United States Patent [19]

Ishikawa et al.

[11] Patent Number: 4,778,743

[45] Date of Patent: Oct. 18, 1988

[54] METHOD FOR PROCESSING LIGHT-SENSITIVE SILVER HALIDE COLOR PHOTOGRAPHIC MATERIAL USING A WASHING SOLUTION SUBSTITUTE

[75] Inventors: Masao Ishikawa; Shigeharu Koboshi; Masayuki Kurematsu, all of Hino, Japan

[73] Assignee: Konishiroku Photo Industry Co., Ltd., Tokyo, Japan

[21] Appl. No.: 43,041

[22] Filed: Apr. 27, 1987

[30] Foreign Application Priority Data

Apr. 30, 1986 [JP] Japan ..... 61-100210
Apr. 30, 1986 [JP] Japan ..... 61-100211

[51] Int. Cl.[4] ..... G03C 7/32; G03C 7/40; G03C 5/24; G03C 5/39

[52] U.S. Cl. ..... 430/376; 430/337; 430/372; 430/384; 430/385; 430/386; 430/387; 430/428; 430/429; 430/463

[58] Field of Search ..... 430/372, 384, 385, 386, 430/387, 428, 429, 463, 421, 337, 376

[56] References Cited

U.S. PATENT DOCUMENTS

| | | | |
|---|---|---|---|
| 3,335,004 | 8/1967 | Wrisley et al. | 430/372 |
| 4,265,431 | 5/1979 | Falomo | 260/112 |
| 4,567,134 | 1/1986 | Koboshi et al. | 430/372 |
| 4,618,569 | 10/1986 | Kurematsu et al. | 430/372 |
| 4,681,835 | 7/1987 | Ishikawa et al. | 430/372 |
| 4,687,731 | 8/1987 | Ishikawa et al. | 430/372 |

*Primary Examiner*—Mukund J. Shah
*Attorney, Agent, or Firm*—Finnegan, Henderson Farabow, Garrett and Dunner

[57] ABSTRACT

Disclosed is a method for processing a light-sensitive silver halide color photographic material, which comprises including at least the step of color developing, the step of processing with a liquor having fixing ability and the step of processing with a washing solution substitute as the final processing step, after imagewise exposure of a light-sensitive silver halide color photographic material containing at least one silver halide emulsion layer on a support, characterized in that at least one layer of the silver halide emulsion layer contains at least one coupler selected from the magenta couplers and the cyan couplers; washing solution substitute contains at least one compound selected from the group consisting of from $2.0\times10^{-5}$ to $2.5\times10^{-2}$ mol per liter of the washing solution substitute of the aldehydes, from $2.0\times10^{-5}$ to $8.0\times10^{-2}$ mol per liter of the washing solution substitute of the aldehyde derivatives and from $2.0\times10^{-5}$ to $8.0\times10^{-2}$ mol per liter of the washing solution substitute of the aldehyde derivatives; and the replenished amount of the washing solution substitute is at least 2 to 50-fold of the amount of processing solution in the processing steps prior to the step of processing with the washing solution substitute, which is carried over into the washing solution substitute by the light-sensitive photographic material processed in the step processed with the liquor having fixing ability.

25 Claims, No Drawings

METHOD FOR PROCESSING LIGHT-SENSITIVE SILVER HALIDE COLOR PHOTOGRAPHIC MATERIAL USING A WASHING SOLUTION SUBSTITUTE

BACKGROUND OF THE INVENTION

This invention relates to a method for processing a light-sensitive silver halide color photographic material, more particularly to a method for processing a light-sensitive silver halide color photographic material according to improved stabilizing processing substituting for water washing.

Generally speaking, light-sensitive silver halide color photographic materials, after image exposure, are subjected to color developing processing, bleaching, processing having fixing ability such as fixing or bleach-fixing processing, and subsequently subjected according to the processing steps such as stabilizing, water washing, etc. In the water washing step subsequent to the processing with a processing liquor having fixing ability, thiosulfate which is a compound for forming water-soluble complexes by reaction with a silver halide, other water-soluble silver complexes, and further sulfite or a metabisulfite, etc., are contained in or attached on the light-sensitive material and thus carried over into a water washing tank, whereby adverse influences remain on the image storability when the amount of washing water is small, as is well known in the art. Accordingly, under the present situation, in order to solve such drawbacks, the salts as mentioned above are washed out from the photographic material by use of a large amount of running water after the processing with a processing liquor having fixing ability. However, for the economical reasons such as storage of water resources, increased sewerage fee and fuel and light expenses as well as pollutative reason, it has been desired to have a processing step in which the amount of washing water is reduced and also measures against pollution have been taken to.

In the prior art, to cope with these problems, for example, a method in which water is permitted to flow countercurrently through a water washing tank with a multi-stage constitution is disclosed German Pat. No. 2,920,222 and S. R. Goldwasser "Water Flow Rate in Immersion-washing of Motion-picture Film" SMPTE. Vol. 64, p. 248–253, May, 1955, etc.

Also, there has been known a processing method in which preliminary washing is provided immediately after fixing bath, thereby reducing the pollutative components which is contained in and attached on the light-sensitive material and thus introduced into the water washing step, and also reducing the amount of washing water.

However, these techniques are not processing methods in which no washing water is used at all. Thus, under the situation in recent years where water resources are dried up and the cost for washing is increased because of price elevation of crude oil, this problem is becoming more serious.

On the other hand, there is a processing method in which stabilizing processing is practiced immediately after photographic processing without performing water washing. For example, silver stabilizing processing with a thiocyanate as described in U.S. Pat. No. 3,335,004 has been known. However, according to this method, since a large amount of inorganic salts are contained in the stabilizing bath, there is the drawback that contamination occurs after drying on the surface of the photographic material. Also, when these stabilizing processing are practiced, it has been also found that there is another drawback of accompaniment of deterioration of dye image during prolonged storage.

As the method for preventing deterioration of dye image during prolonged storage, it has been known in the prior art to use formalin. By use of a processing liquor containing formalin, generation of stain or lowering in density of the dye image can be effectively prevented during prolonged storage, but on the other hand, formalin is a harmful substance and not preferable in decreasing pollution or maintenance of environment, and there is also involved the problem that the liquid storability is liable to be deteriorated to a great extent when a large amount of formalin is used.

On the other hand, processing of color photographic materials is becoming dispersed gradually from a large scale developing station to small scale developing stations called minilabo as represented by camera shops or film handling stations, and presently color photographic materials are processed even in a family restaurant. Thus, under the present situation it has been increasingly demanded to have a system in which decreased pollution can be effected with a replenished amount as small as possible, and yet processing can be done simply and stably without any special knowledge.

SUMMARY OF THE INVENTION

Accordingly, an object of the present invention is to provide a method for processing a light-sensitive silver halide color photographic material which is simple and low in pollution. A second object is to provide a method for processing a light-sensitive silver halide color photographic material which is excellent in stability with lapse of time of liquid and also excellent in storage stability of dye image.

The above objects of the present invention can be accomplished by a method for processing a light-sensitive silver halide color photographic material, which comprises including at least the step of color developing, the step of processing with a liquor having fixed ability and the step of processing with a wash solution substitute as the final processing step, after imagewise exposure of a light-sensitive silver halide color photographic material containing at least one silver halide emulsion layer on a support, characterized in that at least one layer of said silver halide emulsion layer contains at least one coupler selected from magenta couplers represented by Formula I shown below, cyan couplers represented by Formula II shown below, cyan couplers represented by Formula III shown below, and cyan couplers represented by Formula IV shown below; said washing solution substitute contains at least one compound selected from the group consisting of from $2.0\times10^{-5}$ to $2.5\times10^{-2}$ mol per liter of said washing solution substitute of compounds represented by Formula V shown below, from $2.0\times10^{-5}$ to $8.0\times10^{-2}$ mol per liter of said washing solution substitute of compounds represented by Formula VI shown below and from $2.0\times10^{-5}$ to $8.0\times10^{-2}$ mol per liter of said washing solution substitute of compounds represented by Formula VII shown below; and the replenished amount of said washing solution substitute is at least 2 to 50-fold of the amount of processing solution in the processing steps prior to the step of processing with said washing solution substitute, which is carried over into said washing solution substitute by the light-sensitive photographic material processed in the step processed with said liquor having fixing ability:

Formula I

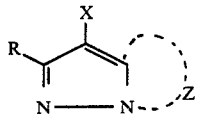

wherein Z represents a group of nonmetallic atoms necessary for formation of a nitrogen containing heterocyclic ring, and the ring formed by said Z may have a substituent; X represents a hydrogen atom or a substituent eliminable through the reaction with the oxidized product of a color developing agent; and R represents a hydrogen atom or a substituent, Formula II

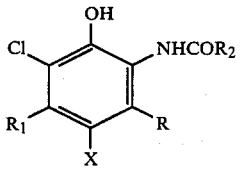

wherein one of R and $R_1$ is a hydrogen atom, and the other is a straight chain or branched alkyl group having at least 2 to 12 carbon atoms, X represents a hydrogen atom or a group eliminatable through the coupling reaction with the oxidized product of an aromatic primary amino color developing agent, and $R_2$ represents a ballast group, Formula III

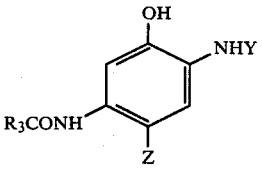

Formula IV

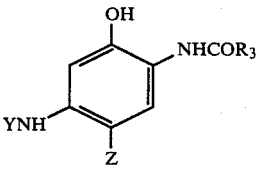

wherein Y represents

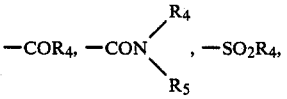

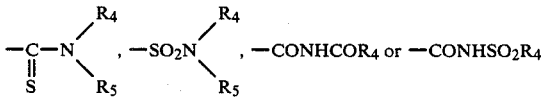

($R_4$ represents an alkyl group, an alkenyl group, a cycloalkyl group, an aryl group or a heterocyclic group, $R_5$ represents a hydrogen atom, an alkyl group, an alkenyl group, a cycloalkyl, an aryl group or a heterocyclic group, or $R_4$ and $R_5$ may be bonded together to form a 5- or 6-membered ring), $R_3$ represents a ballast group, Z represents a hydrogen atom or a group eliminatable through the coupling with the oxidized product of an aromatic primary amine color developing agent, $A_1$—CHO Formula V wherein $A_1$ represents a hydrogen atom, an alkyl group having 1 to 6 carbon atoms, a formyl group, an acyl group or an alkenyl group, Formula VI

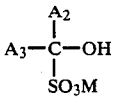

wherein each of $A_2$ and $A_3$ represents a hydrogen atom, an alkyl group having 1 to 6 carbon atoms, a formyl group, an acryl group or an alkenyl group, and M represents an alkali metal, Formula VII

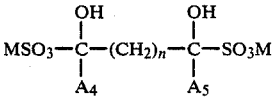

wherein each of $A_4$ and $A_5$ represents a hydrogen atom, an alkyl group having 1 to 6 carbon atoms, a formyl group, an acyl group or an alkenyl group, M represents an alkali metal and n represents an integer of 0 to 4.

DETAILED DESCRIPTION OF THE INVENTION

To describe in detail below about the present invention, it has been well known in the art to carry out processing with a processing liquor containing formalin, a stabilizing processing liquor generally used in the final step of a color negative film for photographing, and it has been already disclosed in Japanese Unexamined Patent Publication No. 126533/1984, etc., to replace the water washing step with the stabilizing processing step substituting for water washing in place of performing the water washing step and the stabilizing processing with a liquor containing formalin after processing with a processing liquor having fixing ability, but the stabilizing liquor containing formalin is separated from the water washing substitute, thereby prohibiting the stabilizing liquor to flow into the stabilizing liquor for substituting for water washing. However, as described above, by processing with a processing liquor containing formalin, there is the effect of preventing yellow stain after storage of dye image or lowering in density, and formalin is important as the technique for improving image storability. However, formalin itself is highly harmful and not preferable in aspect of low pollution, and further processing with a water washing substitute containing formalin after processing with a processing liquor having fixing ability poses a problem in liquid storability, particularly that sulfidization is liable to occur. Thus, it has been very difficult to enhance liquid storability, to improve image storability and yet to attain lower pollution. The present inventors have made intensive studies, and as result, have found the following fact.

By processing with a processing liquor containing formalin, sulfidization in the water washing substitute may be considered to be because the components in the previous baths carried over from the light-sensitive material by continuous processing, for example, sulfite ions in the bleach-fixing liquor or fixing liquor components react with formalin to lower preservability. whereby silver thiosulfate complex is decomposed to effect sulfidization. Whereas, it has been found that the above sulfidization depends greatly on the concentration of formalin, that sulfidization can be prevented by lowering the concentration of formalin, and also unexpectedly that a remarkable sulfidization prevention effect can be exhibited also by use of a bisulfite adduct of an acetaldehyde derivative as substitute for a formalin. However, when the concentration of formalin is lowered, the influence on the image storability must be taken into consideration, and the present inventors were confronted with a new difficulty.

The present inventors have further intensively investigated, and consequently found that, even when the concentration of formalin may be lowered, image storability can be improved by use of a magenta coupler represented by Formula I and cyan coupler represented by Formulae I–IV, and also surprisingly that not only no sulfidization occurs at all by use of a large amount of a bisulfite adduct of an aldehyde derivative represented by Formula VI or VII, but also image storability can be improved.

The terms "washing solution substitute" and "process with washing solution substitute" used in this specification will be explained below.

"Process with washing solution substitute according to this invention" means a process which replaces or plays the same role as water washing process subsequent to a fixing step or a bleach-fixing step. As already described above, conventional water washing process is a process for washing away, by washing with water, a processing solution of a previous bath contained in structural layers of the light-sensitive material, specifically a large amount of thiosulfates, chemicals and silver complex salts contained in a fixing solution or a bleach-fixing solution, chemicals contained in a color developing solution and the like. This process includes, for example, a method in which a large amount of flowing water is flown on the surface of a light-sensitive material in a water washing bath to remove the processing solution of the previous bath as rapid as possible, and a substituting water washing method in which a light-sensitive material is dipped in a constant amount of water and the water is replaced by fresh water after constant time lapse, and then these procedures are repeated, etc. Although this water washing process is usually carried out only by use of water, it may be conducted after dipping the light-sensitive material in a bath containing salts such as sodium sulfite, etc. for several minutes in order to accelerate the processing speed. In any event, the water processing is carried out by using water. Therefore, a large amount of water for washing is required in order to prevent any troubles such as stain, discoloration and fading of images, upon drying or storage of the light-sensitive material, which are cause by chemicals such as thiosulfate remained in the light-sensitive material. Further, since equipments for discharging the water used for the water washing process are required, such process is not advantageous spatially and economically. The process with the washing solution substitute according to this invention is a process in which such problems have been dissolved and improved. The processing solution used for the process is not merely water, but a solution containing an antimildew, antiseptic, disinfection means, further optionally, a chelating agent having the chelating stabilization degree against ferric ion of 8 or more, ammonia compounds, organic acids salts, pH adjusting agents, surfactants, sulfites, brightening agents, etc.

In the conventional water washing process, the compounds adhered or permeated to the light-sensitive material such as thiosulfates, etc. are washed away by replenishing water in about 5 lit. to 150 lit. per 1 $m^2$ of the light-sensitive material. On the other hand, according to the process with washing solution substitute of this invention, such compounds adhered or permeated to the light-sensitive material can be washed away by a replenished amount of only about 0.01 lit. to 2.5 lit. per 2 $m^2$ of the light-sensitive material. Further, since the process of this invention can be made by use of a very small amount of the replenishing solution as compared with in the conventional processes, feeding- and discharging-piping equipments of water to an automatic processing machine which has been indepensable in the conventional water washing process becomes not to be necessarily required, and thus miniturization of the equipment can be accomplished.

Next, this invention will be explained more specifically.

In the magenta coupler represented by the above Formula I according to the present invention:

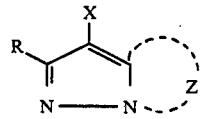

I

Z represents a group of non-metal atoms necessary for formation of a nitrogen-containing heterocyclic ring, and the ring formed by said Z may have substituents.

X represents a hydrogen atom or a substituent eliminatable through the reaction with the oxidized product of a color developing agent.

R represents a hydrogen atom or a substituent.

Examples represented by the above R may include a halogen atoms, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, an sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As a halogen atom, for example, a chlorine atom, a bromine atom may be used, particularly preferably a chlorine atom.

The alkyl group represented by R may include preferably those having 1 to 32 carbon atoms, the alkenyl group or the alkynyl group represented by R those having 2 to 32 carbon atoms and the cycloalkyl group or the cycloalkenyl group represented by R those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents (e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through an oxygen atom such as of a hydroxy group, an alkoxy group, an aryloxy group, a heterocyclicoxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.).

More specifically, there may be included, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-{α-[4''-(p-hydroxybenzenesulfonyl)-phenoxy]dodecanoylamino}phenylpropyl group, a 3-{4'-[α-(2'',4''-di-t-amylphenoxy)butaneamido]phenyl}propyl group, a 4-[α-(o-chlorophenoxy)tetradecaneamidophenoxy]propyl group, an allyl group, a cyclopentyl group, a cyclohexyl group, and so on.

The aryl group represented by R may prefeably be a phenyl group, which may also have a substituent (e.g., an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphosphonyl group and the like; alkoxyphosphonyl groups such as an octyloxyphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group ), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R may be, for example, bicyclo[2.2.1]heptan-1-yl, tricyclo[3.3.1.1]decan-1-yl, 7,7-dimethylbicyclo[2.2.1-]heptan-1-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substituents or atoms for the aryl groups, including, for example, a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, an m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an α-ethylpropanamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzenesulfonamide and the like.

The imide group represented by R may be either open-chained or cyclic, which may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminatable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include, in addition to the carboxyl group, the groups represented by the formula:

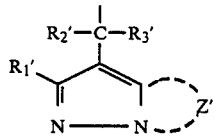

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heterocyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

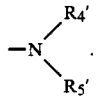

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ or $R_5'$ and alkyl groups. Typical examples of said aryl group may be, for example, a phenyl group, a 1-naphthyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, and N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanophenylcarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z or Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in Formula I and Formulae I-1 to I-7 as hereinafter described has a moiety of the formula:

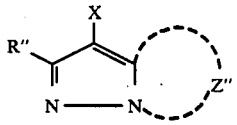

(wherein R", X and Z" have the same meanings as R, X and Z in Formul I), the so-called bis-form type coupler is formed, which is of course included in the present invention. The ring formed by Z, Z', Z" or $Z_1$ as hereinafter described may also be fused with another ring (e.g. a 5- to 7-membered cycloalkene). For example, $R_5$ and $R_6$ in Formula I-4, $R_7$ and $R_8$ in Formula I-5 may be bonded to each other to form a ring (e.g. a 5- to 7-membered rings).

The compounds represented by Formula I can be also represented specifically by the following Formulae I-1 through I-6.

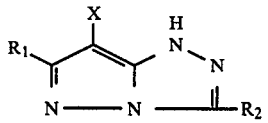

I-1

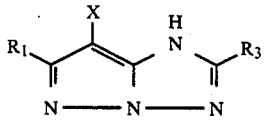

I-2

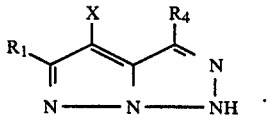

I-3

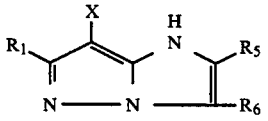

I-4

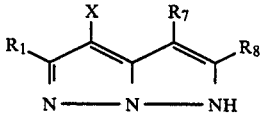

I-5

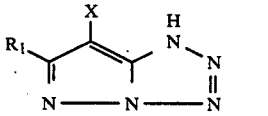

I-6

In the above Formulae I-1 to I-6, $R_1$ to $R_8$ and X have the same meanings as the above R and X.

Of the compounds represented by Formula I, those represented by the following Formula I-7 are preferred.

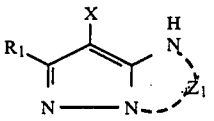

I-7 wherein $R_1$, X and $Z_1$ have the same meanings as R, X and Z in Formula I.

Of the magenta couplers represented by Formulae I-1 to I-6, the magenta coupler represented by Formula I-1 is particularly preferred.

To describe about the substituents on the heterocyclic ring in Formulae I to I-7, R in Formula I and $R_1$ in the Formulae I-1 to I-7 should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by Formula I-8 shown below:

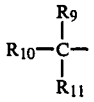

I-8

In the above Formula, each of $R_9$, $R_{10}$ and $R_{11}$ represents a hydrogen atom, a halogen atom, an alkyl group, a cycloalkyl group, an alkenyl group, a heterocyclic group, an alkynyl group, an aryl group, a heterocyclc group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group, and at least two of said $R_9$, $R_{10}$ and $R_{11}$ are not a hydrogen atom.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above Formula I, and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possesed thereby may include examples of cycloalkyl, cycloalkenyl and heterocyclic groups as mentioned for substituents on the R in the aforesaid Formula I and substituents thereof.

Of the compounds of Formula I-8, preferred are: (i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in Formula I and the substituents thereof.

In the following examples of the magenta coupler of the present invention are enumerated, which are not limitatative of the present invention.

M-1

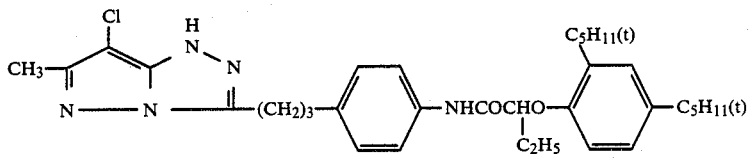

M-2

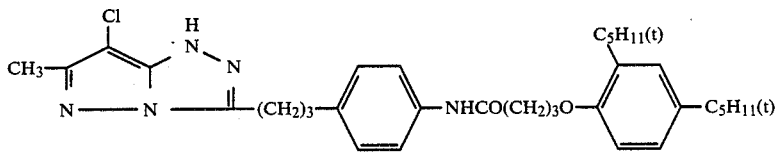

M-3

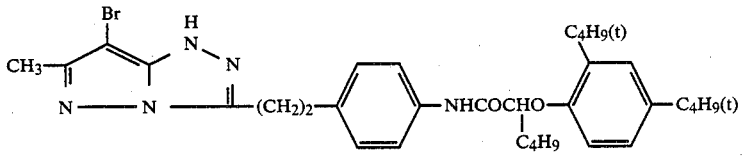

M-4

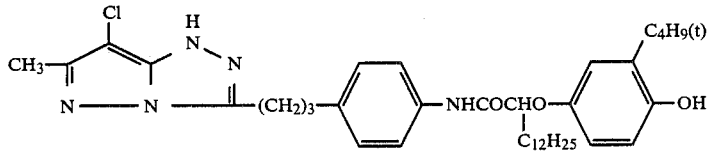

M-5

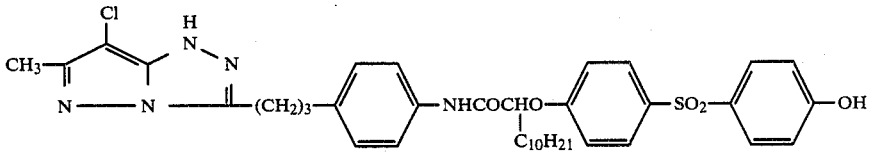

M-6

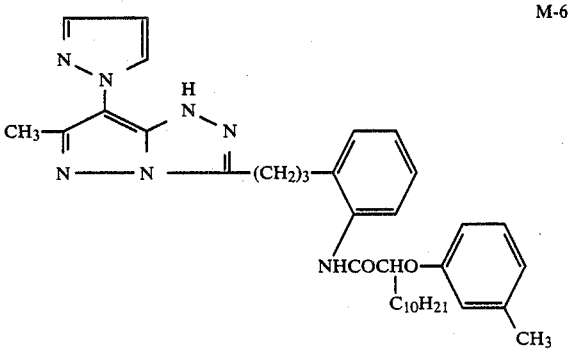

M-7

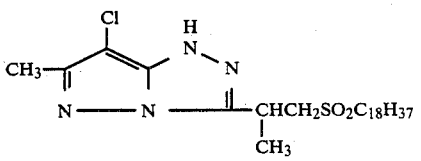

M-8

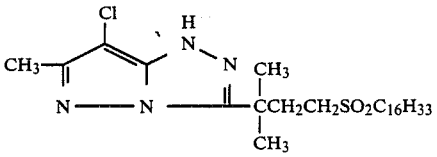

M-9

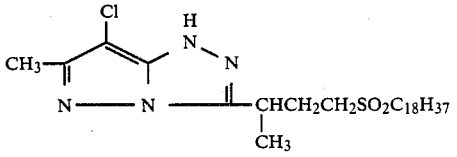

-continued
M-10
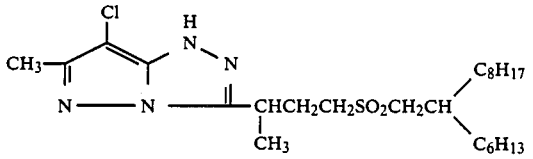
M-11
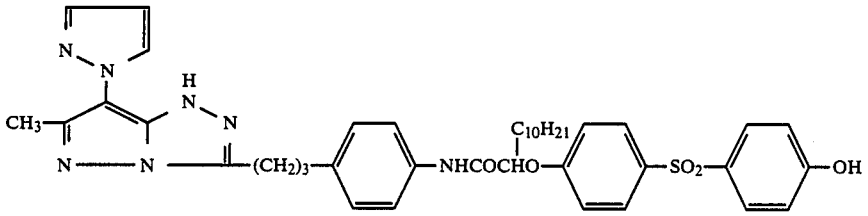
M-12
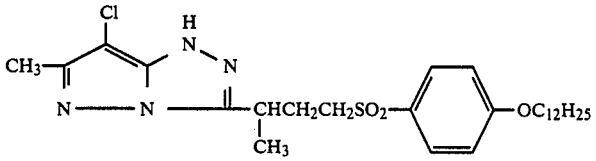
M-13
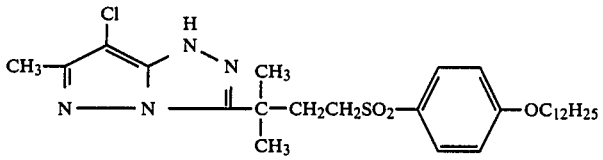
M-14
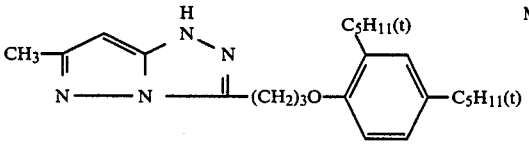
M-15
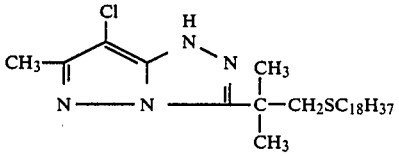
M-16
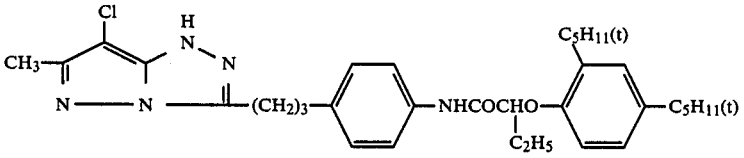
M-17
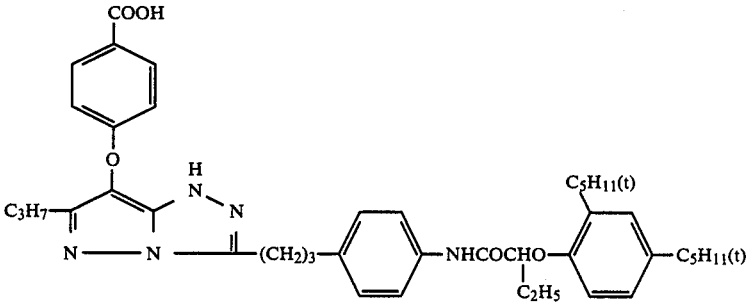
M-18
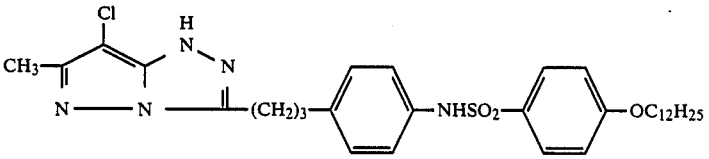

-continued
M-19
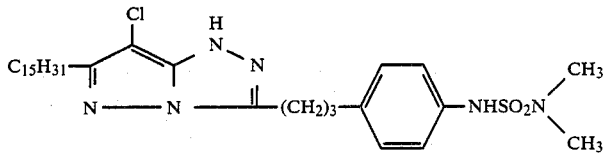
M-20
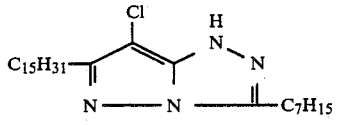
M-21
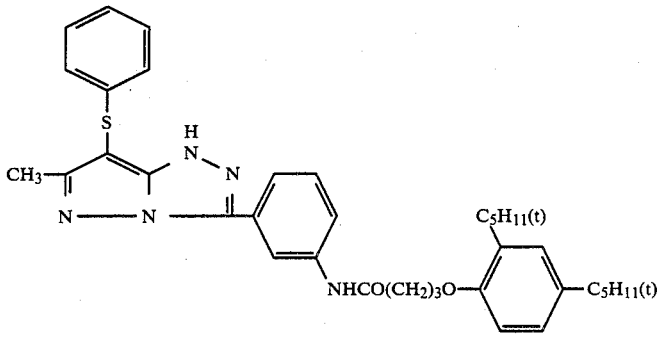
M-22
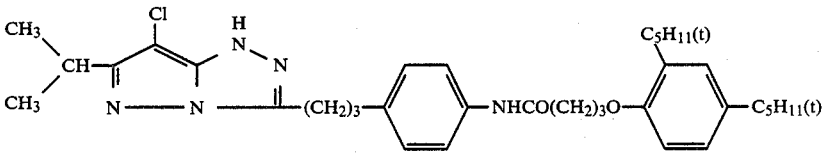
M-23
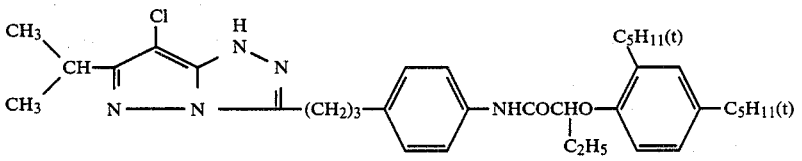
M-24
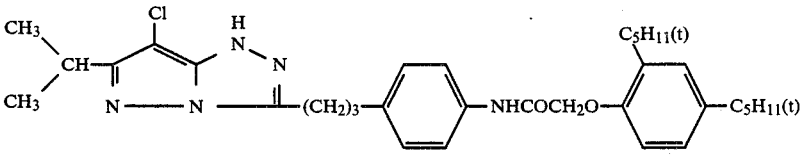
M-25
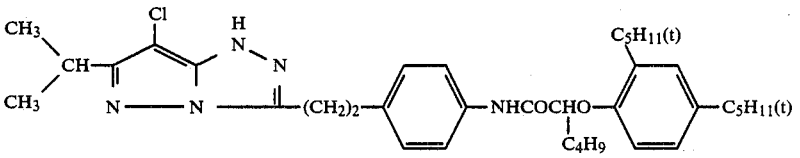
M-26
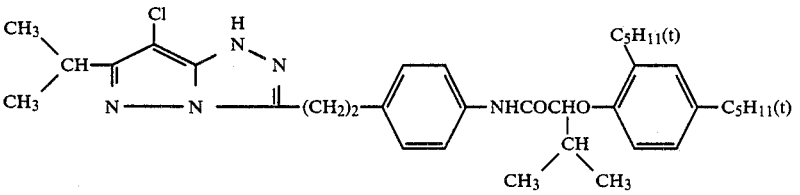

-continued
M-27
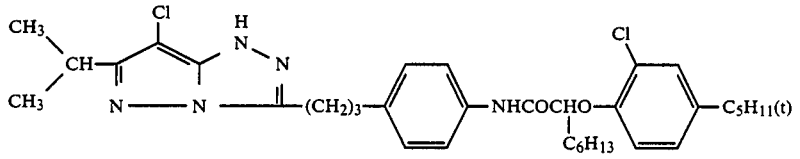
M-28
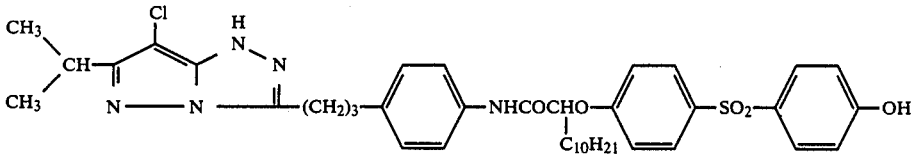
M-29
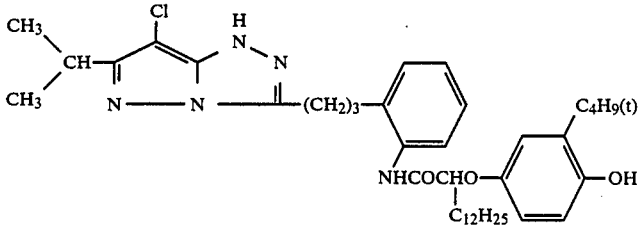
M-30
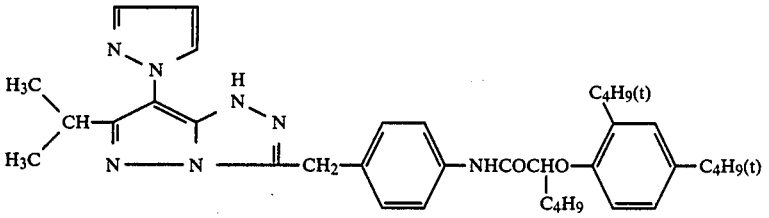
M-31
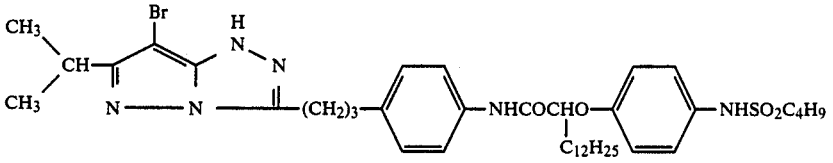
M-32
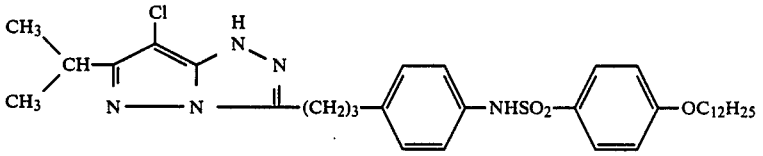
M-33
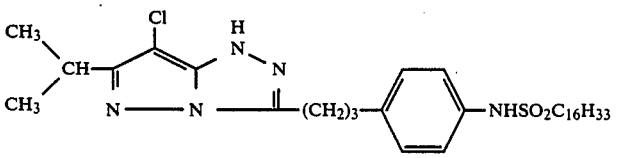
M-34
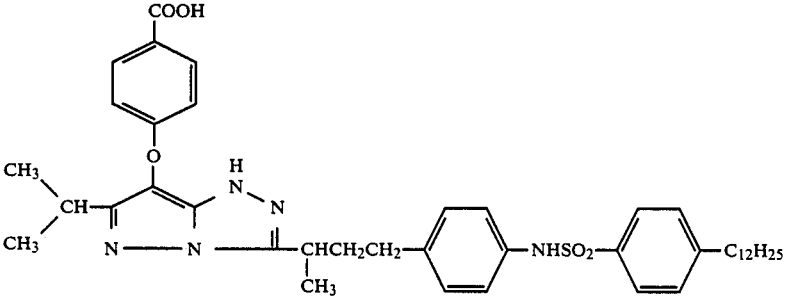

-continued
M-35
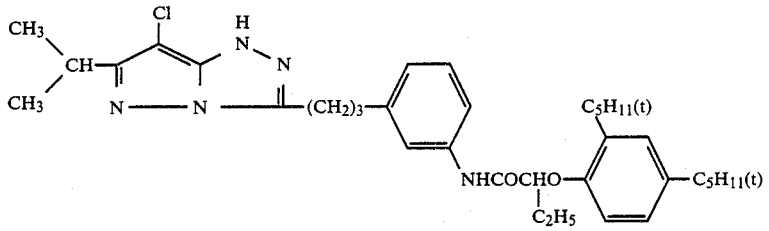
M-36
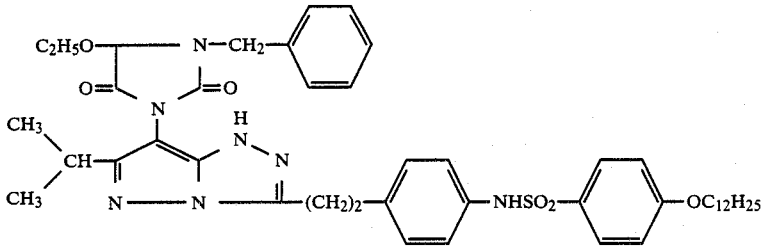
M-37
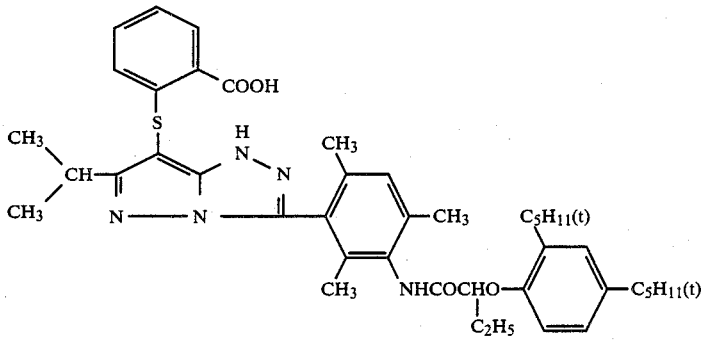
M-38
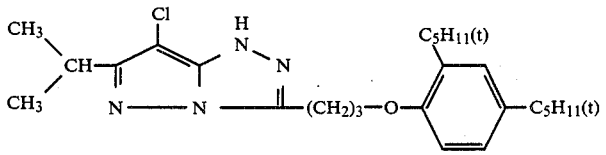
M-39
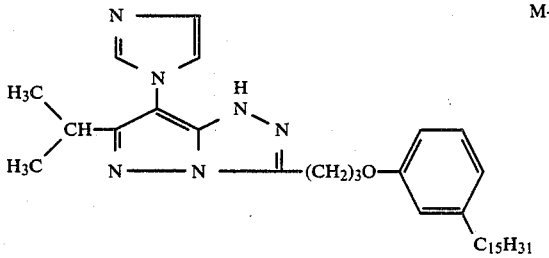
M-40
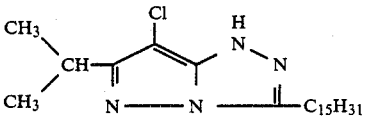
M-41
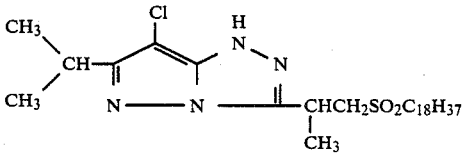
M-42
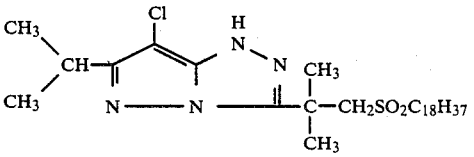
M-43
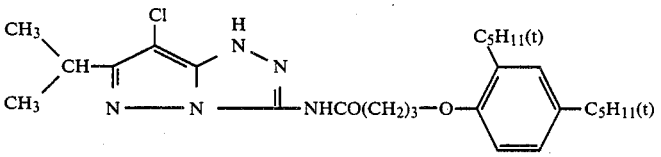

-continued
M-44
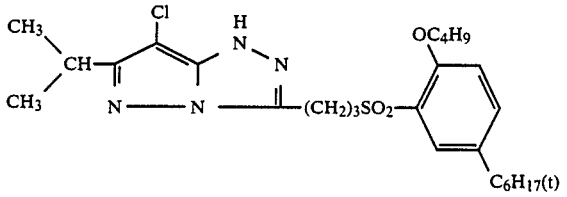
M-45
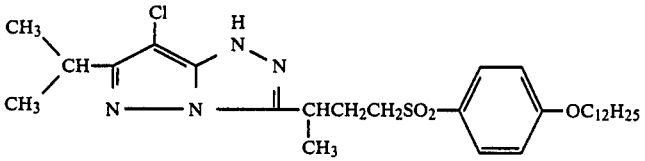
M-46
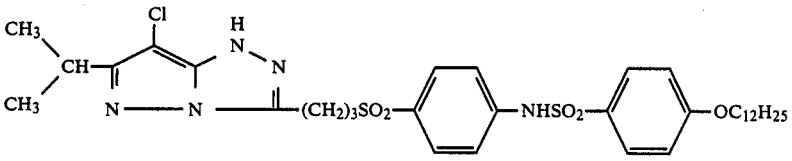
M-47
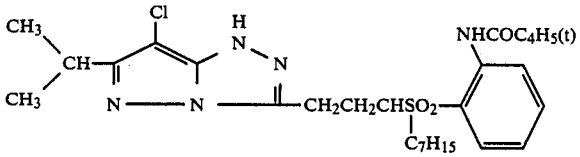
M-48
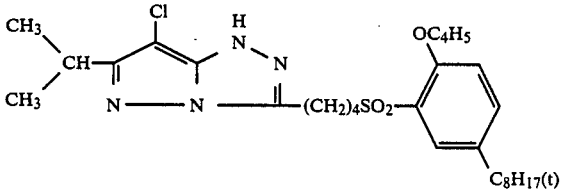
M-49
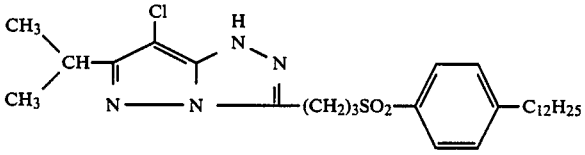
M-50
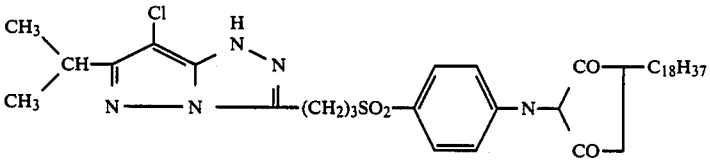
M-51
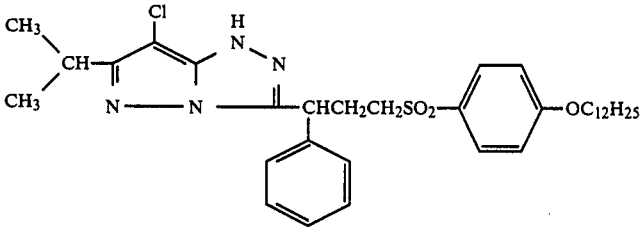
M-52
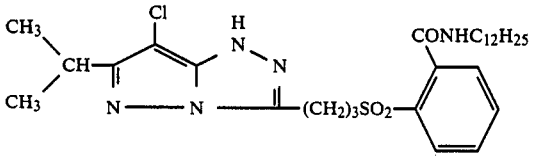

-continued
M-53
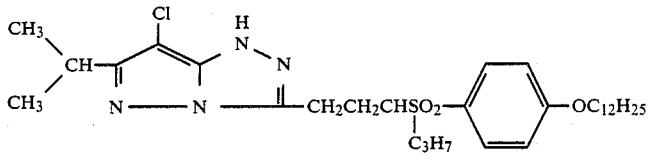
M-54
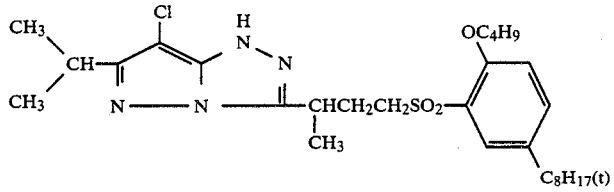
M-55
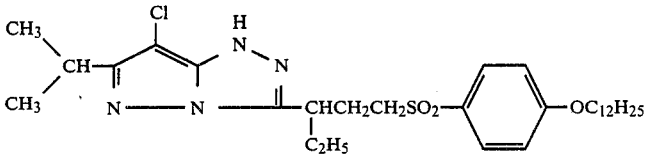
M-56
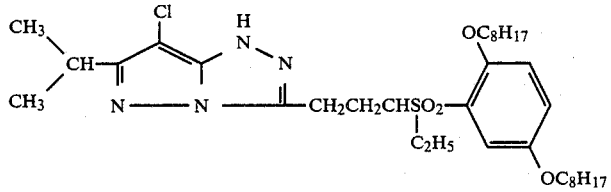
M-57
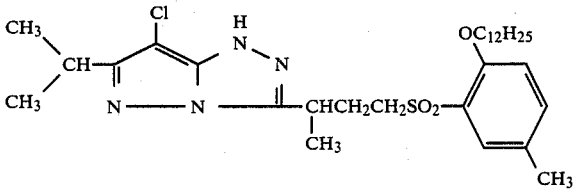
M-58
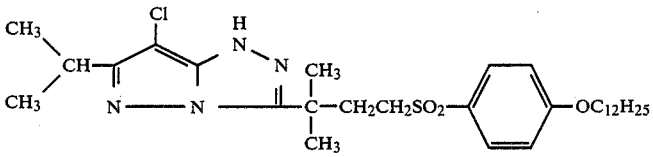
M-59
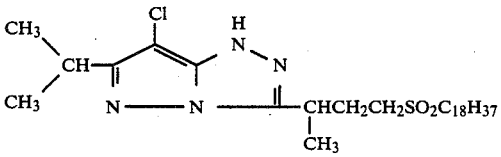
M-60
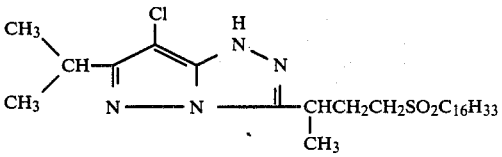
M-61
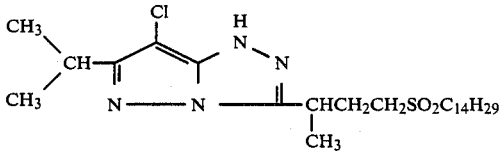
M-62
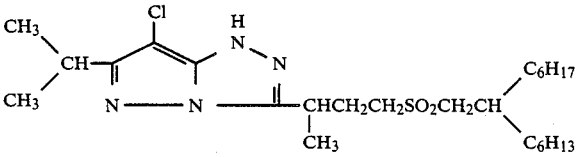

-continued
M-63
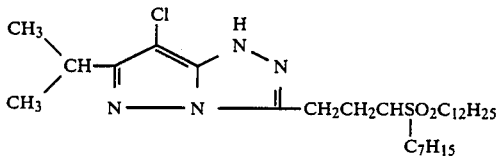
M-64
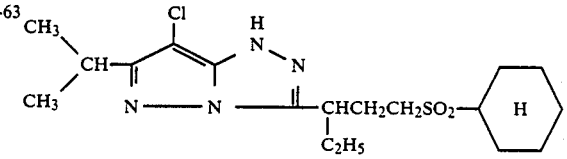
M-65
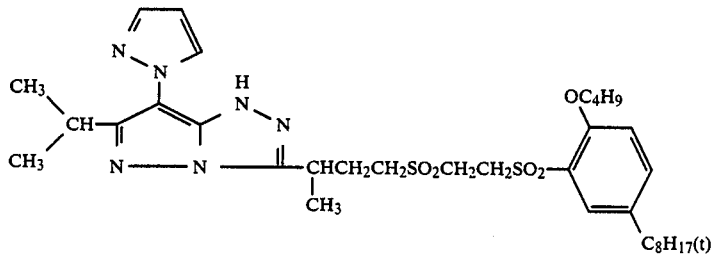
M-66
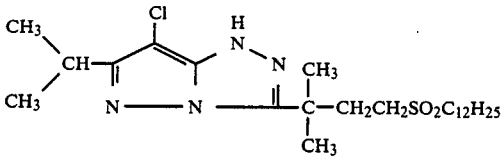
M-67
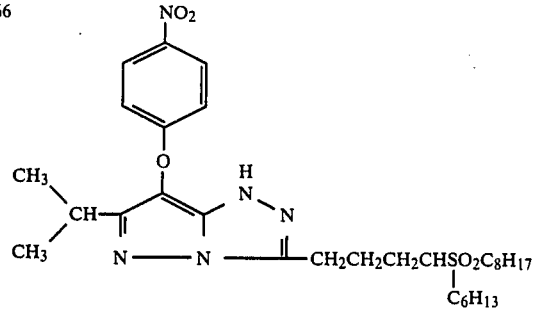
M-68
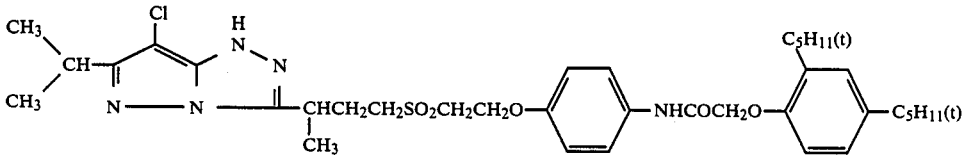
M-69
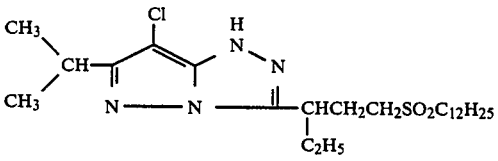
M-70
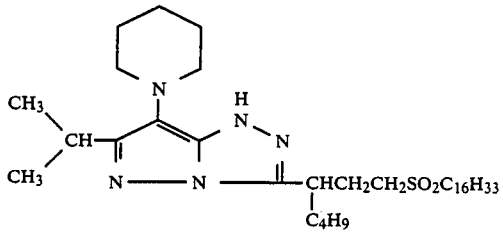
M-71
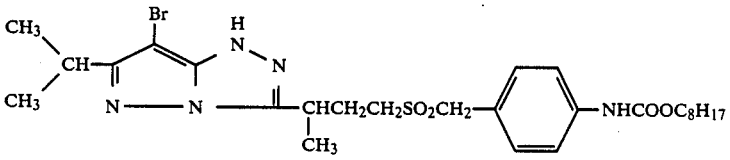
M-72
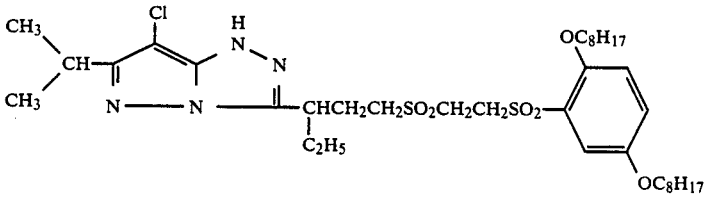

-continued
M-73
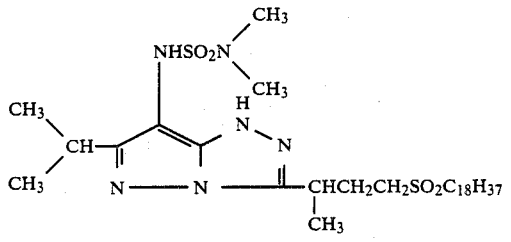
M-74
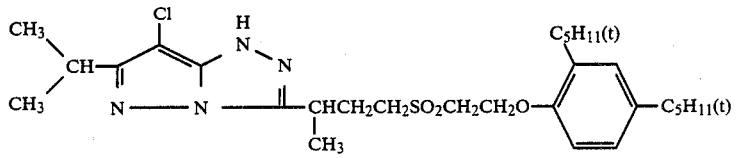
M-75
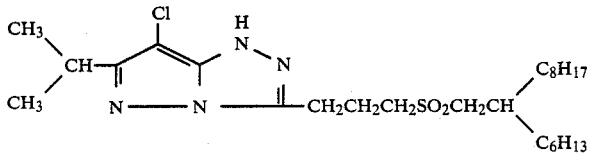
M-76
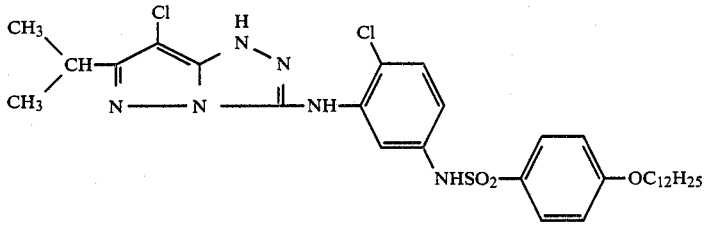
M-77
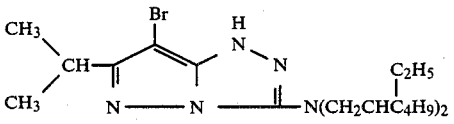
M-78
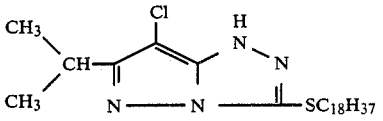
M-79
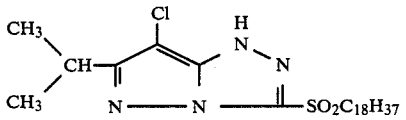
M-80
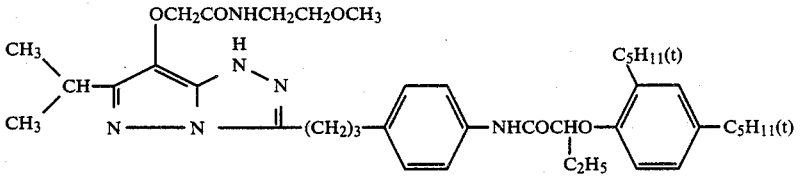
M-81
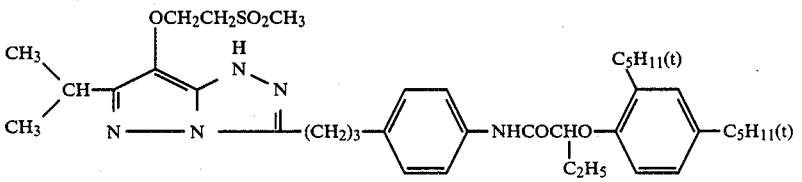
M-82
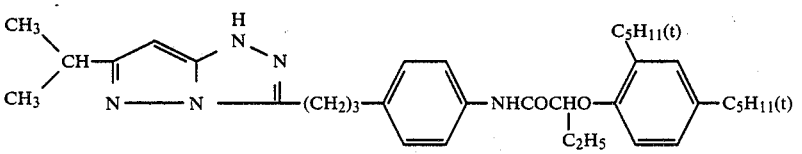

-continued
M-83
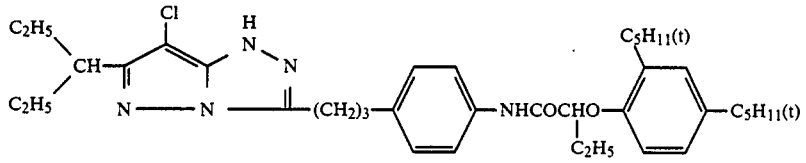
M-84
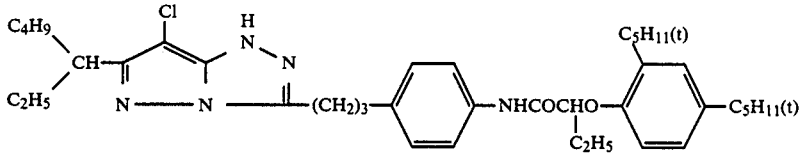
M-85
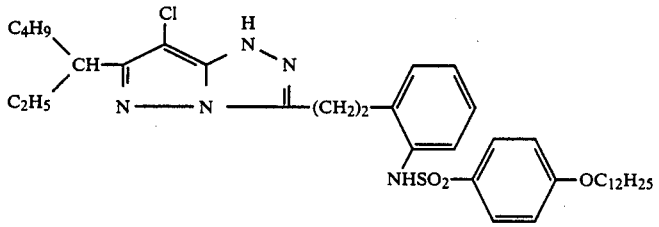
M-86
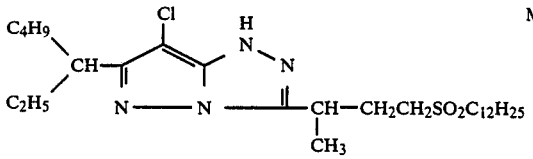
M-87
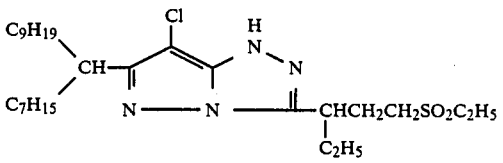
M-88
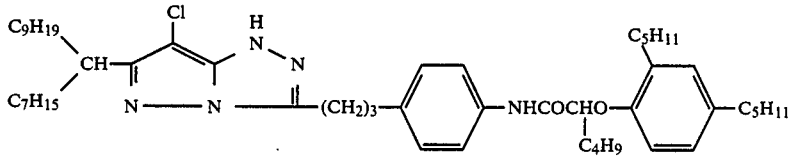
M-89
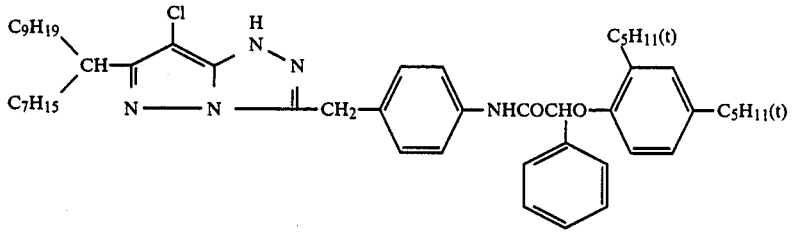
M-90
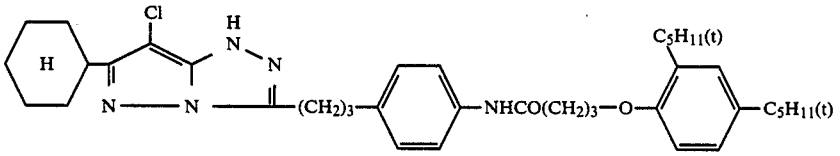
M-91
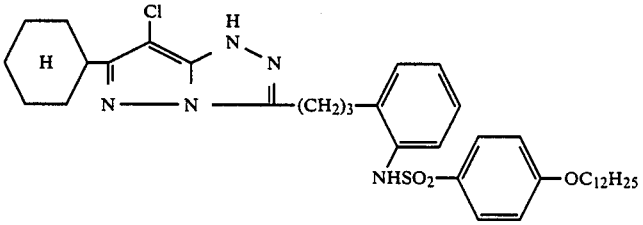

-continued
M-92
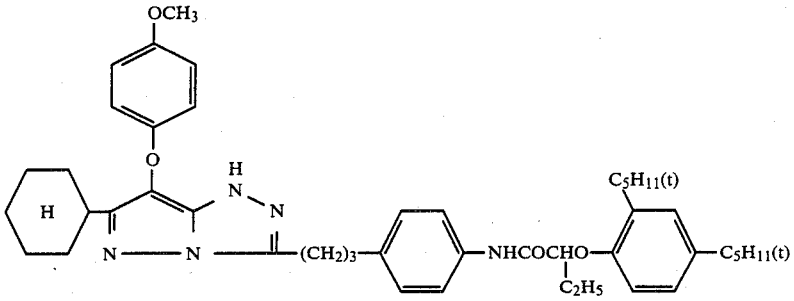
M-93
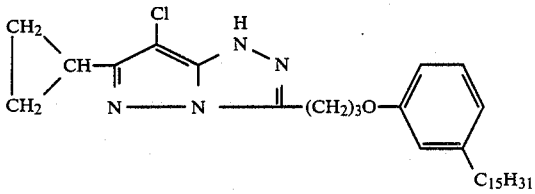
M-94
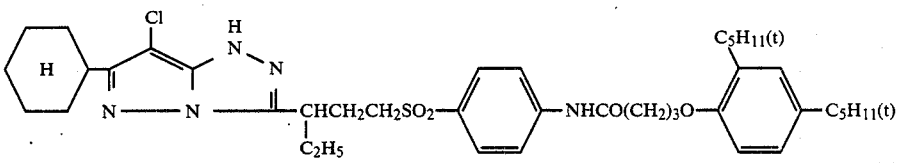
M-95
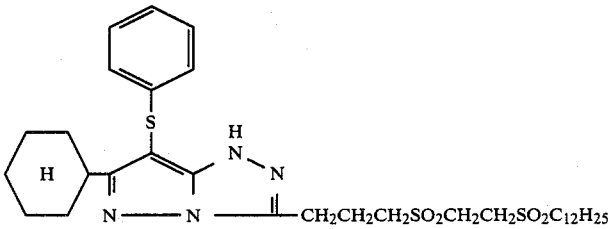
M-96
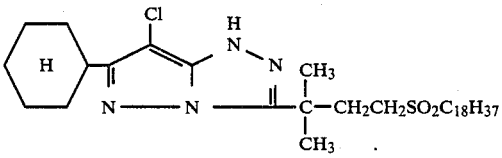
M-97
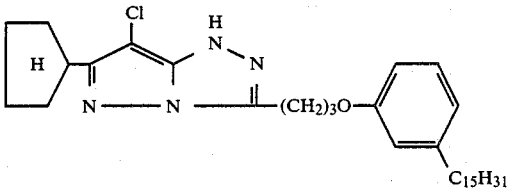
M-98
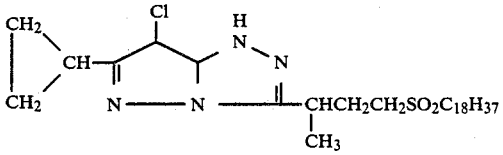
M-99
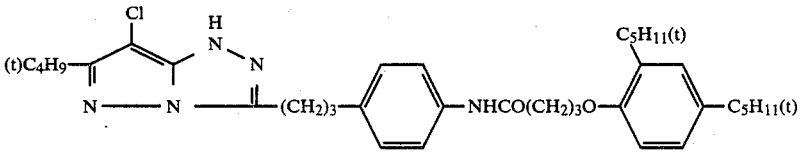
M-100
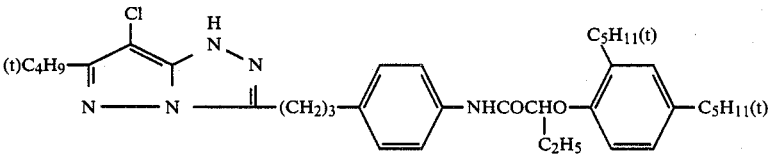

-continued
M-101
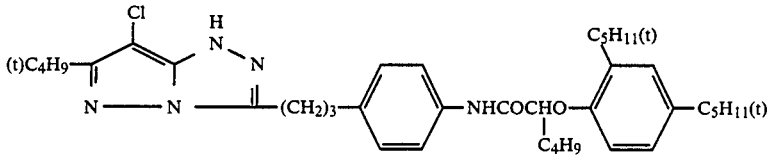
M-102
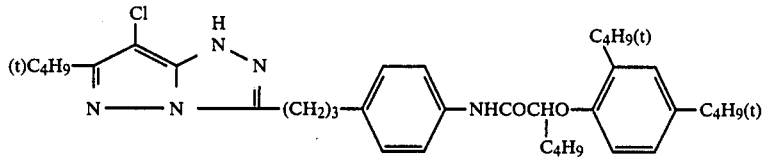
M-103
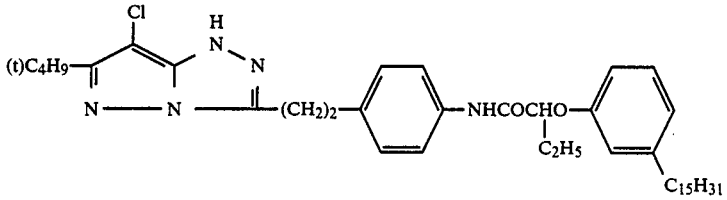
M-104
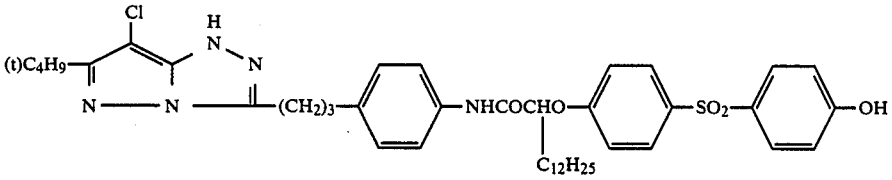
M-105
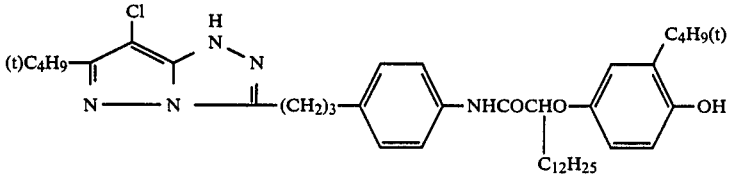
M-106
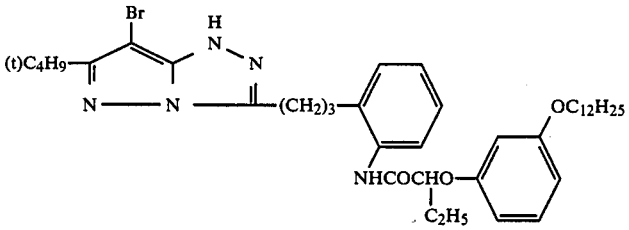
M-107
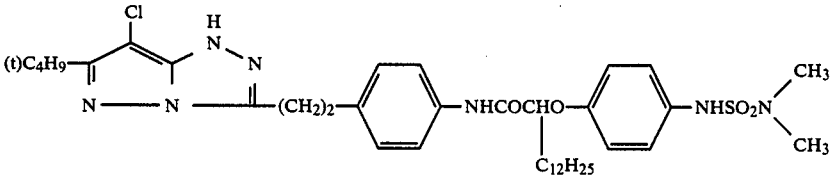
M-108
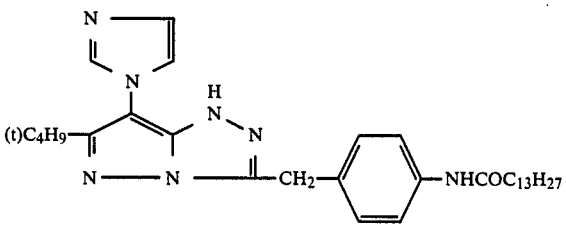

-continued
M-109
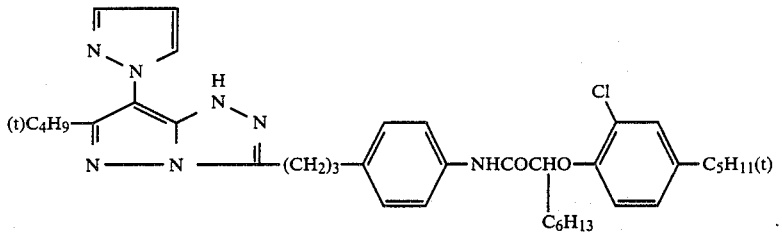
M-110
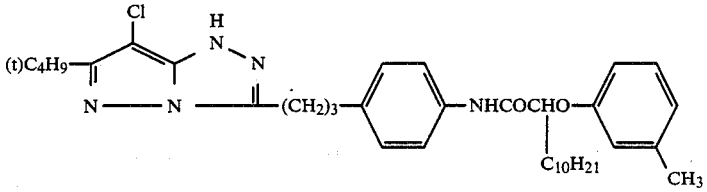
M-111
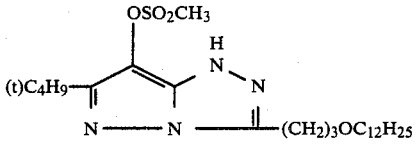
M-112
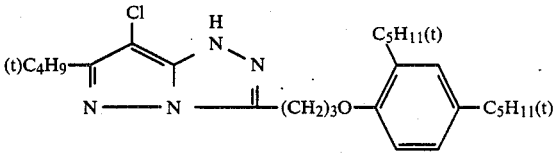
M-113
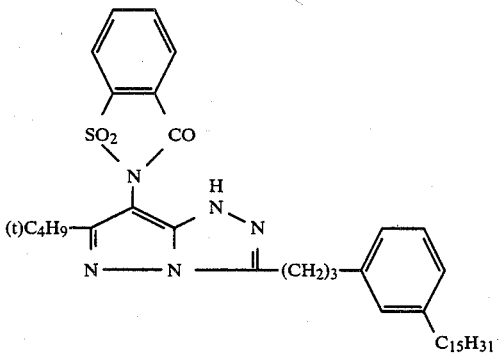
M-114
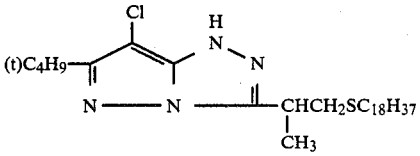
M-115
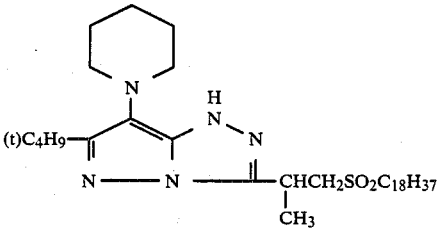
M-116
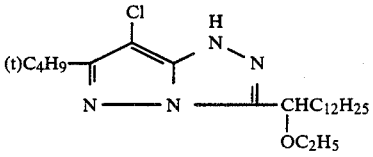
M-117
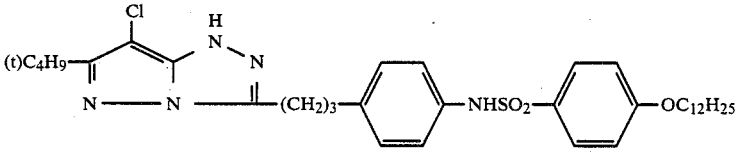

-continued
M-118
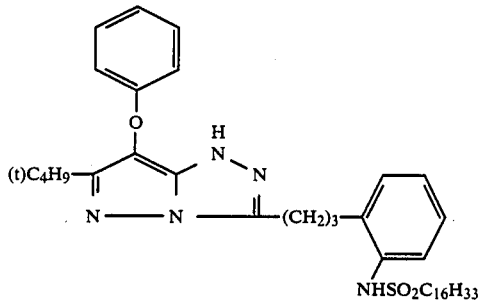
M-119
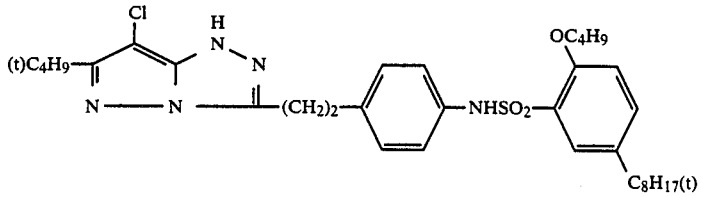
M-120
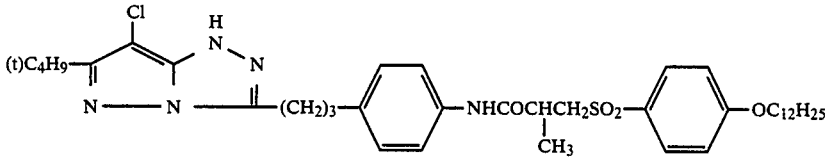
M-121
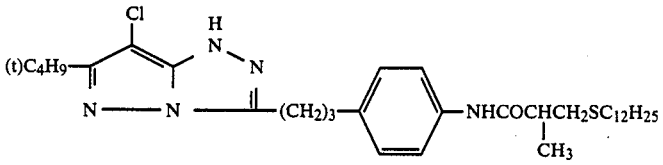
M-122
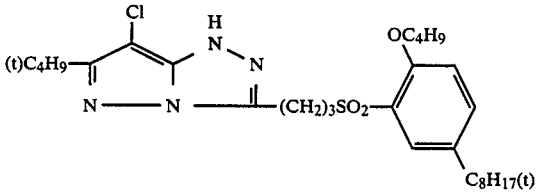
M-123
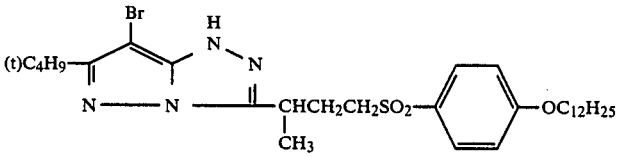
M-124
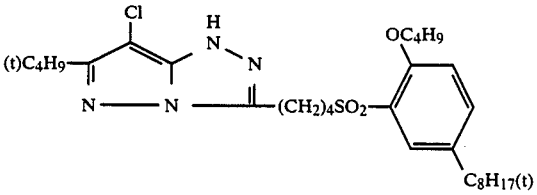

-continued
M-125
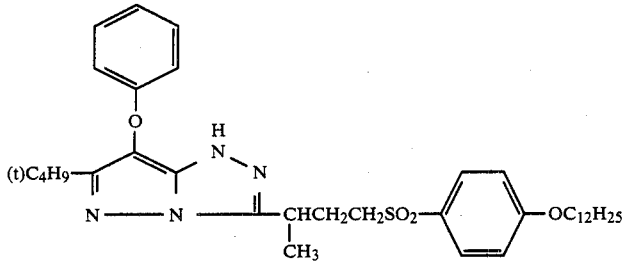
M-126
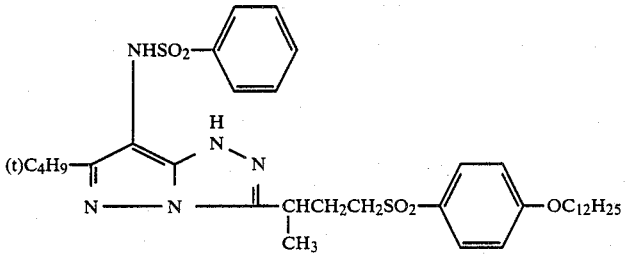
M-127
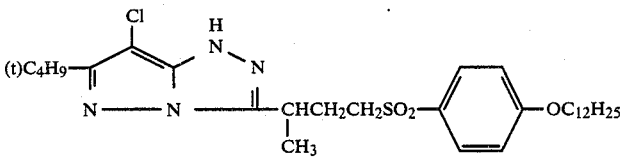
M-128
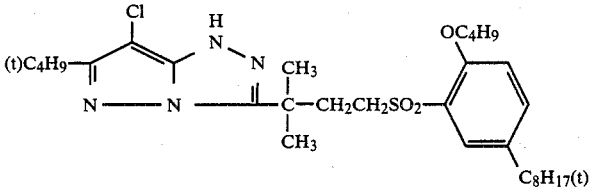
M-129
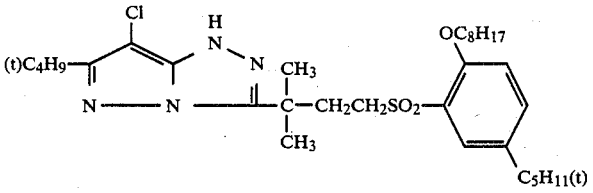
M-130
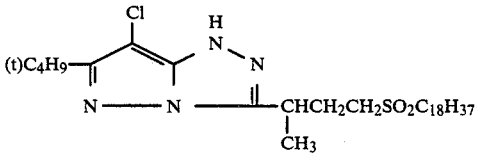
M-131
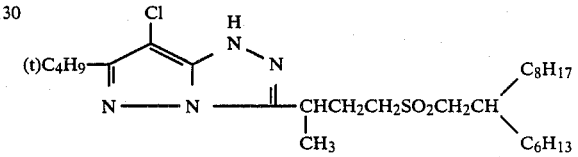
M-132
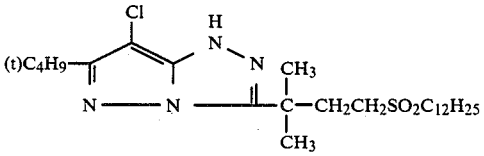
M-133
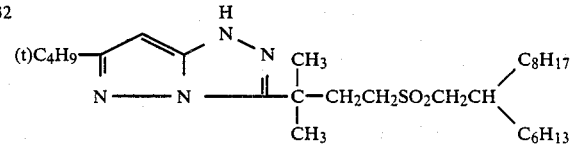

-continued
M-134
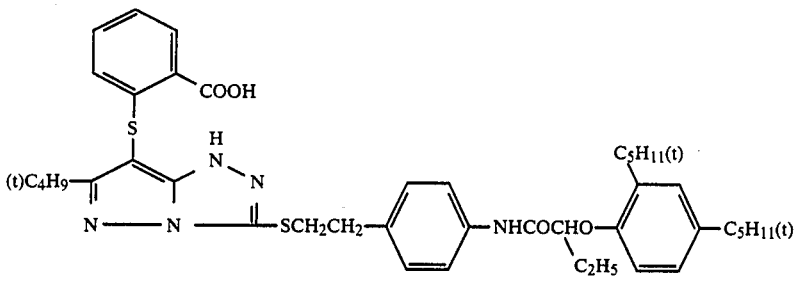
M-135
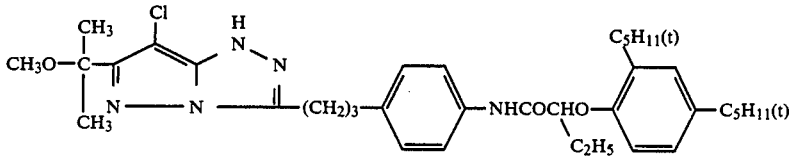
M-136
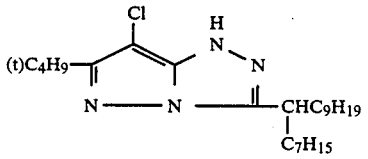
M-137
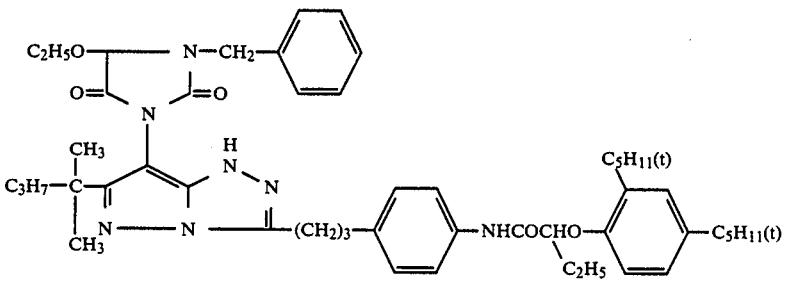
M-138
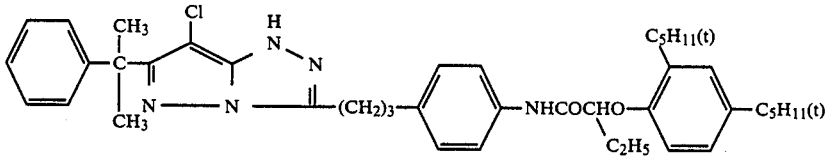
M-139
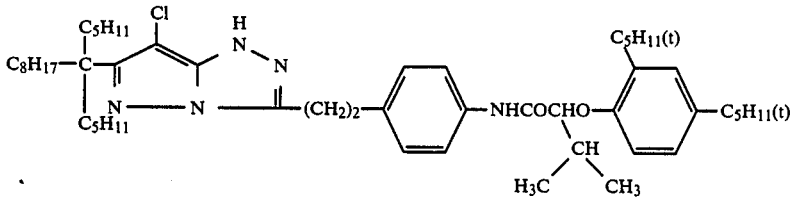
M-140
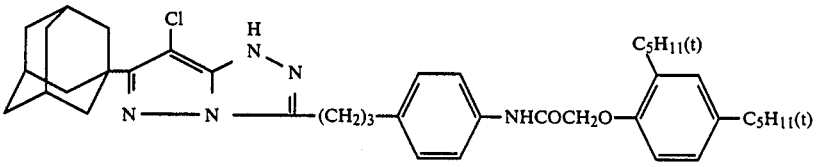
M-141
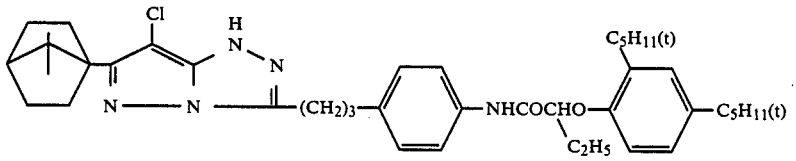

-continued
M-142
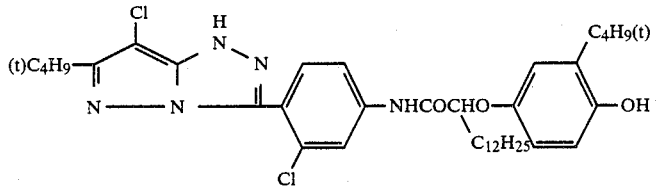
M-143
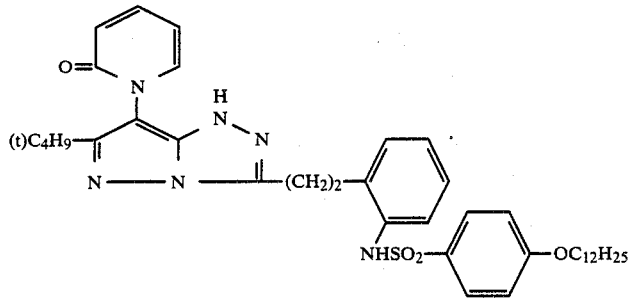
M-144
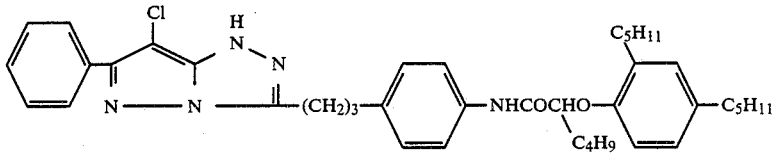
M-145
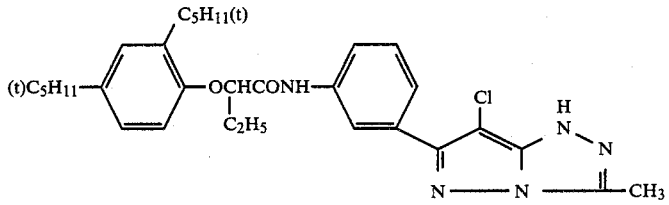
M-146
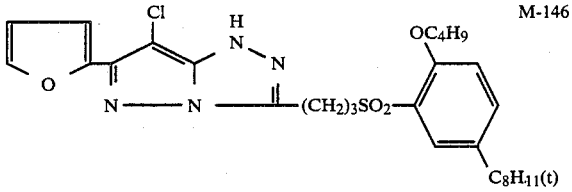
M-147
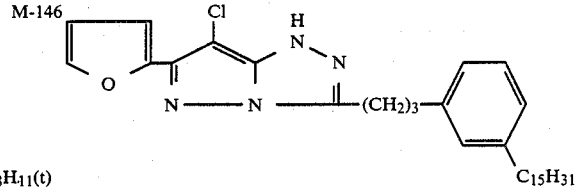
M-148
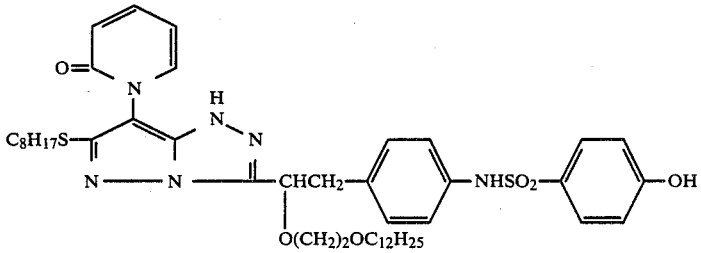
M-149
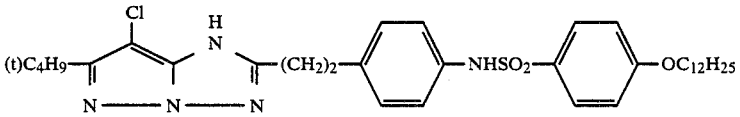
M-150
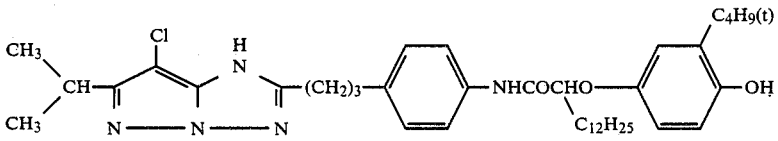

-continued
M-151
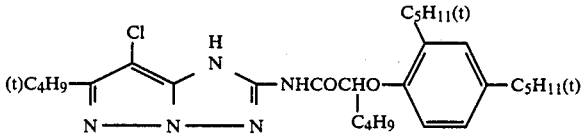
M-152
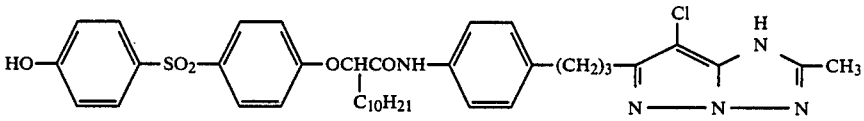
M-153
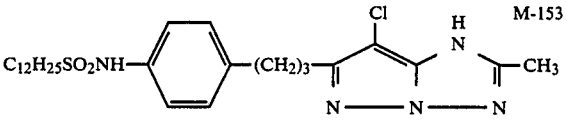
M-154
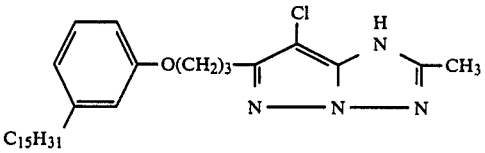
M-155
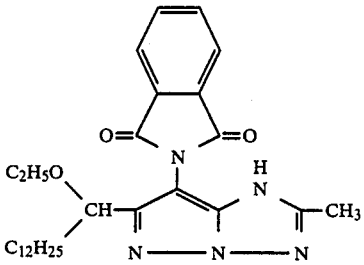
M-156
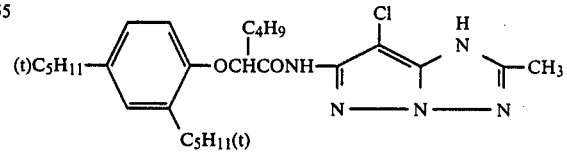
M-157
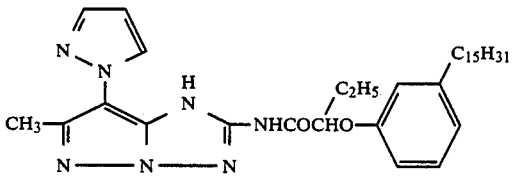
M-158
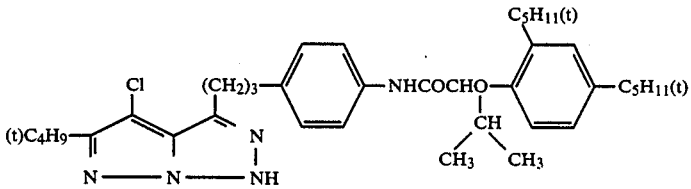
M-159
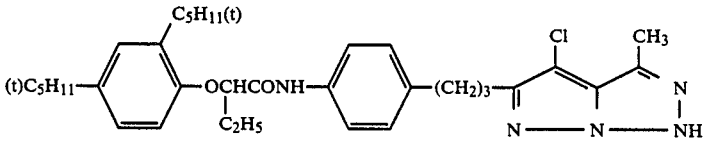
M-160
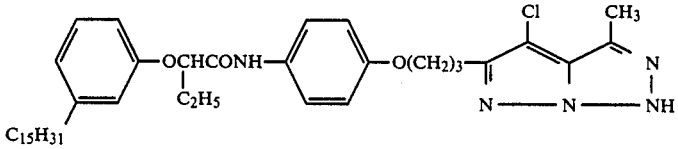

-continued
M-161
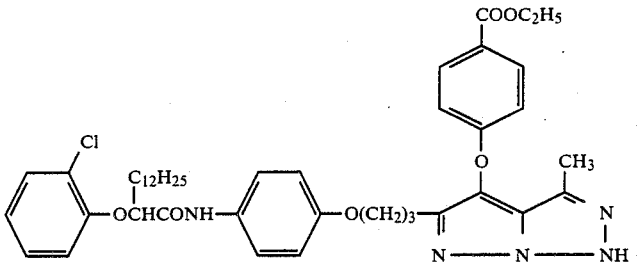
M-162
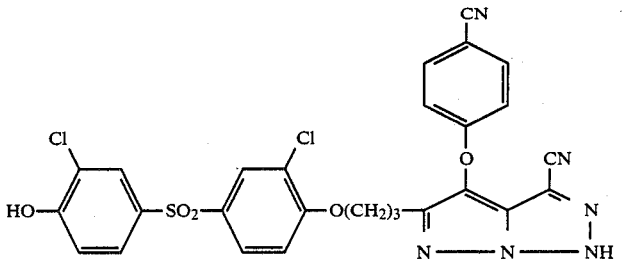
M-163
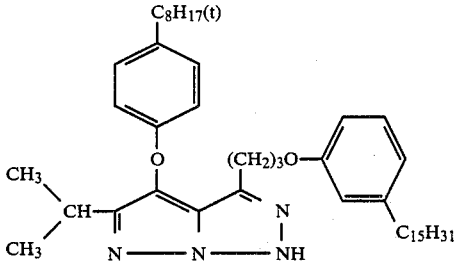
M-164
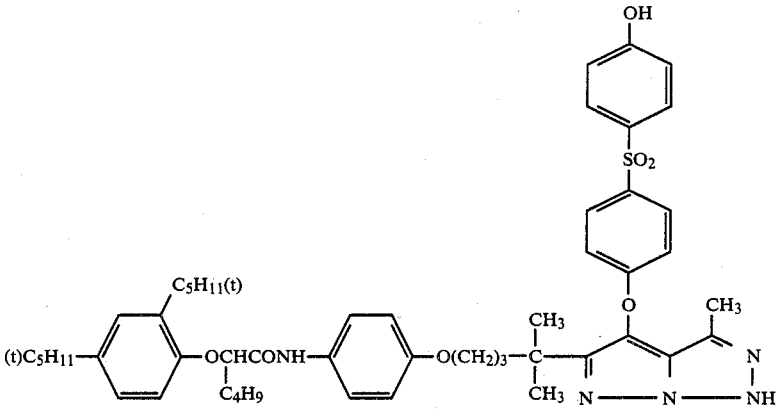
M-165
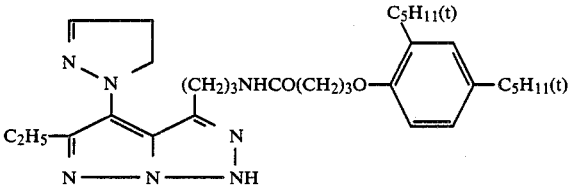
M-166
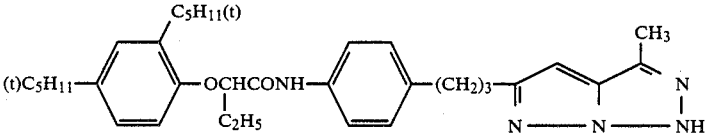

-continued
M-167
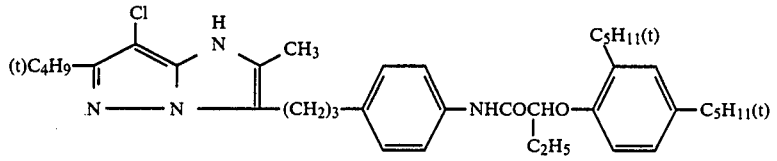
M-168
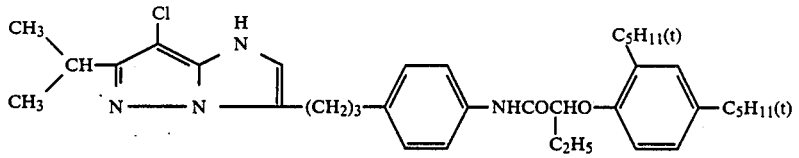
M-169
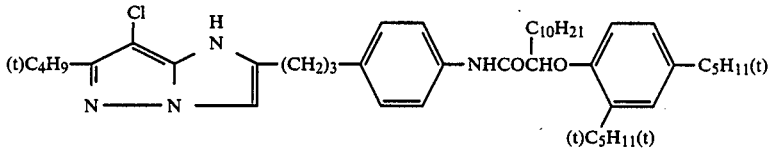
M-170
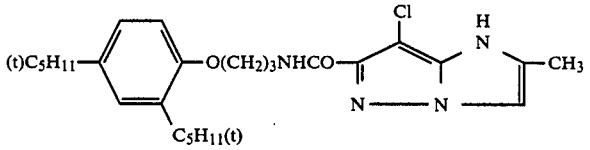
M-171
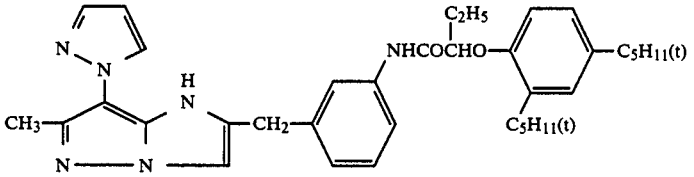
M-172
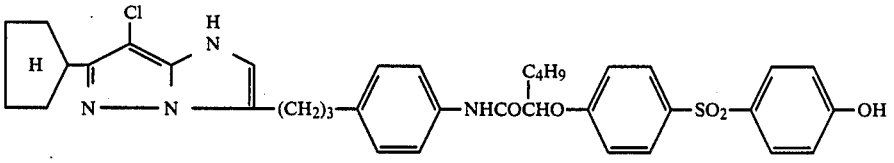
M-173
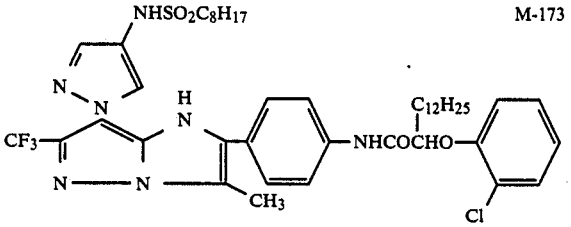
M-174
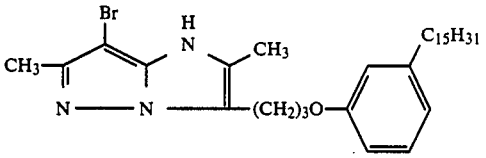
M-175
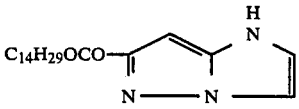
M-176
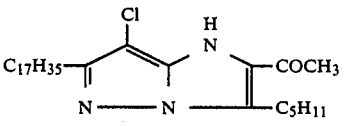
M-177
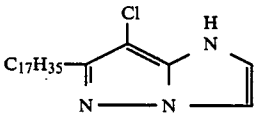
M-178
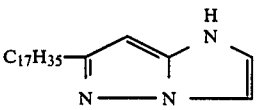
M-179
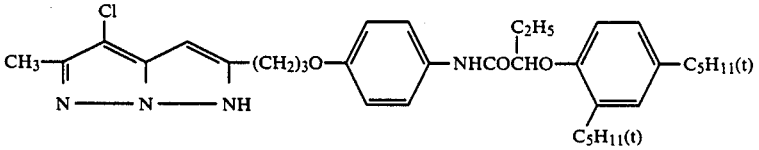

-continued
M-180
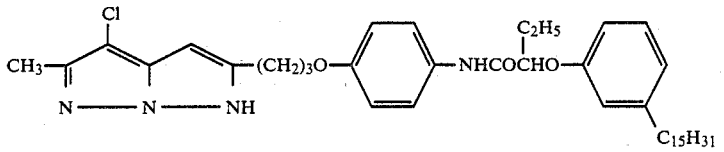
M-181
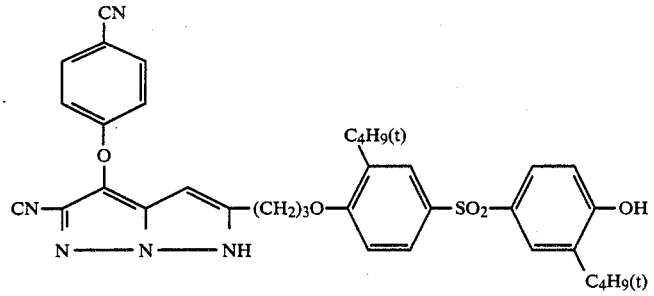
M-182
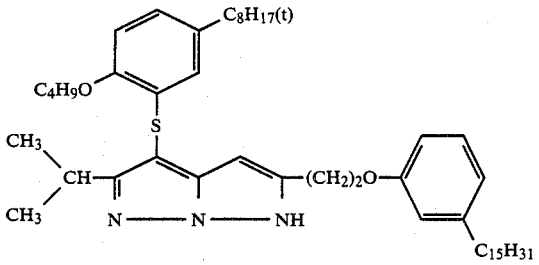
M-183
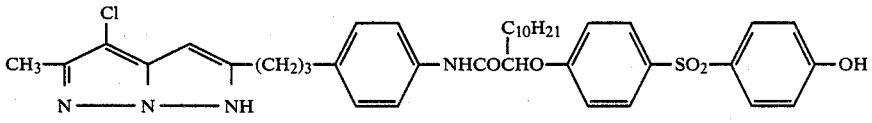
M-184
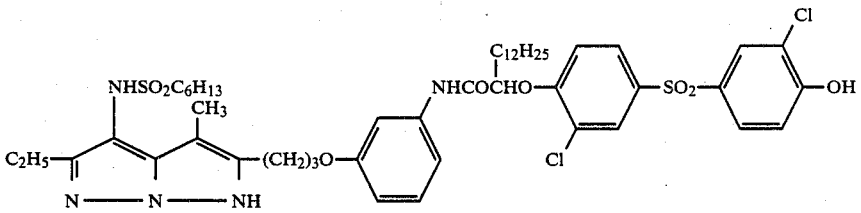
M-185
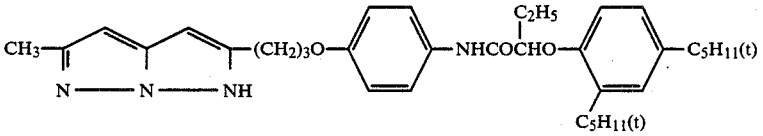
M-186
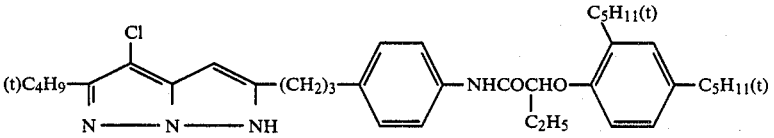
M-187
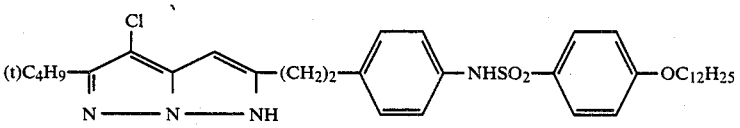

-continued
M-188
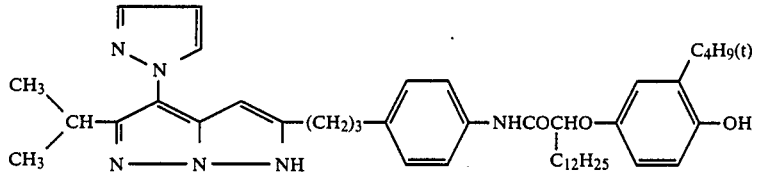
M-189
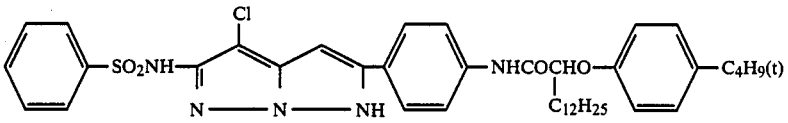
M-190
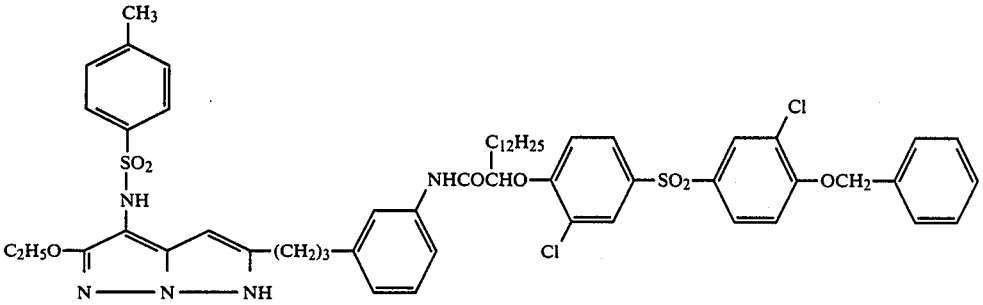
M-191
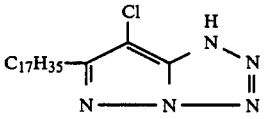
M-192
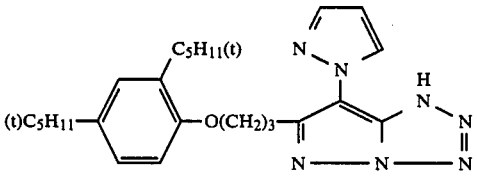
M-193
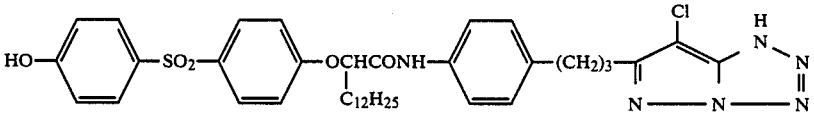
M-194
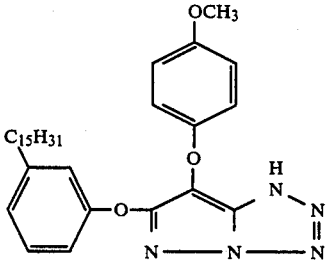
M-195
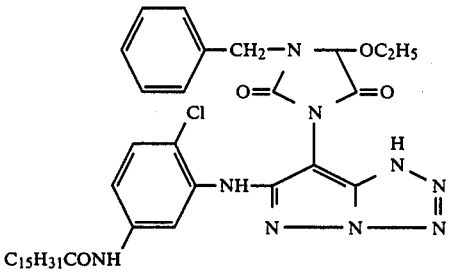
M-196
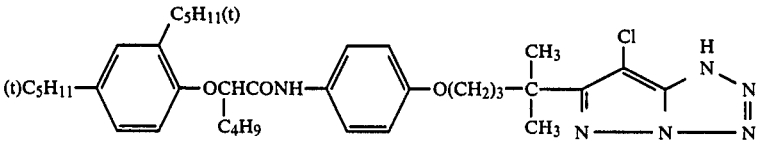
M-197
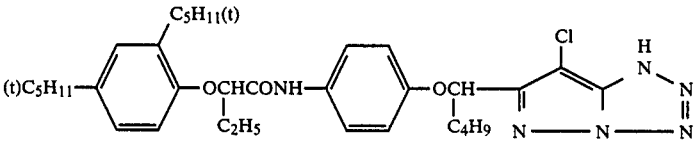

-continued

M-198

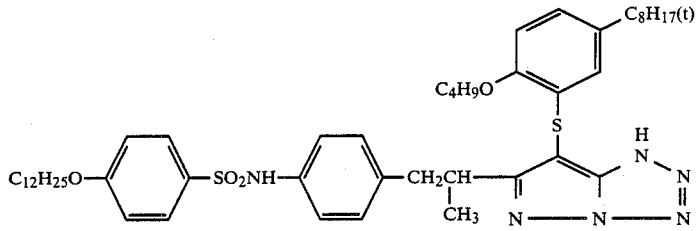

M-199

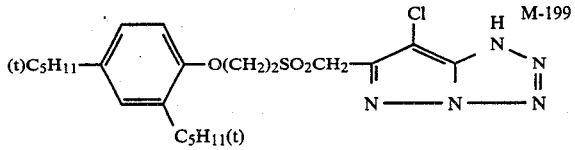

M-200

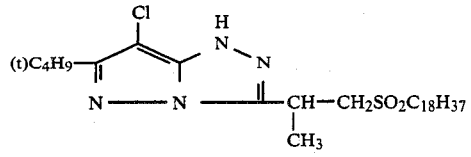

M-201

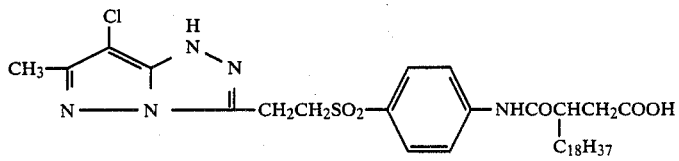

M-202

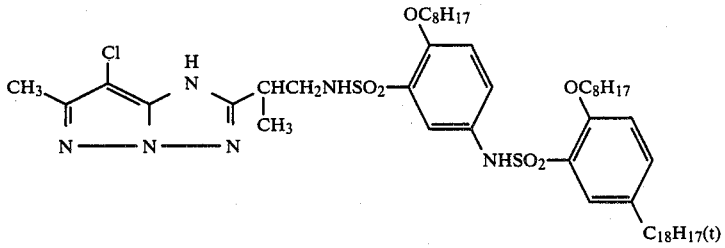

M-203

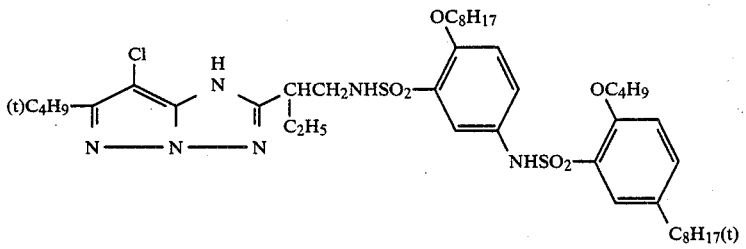

M-204

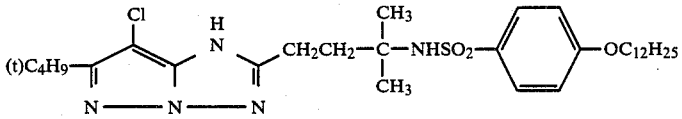

M-205

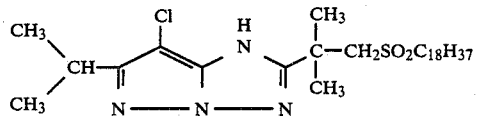

Also, the above couplers were synthesized by referring to Journal of the Chemical Society, Perkin I (1977), 2047–2052, U.S. Pat. No. 3,725,067, Japanese Unexamined Patent Publication Nos. 99437/1984 and 42045/1983, etc.

The coupler of the present invention may be used in an amount generally in the range from $1\times10^{-3}$ mol to $5\times10^{-1}$ mol, preferably from $1\times10^{-2}$ mol to $5\times10^{-1}$, per 1 mol of silver halide.

The cyan dye forming coupler according to the present invention can be represented by the above Formulae II to IV, and said Formula II is described in more detail.

In the present invention, the straight chain or branched alkyl group having 2 to 12 carbon atoms represented by $R_1$, R in the above Formula II may be, for example, ethyl, propyl, or butyl group.

In Formula II, the ballast group represented by $R_2$ is an organic group having a size and a shape which give sufficient bulkiness to the coupler molecule so that the coupler may not be substantially diffused to another layer from the layer to which the coupler is applied. Typical ballast groups may include alkyl groups or aryl groups having total atoms of 8 to 32, preferably total atoms of 13 to 28. Examples of the substituents on those alkyl groups and aryl groups may include alkyl, aryl, alkoxy, allyloxy, carboxy, acyl, ester, hydroxy, cyano, nitro, carbamoyl, carbonamide, alkylthio, arylthio, sulfonyl, sulfonamide, sulfamoyl groups and halogens, and also as the substituents on alkyl groups, the substituents mentioned for the above aryl groups except for alkyl groups may be included.

Preferable as said ballast group is a group represented by the following formula.

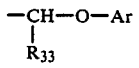

$R_{33}$ represents an alkyl group having 1 to 12 carbon atoms, Ar represents an aryl group such as phenyl group, etc., and this aryl group may have substituents. As the substituents, alkyl, hydroxy groups, halogen atoms, alkylsulfoneamide groups, etc., may be included, and most preferable is a branched alkyl group such as t-butyl group, etc.

The group eliminatable through the coupling with the oxidized product of a color developing agent defined by X in the above Formula II determines the equivalent number of the coupler and also influences the reactivity of coupling, as is well known to those skilled in the art. Typical examples may include a halogen as represented by chlorine, fluorine, aryloxy group, substituted or unsubstituted alkoxy, acyloxy, sulfonamide, arylthio, heteroylthio, heteroyloxy, sulfonyloxy, carbamoyloxy groups, etc. Further specific examples may include those as disclosed in Japanese Unexamined Patent Publication Nos. 10135/1975, 120334/1975, 130414/1975, 48237/1979, 146828/1976, 14736/1979, 37425/1972, 123341/1975, 95346/1983, Japanese Patent Publication No. 36894/1973, U.S. Pat. Nos. 3,476,563, 3,737,316, 3,227,551.

In the following, exemplary compounds of the cyan coupler represented by Formula II are set forth below, but the present invention is not limited to these.

(Exemplary compound)

| Coupler No. | $R_1$ | X | $R_2$ | R |
|---|---|---|---|---|
| C-1 | $-C_2H_5$ | $-H$ | 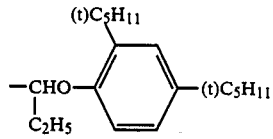 | $-H$ |
| C-2 | $-C_2H_5$ | $-Cl$ | 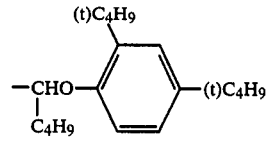 | $-H$ |
| C-3 | $-C_2H_5$ | $-H$ | 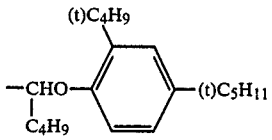 | $-H$ |
| C-4 | $-C_2H_5$ | $-Cl$ | 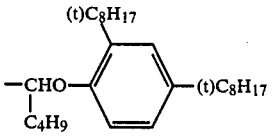 | $-H$ |
| C-5 | $-C_2H_5$ | $-Cl$ | 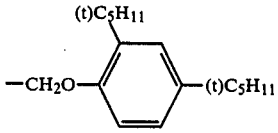 | $-H$ |
| C-6 | $-C_2H_5$ | 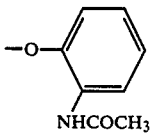 | 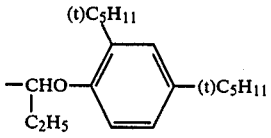 | $-H$ |
| C-7 | 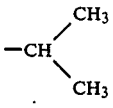 | $-Cl$ | 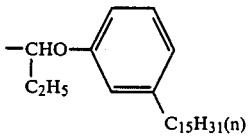 | $-H$ |

-continued
(Exemplary compound)
| Coupler No. | $R_1$ | X | $R_2$ | R |
|---|---|---|---|---|
| C-8 | $-C_2H_5$ | $-Cl$ | 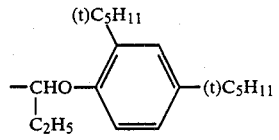 | $-H$ |
| C-9 | $-C_2H_5$ | $-Cl$ | 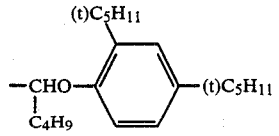 | $-H$ |
| C-10 | $-C_4H_9$ | $-F$ | 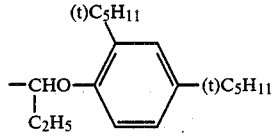 | $-H$ |
| C-11 | $-C_2H_5$ | $-F$ | 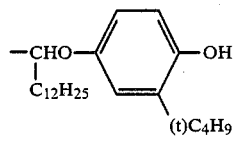 | $-H$ |
| C-12 | $-C_2H_5$ | $-Cl$ | 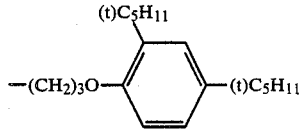 | $-H$ |
| C-13 | $-C_2H_5$ | $-F$ | 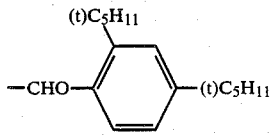 | $-H$ |
| C-14 | $-C_4H_9$ | $-Cl$ | 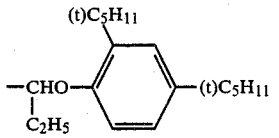 | $-H$ |
| C-15 | $-C_2H_5$ | $-Cl$ | 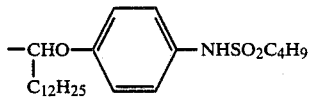 | $-H$ |
| C-16 | $-C_2H_5$ | $-Cl$ | 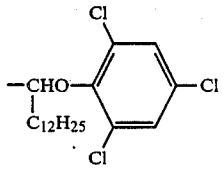 | $-H$ |
| C-17 | $-CH(CH_3)_2$ | $-Cl$ | $-C_{18}H_{37}$ | $-H$ |
| C-18 | $-C_2H_5$ | $-F$ | 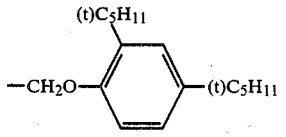 | $-H$ |

-continued (Exemplary compound)

| Coupler No. | $R_1$ | X | $R_2$ | R |
|---|---|---|---|---|
| C-19 | $-C_2H_5$ | 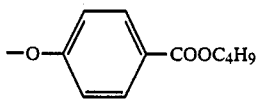 | 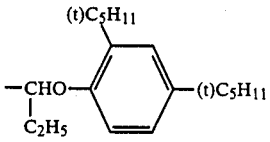 | $-H$ |
| C-20 | $-C_2H_5$ | $-Cl$ | 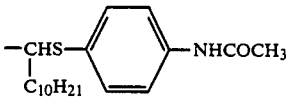 | $-H$ |
| C-21 | $-C_3H_7$ | $-Cl$ | 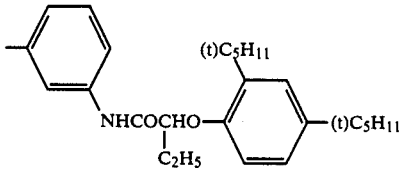 | $-H$ |
| C-22 | $-C_3H_7$ | $-Cl$ | 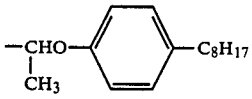 | $-H$ |
| C-23 | $-C_2H_4NHCOCH_3$ | $-Cl$ | 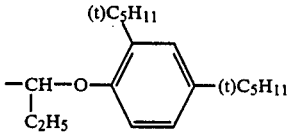 | $-H$ |
| C-24 | $-C_3H_6OCH_3$ | $-Cl$ | 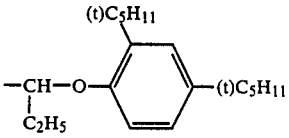 | $-H$ |
| C-25 | $-H$ | $-Cl$ | 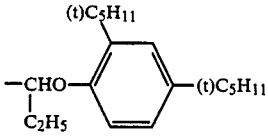 | $-C_2H_5$ |
| C-26 | $-H$ | $-Cl$ | 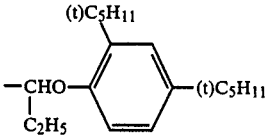 | $-C_3H_7$ |
| C-27 | $-H$ | $-Cl$ | 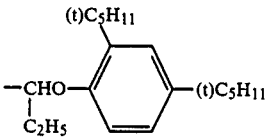 | $-C_5H_{11}$ |
| C-28 | $-C_2H_5$ | $-Cl$ | 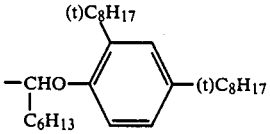 | $-H$ |

In the following, the method for synthesizing the exemplary compound of the present invention are shown, but other exemplary compounds can be also synthesized according to similar methods.

SYNTHESIS EXAMPLE OF EXEMPLARY COMPOUND C-5

[(1)-a]

Synthesis of 2-nitro-4,6-dichloro-5-ethylphenol

2-Nitro-5-ethylphenol (33 g), 0.6 g of iodine and 1.5 g of ferric chloride were dissolved in 150 ml of glacial acetic acid. To this solution was added dropwise 75 ml of sulfuryl chloride at 40° C. over 3 hours. The precipitate formed in the course of the dropwise addition was reacted and dissolved by heating under reflux after completion of the dropwise addition of sulfuryl chloride. Heating reflux rquired about 2 hours. The crystal formed by pouring the reaction mixture into water was purified by recrystallization from methanol. Confirmation of (1)-a was conducted by NMR spectrum and elemental analysis.

[(1)-b]

Synthesis of 2-nitro-4,6-dichloro-5-ethylphenol

To a solution of 21.2 g of the compound of [(1)-a] dissolved in 300 ml of alcohol was added a catalytic amount of Raney nickel, and hydrogen was passed until there was no hydrogen absorption at normal pressure. After the reaction, Raney nickel was removed and alcohol was distilled off under reduced pressure. The residue of [(1)-b] was subjected to the subsequent acylation without purification.

[(1)-c]

Synthesis of 2[(2,4-di-tert-acylphenoxy)acetamide]-4,6-dichloro-5-ethylphenol The crude amino derivative obtained in [(1)-b] (18.5 g) was dissolved in a mixture of 500 ml of glacial acetic acid and 16.7 g of sodium acetate, and to this solution was added dropwise an acetic acid solution of 28.0 g of 2,4-di-tert-aminophenoxy acetic acid chloride dissolved in 50 ml of acetic acid at room temperature. After the dropwise addition for 30 minutes, the mixture was further stirred for 30 minutes, and thereafter the reaction mixture was poured into ice-water. The precipitate formed was filtered and dried, followed by recrystallization from acetonitrile twice to give the desired product. Confirmation of the desired product was conducted by elemental analysis and NMR spectrum.

| | $C_{21}H_{35}NO_3Cl_2$ | | | |
|---|---|---|---|---|
| | C | H | N | Cl |
| Calcd. (%) | 65.00 | 7.34 | 2.92 | 14.76 |
| Found (%) | 64.91 | 7.36 | 2.99 | 14.50 |

Next, the cyan coupler represented by Formula III or IV used in the present invention is described. In the above Formulae III and IV, Y is a group represented by

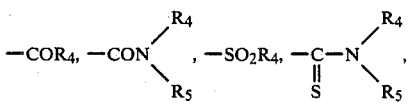

-continued

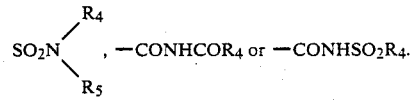

Here, $R_4$ represents an alkyl group, preferably an alkyl group having 1 to 20 carbon atoms (e.g. methyl, ethyl, t-butyl, dodecyl, etc.), an alkenyl group, preferably an alkenyl group having 2 to 20 carbon atoms (e.g. allyl group, heptadecenyl group, etc.), a cycloalkyl group, preferably a 5- to 7-membered ring (e.g. cyclohexyl, etc.), an aryl group (e.g. phenyl group, tolyl group, naphthyl group, etc.), a heterocyclic group, preferably a 5- to 6-membered heterocyclic group containing 1 to 4 nitrogen atoms, oxygen atoms or sulfur atoms (e.g. furyl, thienyl group, benzothiazolyl, etc.). $R_5$ represents a hydrogen atom or a group represented by $R_4$. $R_4$ and $R_5$ may be also bonded together to form a 5- to 6-membered heterocyclic ring containing nitrogen atom, it is possible to introduce any desired substituent into $R_4$ and $R_5$, and examples of the substituent may include alkyl groups having 1 to 10 carbon atoms (e.g. ethyl, i-propyl, i-butyl, t-butyl, t-octyl, etc.), aryl groups (e.g. phenyl, naphthyl, etc.), halogen atoms (fluorine, chlorine, bromine, etc.), cyano, nitro, sulfonamide groups (e.g. methanesulfonamide, butanesulfonamide, p-toluenesulfonamide, etc.), sulfamoyl groups (e.g. methylsulfamoyl, phenylsulfamoyl, etc.), sulfonyl groups (e.g. methanesulfonyl, p-toluenesulfonyl, etc.), fluorosulfonyl, carbamoyl group (e.g. dimethylcarbamoyl, phenylcarbamoyl, etc.), oxycarbonyl groups (e.g. ethoxycarbonyl, phenoxycarbonyl, etc.), acyl groups (e.g. acetyl, benzoyl, etc.), heterocyclic groups (e.g. pyridyl group, pyrazolyl group, etc.), alkoxy group, aryloxy group, acyloxy group and so on.

In Formulae III and IV, $R_3$ represents a ballast group necessary for imparting diffusion resistance to the cyan coupler represented by Formulae III and IV and the cyan dye formed from said cyan coupler. Preferably, it is an alkyl group having 4 to 30 carbon atoms, and aryl group or a heterocyclic group. For example, there may be included straight chain or branched alkyl groups (e.g. t-butyl, n-octyl, t-octyl, n-dodecyl, etc.), alkenyl groups, cycloalkyl groups, 5- or 6-membered heterocyclic groups, etc.

In Formulae III and IV, Z represents a hydrogen atom or a group eliminatable during the coupling reaction with the oxidized product of a color developing agent. For example, there may be included halogen atoms (e.g. chlorine, bromine, fluorine, etc.), substituted or unsubstituted alkoxy, aryloxy, heterocyclic oxy, acyloxy, carbamoyloxy, sulfonyloxy, alkylthio, arylthio, heterocyclic thio, sulfonamide groups, etc., and further specific examples as disclosed in U.S. Pat. No. 3,741,563, Japanese Unexamined Patent Publication No. 37425/1972, Japanese Patent Publication No. 36894/1973, Japanese Unexamined Patent Publication Nos. 10135/1975, 117422/1975, 130441/1975, 108841/1976, 120343/1975, 18315/1977, 105226/1978, 14736/1979, 48237/1979, 32071/1980, 65957/1980, 1938/1981, 12643/1981, 27147/1981, 146050/1984, 166956/1984, 24547/1985, 35731/1985, 37557/1985.

In the present invention, the cyan couplers represented by the following Formulae XI, XII or XIII are further preferred.

Formula XI

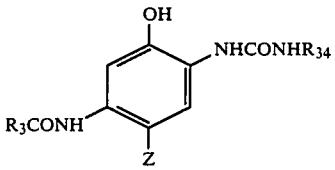

Formula XII

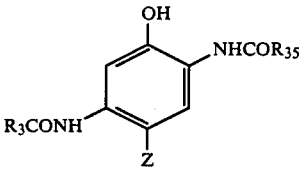

Formula XIII

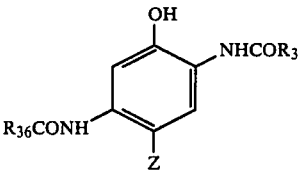

In Formula XI, $R_{34}$ is a substituted or unsubstituted aryl group (particularly preferably phenyl group). When said aryl group has a substituent, examples of the substituents may include at least one substituent selected from $-SO_2R_{37}$, halogen atoms (e.g. fluorine, bromine, chlorine, etc.), $-CF_3$, $-NO_2$, $-CN$, $-COR_{37}$, $-COOR_{37}$, $-SO_2OR_{37}$,

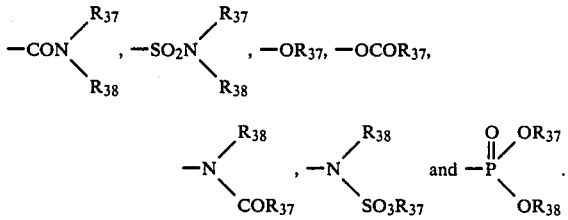

Here $R_{37}$ represents an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, heptadecenyl, etc.), a cycloalkyl group, preferably a 5- to 7-membered group (e.g. cyclohexyl, etc.), an aryl group (e.g. phenyl, tolyl, naphthyl, naphthyl group, etc.), and $R_{38}$ is a hydrogen atom or a group represented by the above $R_{37}$.

Preferable compounds of the phenol type cyan coupler represented by Formula XI are compounds wherein $R_{37}$ is a substituted or unsubstituted phenyl group, and the substituent on the phenyl group is cyano, nitro, $-SO_2R_{39}$ ($R_{39}$ is an alkyl group), a halogen atom, trifluoromethyl.

In Formulae XII and XIII, $R_{35}$, $R_{36}$ represent alkyl groups, preferably alkyl group having 1 to 20 carbon atoms (e.g. methyl, ethyl, tert-butyl, dodecyl, etc.), alkenyl groups, preferably alkenyl groups having 2 to 20 carbon atoms (e.g. allyl, oleyl, etc.), cycloalkyl groups, preferably 5- to 7-membered cyclic groups (e.g. cyclohexyl, etc.), aryl groups (e.g. phenyl, tolyl, naphthyl group, etc.), heterocyclic groups (preferably 5- to 6-membered heterocyclic groups containing 1 to 4 nitrogen atoms, oxygen atoms or sulfur atoms, for example, furyl, thienyl, benzothiazolyl group, etc.).

It is further possible to introduce any desired substituent into the above $R_{37}$, $R_{38}$ and $R_{35}$, $R_{36}$ in Formulae XII and XIII, and specific examples may include substituents which can be introduced into $R_4$ or $R_5$ in Formulae II and III. And, as the substituent is particularly preferred a halogen atom (chlorine atom, fluorine atom, etc.).

In Formulae XI, XII and XIII, Z and $R_3$ have respectively the same meanings as in Formulae III and IV. Preferable examples of the ballast group represented by $R_3$ are groups represented by the following Formula XIV. Formula XIV

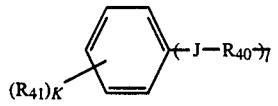

In the above Formula, J represents an oxygen atom, a sulfur atom or a sulfonyl group, K represents an integer of 0 to 4, l represents 0 or 1, and when K is 2 or more, $R_{41}$ existing in number of two or more may be the same or different, $R_{40}$ represents an alkylene group having 1 to 20 carbon atoms which is straight chain or branched, and substituted with an aryl group, etc., $R_{41}$ represents a monovalent group, preferably a hydrogen atom, a halogen atom (e.g. chloro, bromo), an alkyl group, preferably a straight chain or branched alkyl group having 1 to 20 carbon atoms (e.g. methyl, t-butyl, t-pentyl, t-octyl, dodecyl, pentadecyl, benzyl, phenethyl, etc.), an aryl group (e.g. phenyl), a heterocyclic group (preferably nitrogen containing heterocyclic group), an alkoxy group, preferably a straight chain or branched alkoxy group having 1 to 20 carbon atoms (e.g. methoxy, ethoxy, t-butyloxy, octyloxy, decyloxy, dodecyloxy, etc.), an aryloxy group (e.g. phenoxy group), hydroxy, an acyloxy group, preferably an alkylcarbonyloxy group, an arylcarbonyloxy group (e.g. acetoxy group, benzoyloxy group), carboxy, an alkyloxycarbonyl group, preferably a straight or brached alkyloxycarbonyl group having 1 to 20 carbon atoms, an aryloxycarbonyl group, preferably phenoxycarbonyl, an alkylthio group, preferably an alkylthio group having 1 to 20 carbon atoms, an acyl group, preferably a straight chain or branched alkylcarbonyl having 1 to 20 carbon atoms, an acylamino group, preferably a straight chain or brached alkylcarboamide having 1 to 20 carbon atoms, benzenecarboamide, sulfonamide group, preferably a straight or branched alkylsulfonamide group having 1 to 20 carbon atoms or benzenesulfonamide group, carbamoyl group, preferably a straight chain or branched alkylaminocarbonyl group having 1 to 20 carbon atoms or phenylaminocarbonyl group, sulfamoyl group, preferably a straight chain or branched alkylaminosulfonyl group having 1 to 20 carbon atoms or phenylaminosulfonyl group, etc.

In the following, specific exemplary compounds of the cyan couplers represented by Formula III or IV are set forth, but the present invention is not limited thereto.

(Exemplary Compound)

-continued
C-29
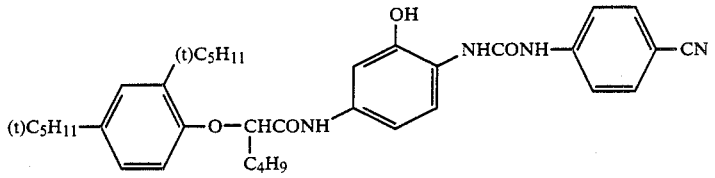
C-29'
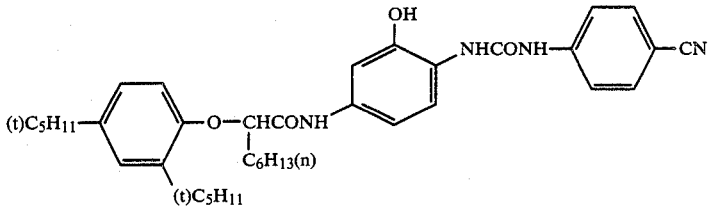
C-30
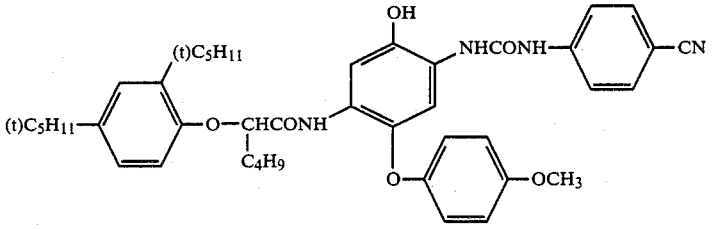
C-31
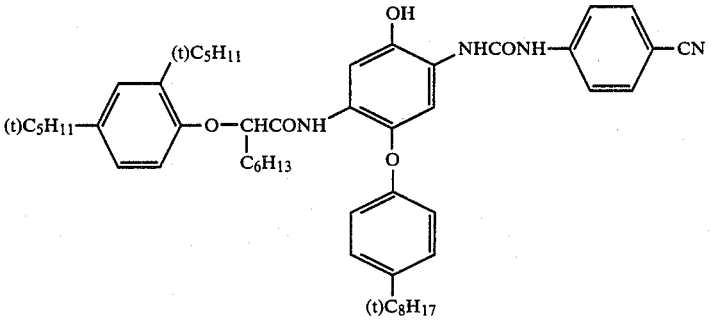
C-32
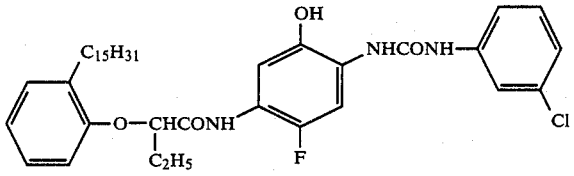
C-33
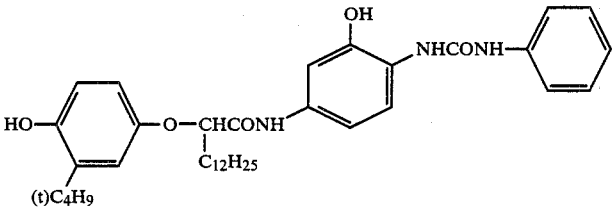
C-34
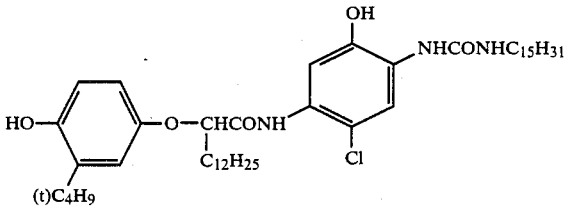

-continued
C-35
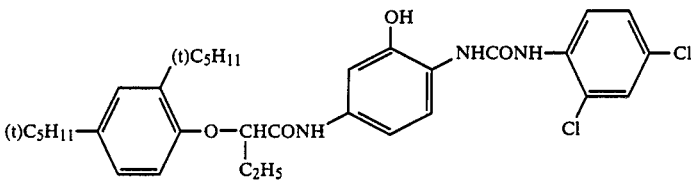
C-36
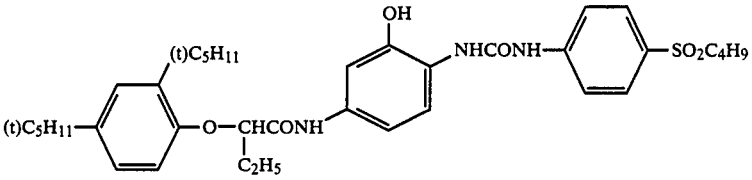
C-37
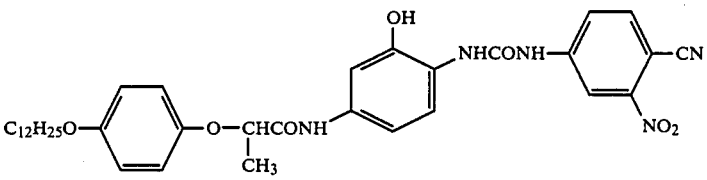
C-38
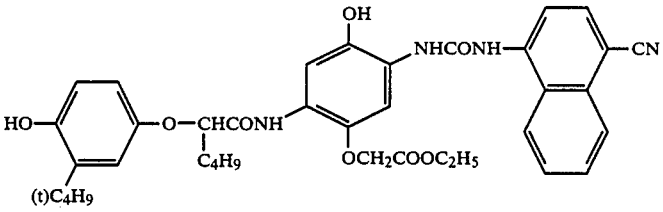
C-39
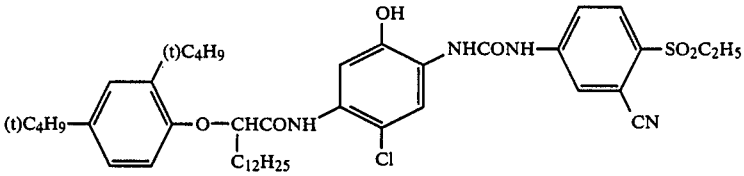
C-40
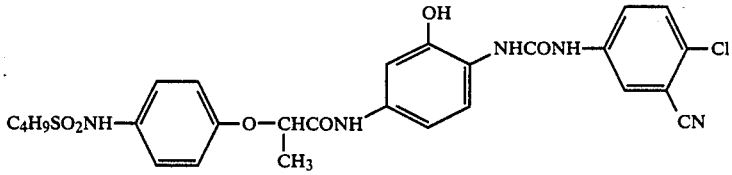
C-41
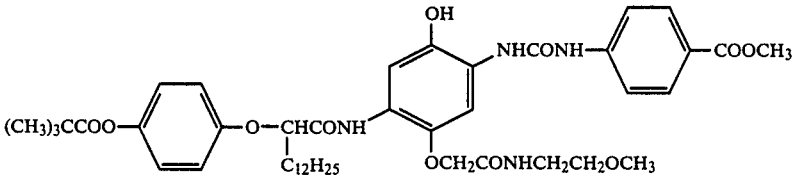
C-42
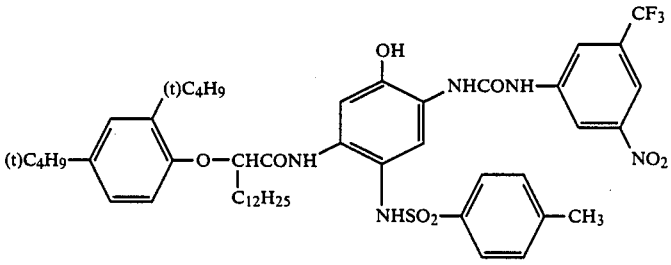

-continued
C-43
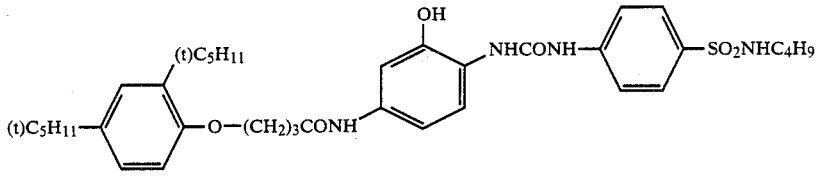
C-44
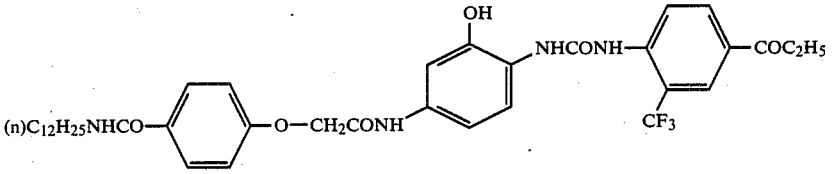
C-45
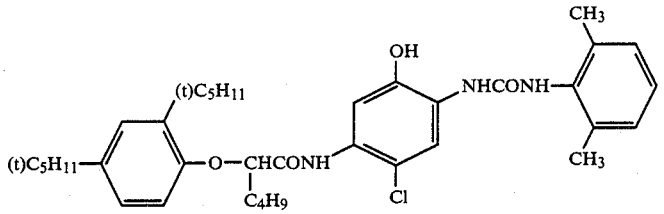
C-46
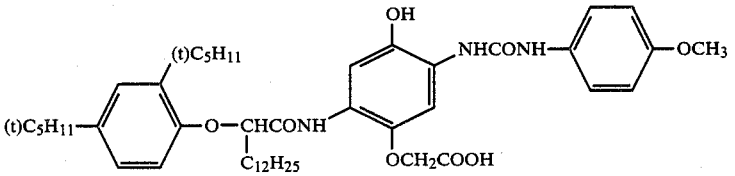
C-47
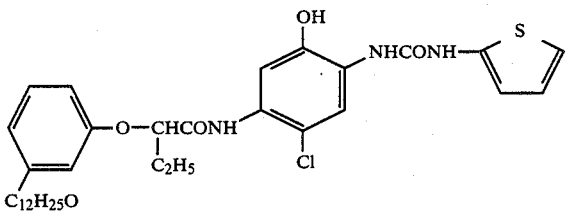
C-48
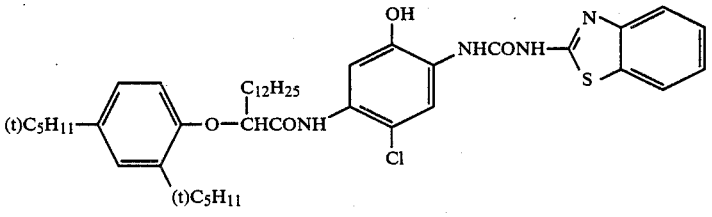
C-49
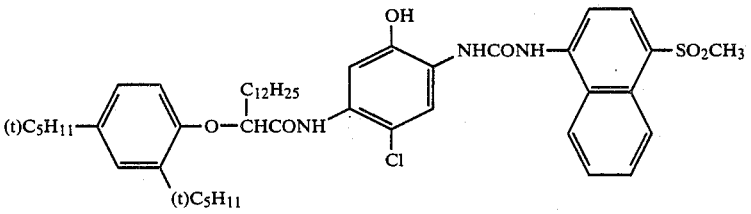

-continued
C-50
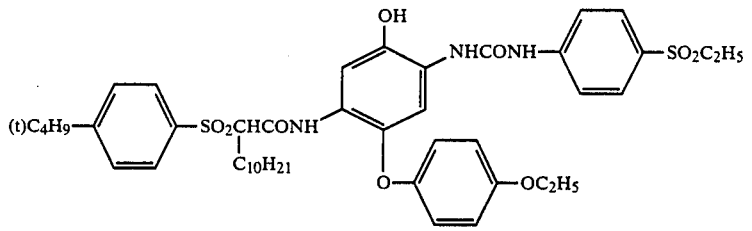
C-51
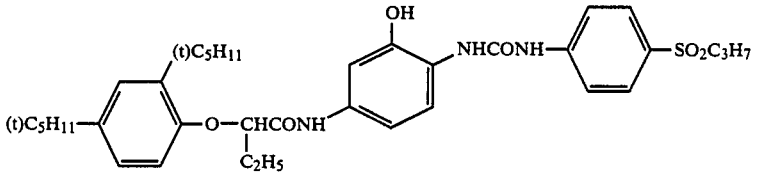
C-52
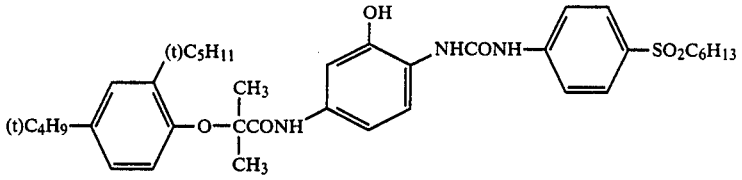
C-53
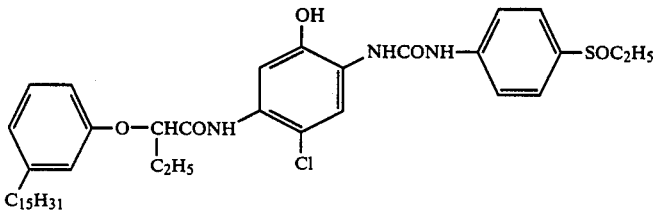
C-54
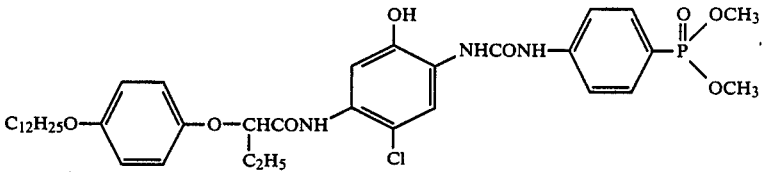
C-55
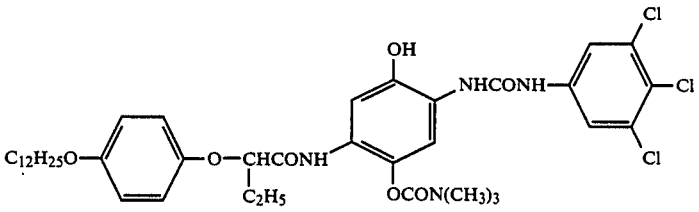
C-56
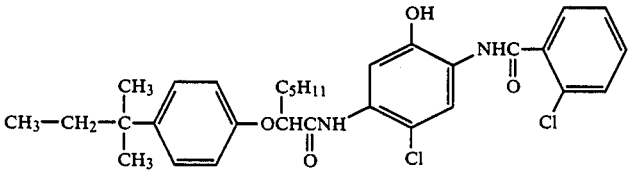

-continued
C-57
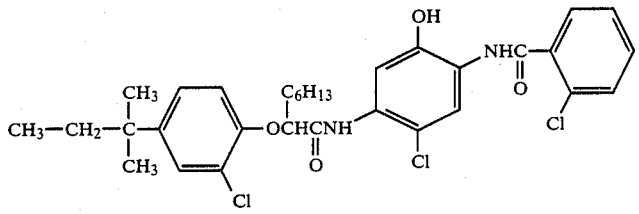
C-58
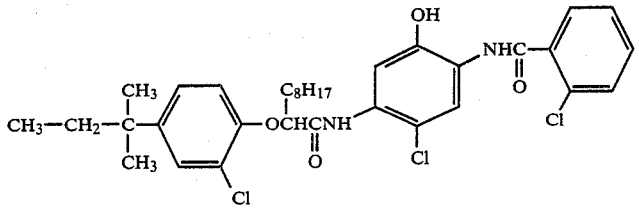
C-59
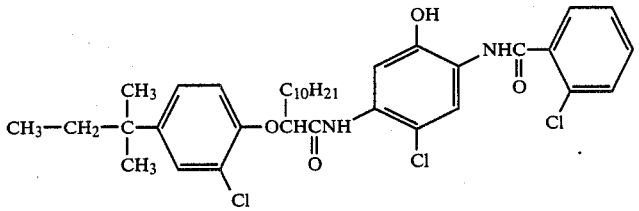
C-60
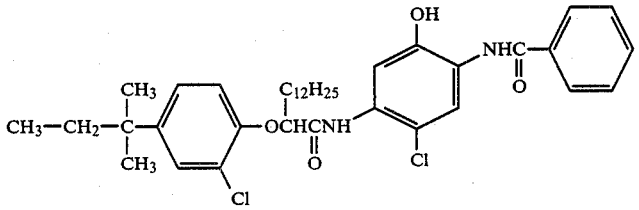
C-61
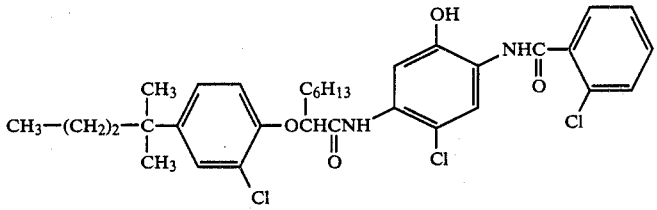
C-62
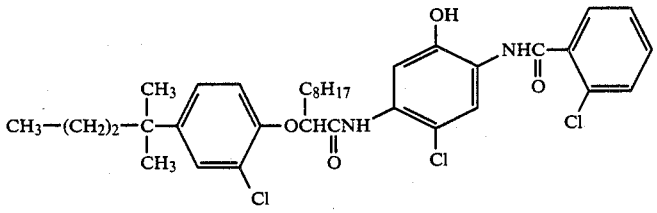
C-63
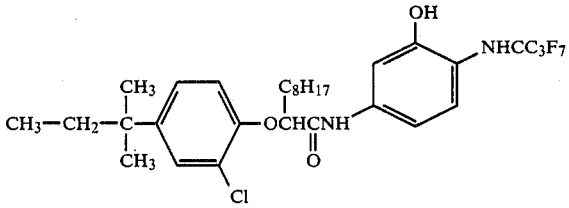

-continued
C-64
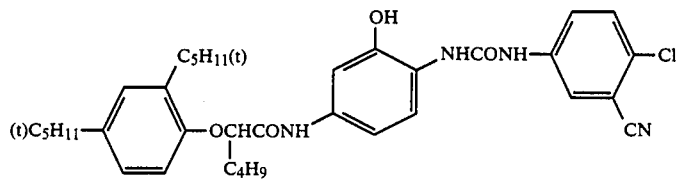
C-65
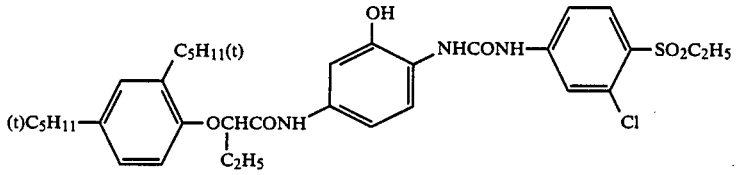
C-66
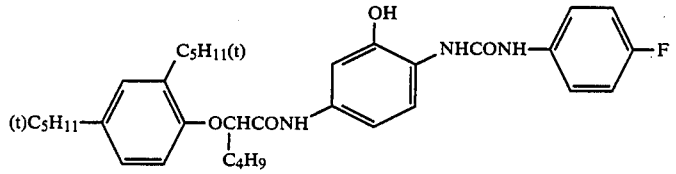
C-67
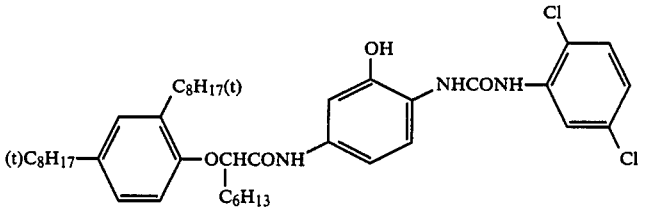
C-68
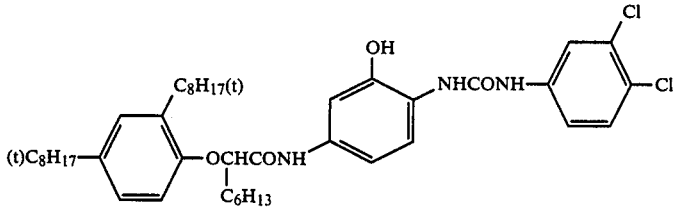
C-69
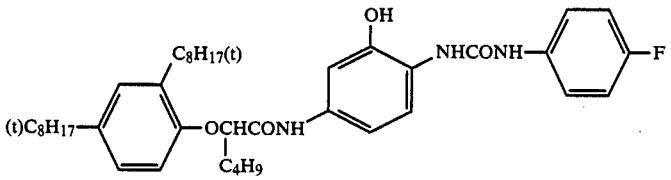
C-70
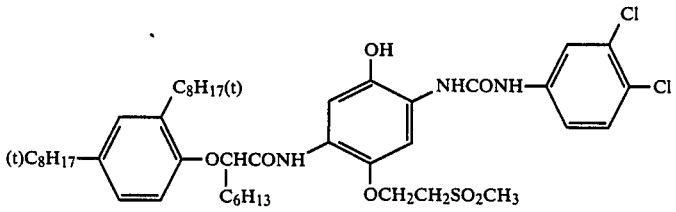
C-71
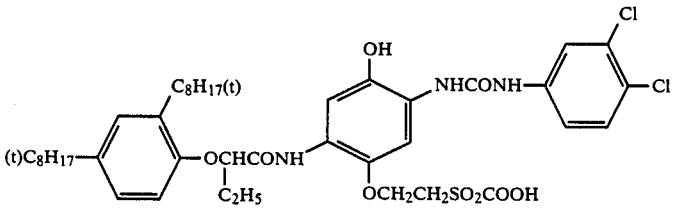

-continued
C-72
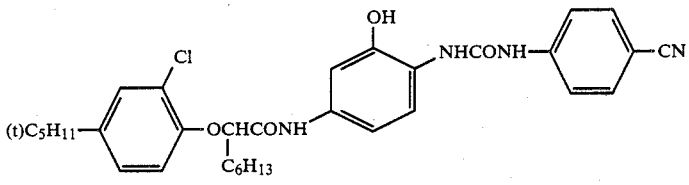
C-73
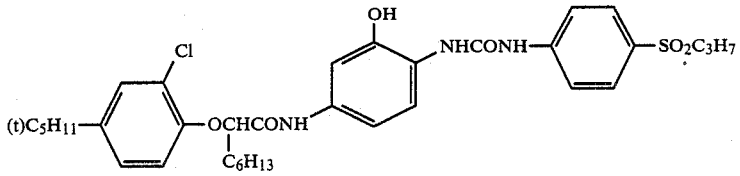
C-74
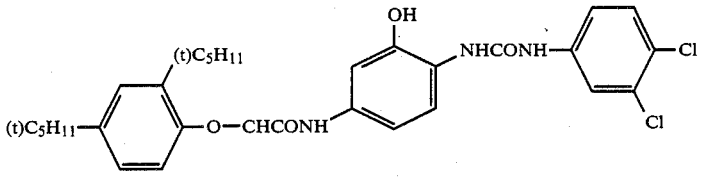
C-75
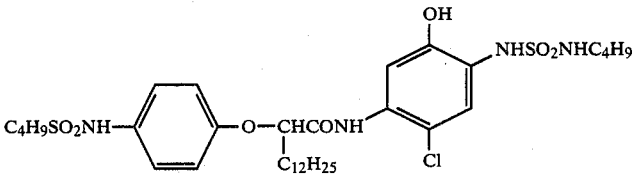
C-76
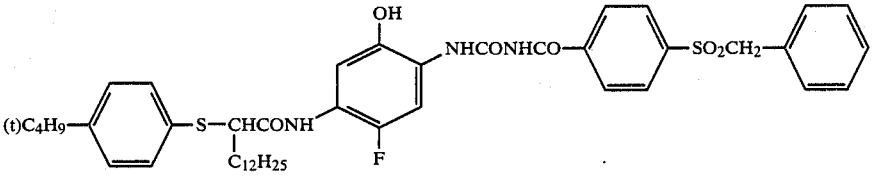
C-77
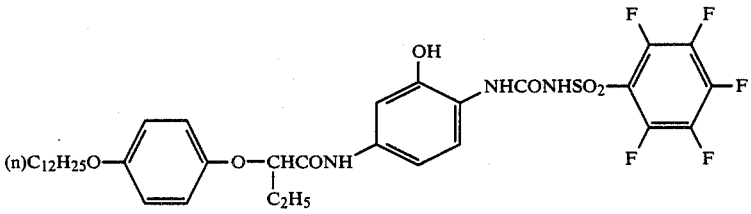
C-78
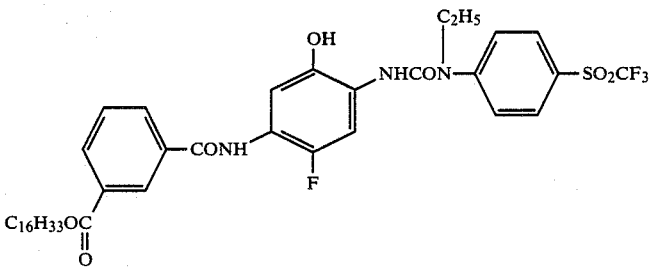

-continued
C-79
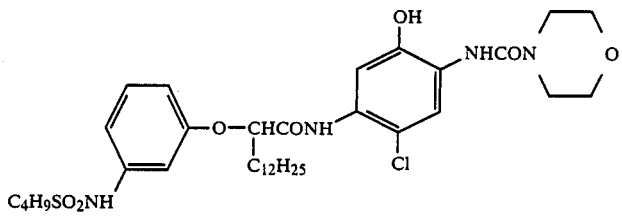
C-80
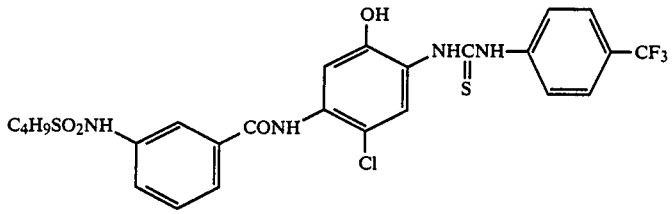
C-81
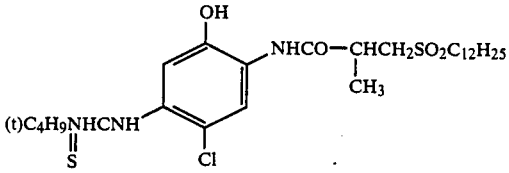
C-82
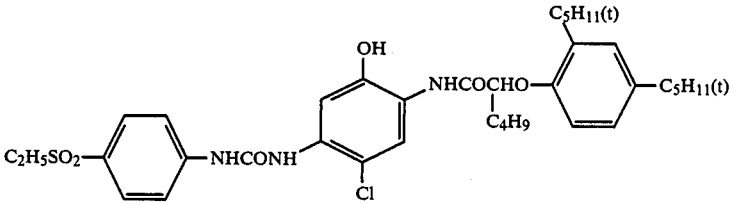
C-83
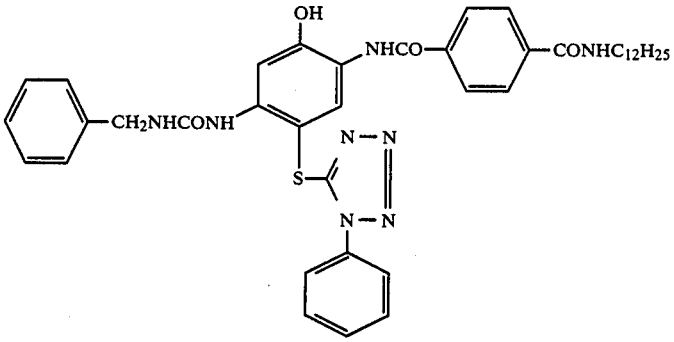
C-84
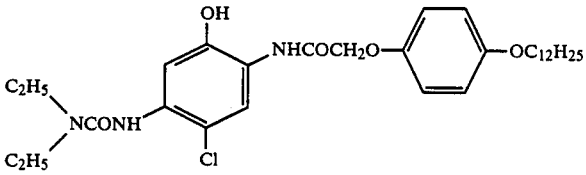
C-85
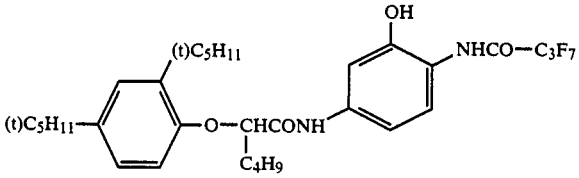

-continued
C-86
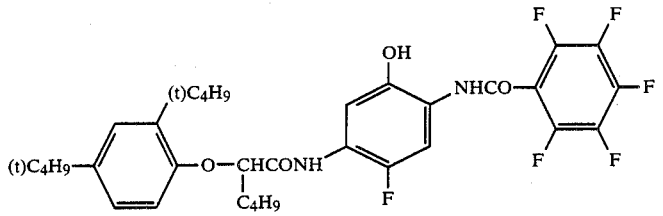
C-87
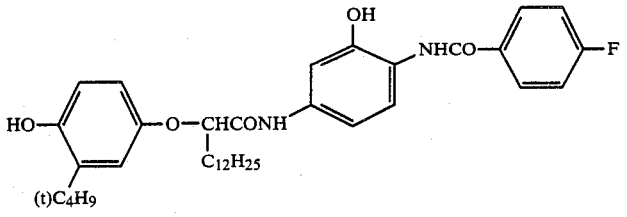
C-88
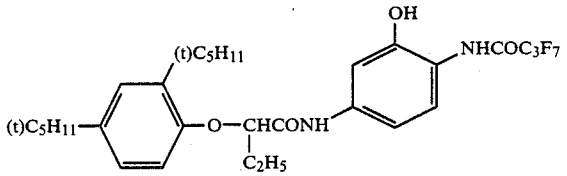
C-89
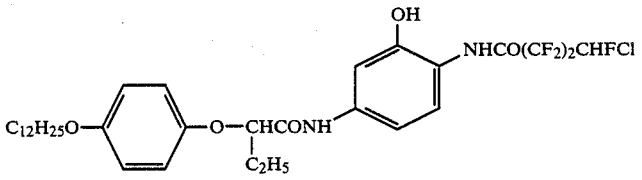
C-90
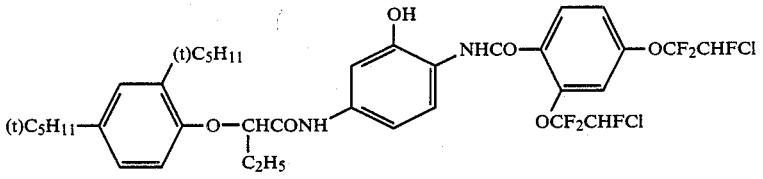
C-91
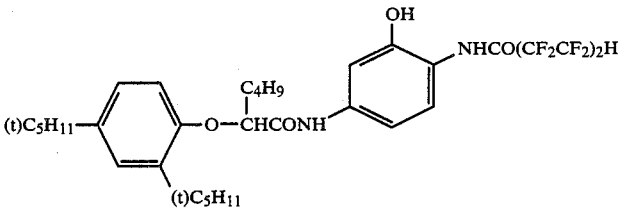
C-92
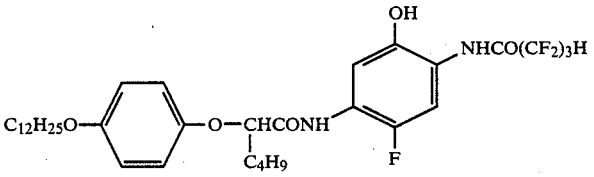
C-93
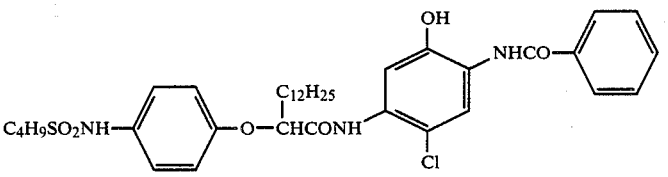

-continued
C-94
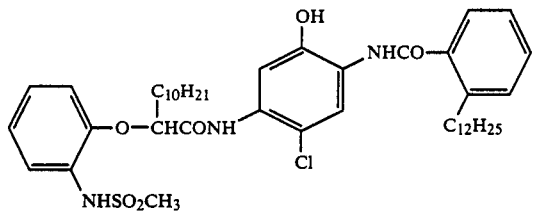
C-95
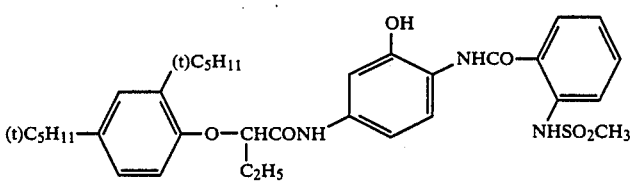
C-96
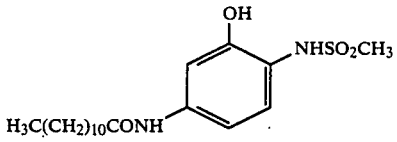
C-97
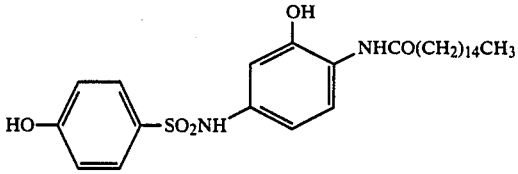
C-98
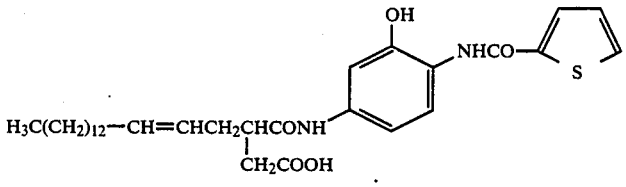
C-99
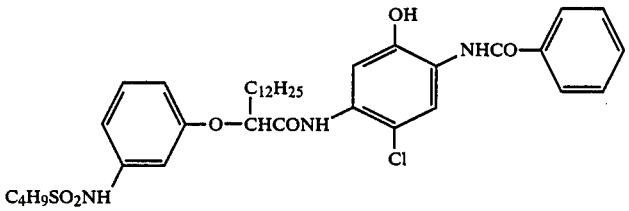
C-100
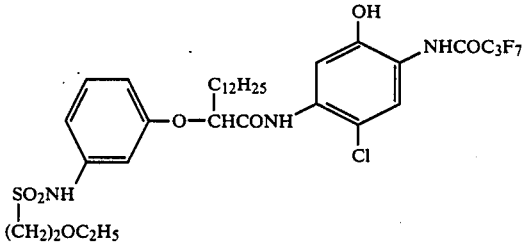

-continued
C-101
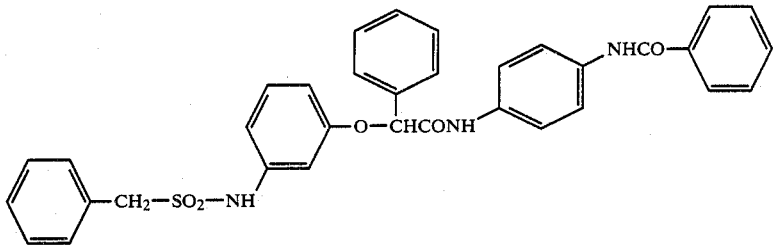
C-102
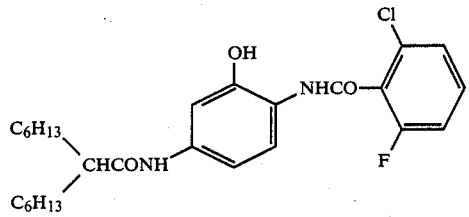
C-103
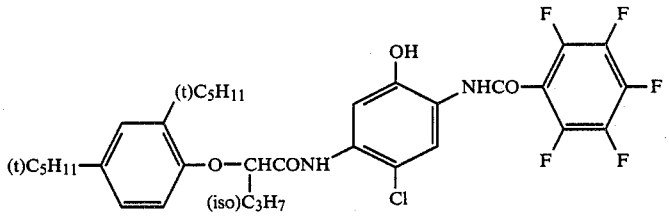
C-104
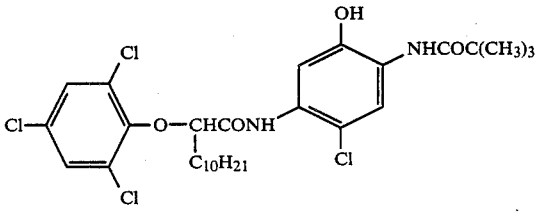
C-105
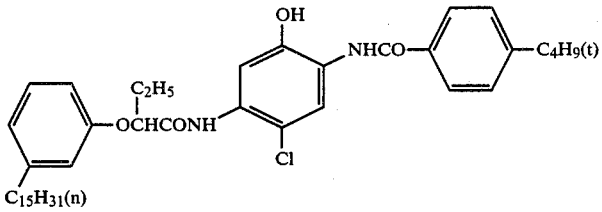
C-106
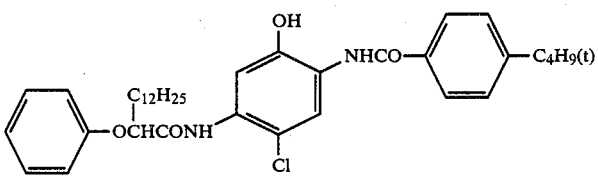
C-107
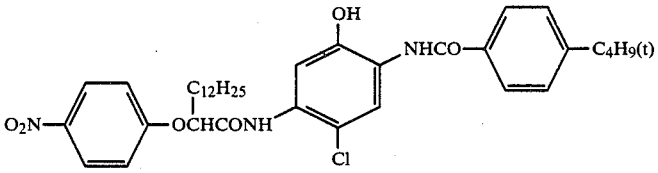

-continued
C-108
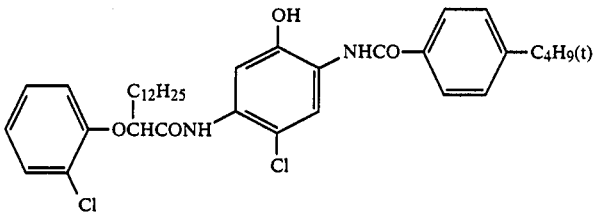
C-109
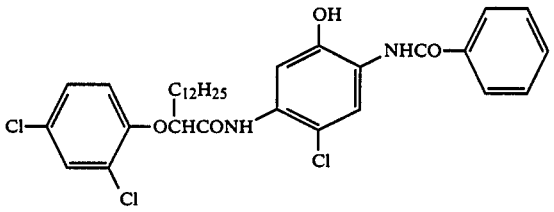
C-110
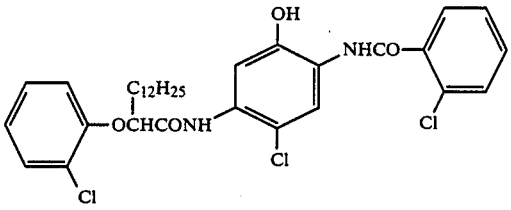
C-111
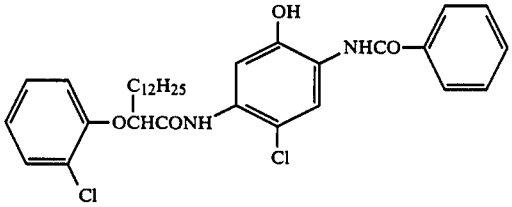
C-112
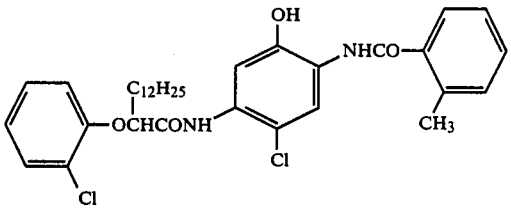
C-113
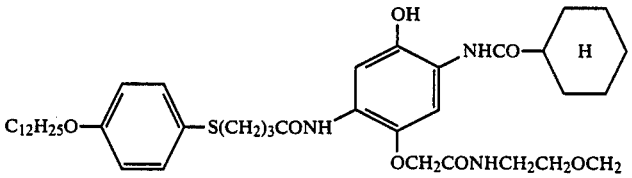
C-114
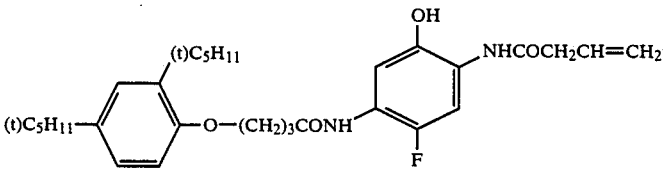

-continued
C-115
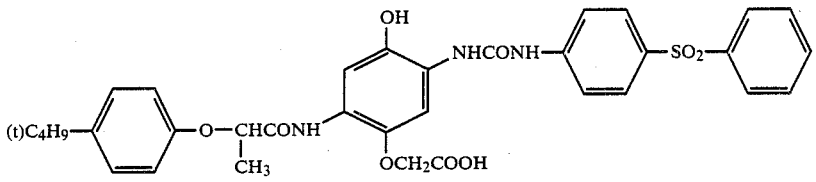
C-116
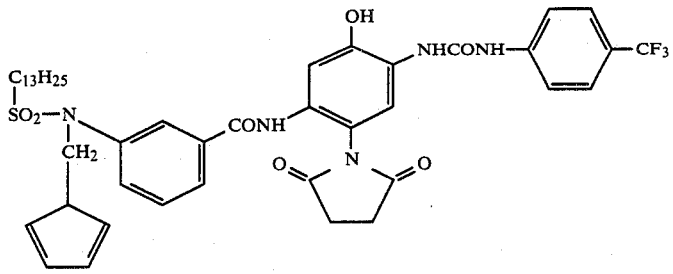
C-117
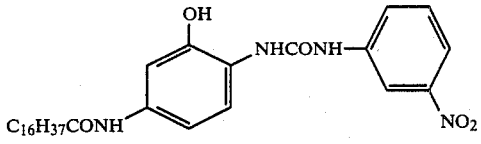
C-118
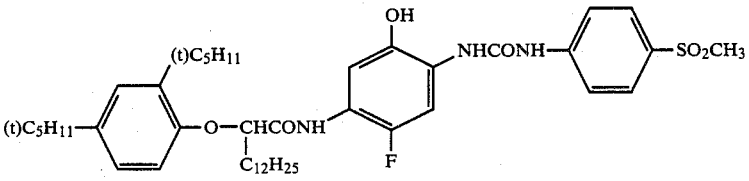
C-119
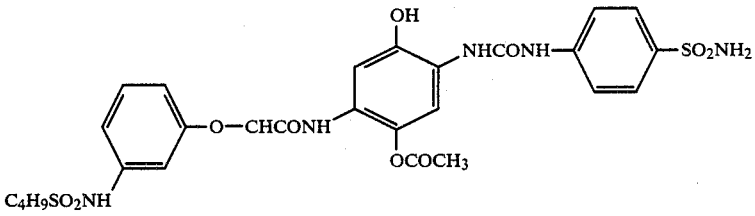
C-120
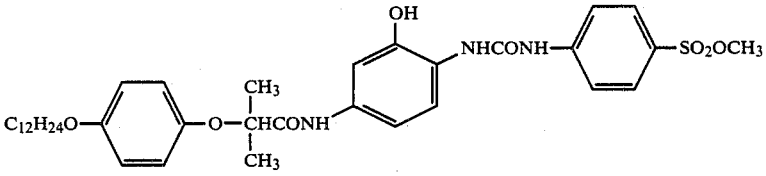
C-121
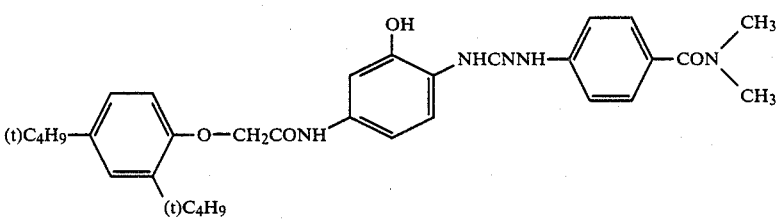

-continued

C-122

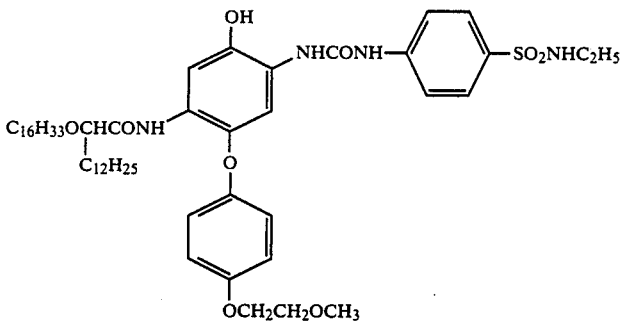

C-123

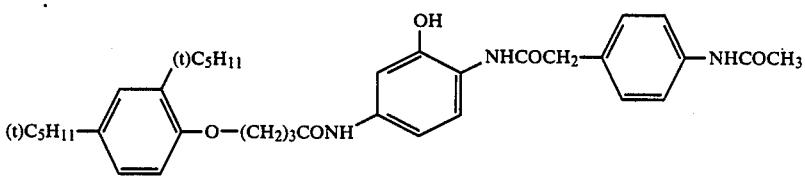

C-124

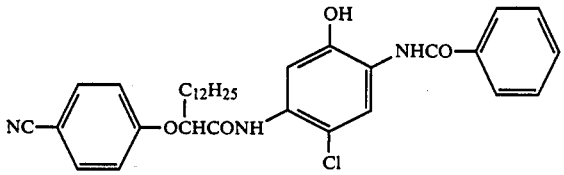

C-125

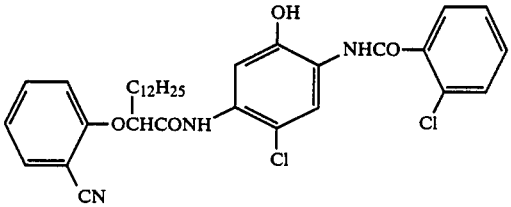

C-126

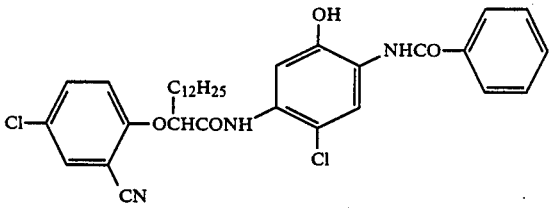

C-127

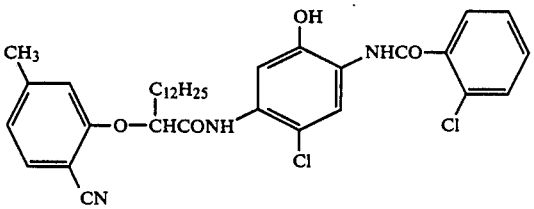

These cyan couplers can be synthesized according to known methods, for example, according to the synthetic methods as described in U.S. Pat. Nos. 2,772,162, 3,758,308, 3,880,661, 4,124,396, 3,222,176, U.K. Pat. Nos. 975,773, 8,011,693, 8,011,694, Japanese Unexamined Patent Publication Nos. 21139/1972, 112038/1975, 163537/1980, 29235/1981, 99341/1980, 116030/1981, 69329/1977, 55945/1981, 80045/1981, 134644/1975, U.K. Pat. No. 1,011,940, U.S. Pat. Nos. 3,446,622, 3,996,253, Japanese Unexamined Patent Publication Nos. 65134/1981, 204543/1982, 204544/1982, 204545/1982, Japanese Patent Application Nos. 131312/1981, 131313/1981, 131314/1981, 131309/1981, 131311/1981, 149791/1982, 130459/1981, Japanese Unexamined Patent Publication Nos. 146050/1984, 166956/1984, 24547/1985, 35731/1985, 37557/1985.

In the present invention, the cyan coupler represented by Formula II, III or IV can be used in combination with cyan couplers known in the art within the range which is not contradictory to the object of the present invention. Also, the cyan couplers of Formulae II, III and IV can be used in combination.

When the cyan coupler according to the present invention represented by Formulae II to IV is incorporated in the silver halide emulsion layer, it is used in an amount generally in the range from about 0.005 to 2 mols, preferably from 0.01 to 1 mol, per 1 mol of silver halide.

The aldehyde derivative to be used in the present invention is a compound represented by the following Formulae V to VII.

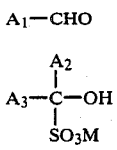

Formula V

Formula VI

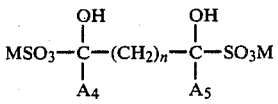

Formula VII $A_1$, $A_2$, $A_3$, $A_4$, $A_5$ represent hydrogen atoms, alkyl groups having 1 to 6 carbon atoms, formyl group, acyl group or alkenyl group.

As the alkyl group having 1 to 6 carbon atoms, straight chain and branched groups are included, such as methyl, ethyl, n-propyl, iso-propyl, n-butyl, n-valeric, iso-valeric, hexyl, isohexyl group, etc. They may be also substituted, and specific examples of the substituent may include formyl groups (e.g. formylmethyl, 2-formylethyl, etc.), amino groups (e.g. aminomethyl, aminoethyl, etc.), hydroxy groups (e.g. hydroxymethyl, 2-hydroxyethyl, 2-hydroxypropyl, etc.), alkoxy groups (e.g. methoxy, ethoxy, etc.), halogen atoms (e.g. chloromethyl, trichloromethyl, dibromomethyl, etc.).

Alkenyl groups may include substituted and unsubstituted groups, and examples of unsubstituted groups are vinyl, 2-propenyl, etc., while examples of substituted groups may be, 1,2-dichloro-2-carboxyvinyl, 2-phenylvinyl, etc.

In the following, specific examples of the compounds represented by the above Formulae are set forth, but the present invention is not limited thereto.

[Exemplary compounds]

V-1: Formaldehyde
V-2: Acetoaldehyde
V-3: Propionealdehyde
V-4: Isobutylaldehyde
V-5: n-Butylaldehyde
V-6: n-Valeraldehyde
V-7: Isovaleraldehyde
V-8: Methylethylacetaldehyde
V-9: Trimethylacetaldehyde
V-10: n-Hexaaldehyde
V-11: Methyl-n-propylacetaldehyde
V-12: Isohexaaldehyde
V-13: Glyoxal
V-14: Malonaldehyde
V-15: Succinaldehyde
V-16: Glutaraldehyde
V-17: Adipinaldehyde
V-18: Methylglyoxal
V-19: Acetoacetic aldehyde
V-20: Glycolaldehyde
V-21: Ethoxyacetaldehyde
V-22: Aminoacetaldehyde
V-23: Betainealdehyde
V-24: Chloral
V-25: Chloracetaldehyde
V-26: Dichloracetaldehyde
V-27: Bromal
V-28: Dibromoacetaldehyde
V-29: Iodoacetaldehyde
V-30: α-Chlorpropionacetaldehyde
V-31: α-Bromopropionacetaldehyde
V-32: Mucochloric acid
VI-1: Sodium formaldehyde bisulfite
VI-2: Sodium acetaldehyde bisulfite
VI-3: Sodium propionaldehyde bisulfite
VI-4: Sodium butylaldehyde bisulfite
VII-1: Sodium succinaldehyde bisulfite
VII-2: Sodium glutaraldehyde bisbisulfite
VII-3: Sodium β-methylglutaraldehyde bisbisulfite
VII-4: Sodium maleic dialdehyde bisbisulfite Of the above aldehyde derivatives, the compound of Formula V, typically formalin, may be used at a concentration of $2.0\times10^{-5}$ to $2.5\times10^{-2}$ mol per one liter of the water washing substitute, preferably $5.0\times10^{-4}$ to $2.0\times10^{-2}$ mol, more preferably $1.0\times10^{-3}$ to $2.0\times10^{-2}$ mol, particularly preferably at a concentration of $2.0\times10^{-3}$ to $2.0\times10^{-2}$ mol at which liquid storability is improved and image storability is also good.

In the present invention, the compounds of the Formulae VI and VII are preferably used. The compounds represented by Formulae VI and VII are excellent in the point that liquid storability is rather improved than being deteriorated even when added in a large amount. Specifically they may be added at concentrations of $2.0\times10^{-5}$ to $8.0\times10^{-2}$ mol, preferably $1.0\times10^{-4}$ to $4.0\times10^{-2}$ mol per one liter of the water washing substitute.

The replenished amount of the water washing substitute of the present invention is required to be 2 to 50-fold of the amount carried over from the previous bath per unit area of the color photographic material to be processed, and in the present invention the processing tank for the water washing substitute is required to be constituted so that the concentration of the previous bath components (bleach-fixing solution or fixing solution) in the water washing substitute should be 1/50 or less in the final tank of the tank for water washing substitute, preferably 1/100 or less, but 1/50 to 1/100000, preferably 1/100 to 1/50000, in aspect of low pollution and storability of liquid.

The processing tank is constituted of a plurality of tanks, and said plurality of tanks should be preferably made 2 tanks to 6 tanks for the present invention.

In the present invention, it is particularly preferable for the effect of the present invention, particularly in low pollution and improvement of image storability, to use 2 to 6 tanks and also a countercurrent system (the system in which processing liquor is fed into the later bath and permitted to overflow from the previous bath).

The amount carried over may differ depending on the kind of the light-sensitive material, the conveying speed of the automatic developing machine, the conveying system, the squeeze system on the surface of the light-sensitive material, but in a color-sensitive material the amount carried over is generally 10 ml/m$^2$ to 150 ml/m$^2$ and the replenished amount of the water washing substitute of the present invention for this amount carried over is in the range of from 100 ml/m$^2$ to 4.0 l/m$^2$. For example, in the case of a color-sensitive material for photography in the case of a conventional color film (roll film), the amount carried over is generally 50 ml/m$^2$ to 150 ml/m$^2$, and the replenished amount at which the effect of the present invention is more effective for this amount carried over is in the range from 100 ml/m$^2$ to 4.0 l/m$^2$, particularly the replenished amount with remarkable effect is in the range from 200 ml/m$^2$ to 1500 ml/m$^2$.

In the case of a color paper, ordinary amount carried over is 10 ml/m$^2$ to 100 ml/m$^2$, and the replenished amount with more marked effect of the present invention for this amount carried over is in the range from 20 ml/m$^2$ to 1.5 l/m$^2$.

The processing temperature for processing with the water washing substitute may be preferably in the range from 15° to 60° C., preferably from 20° to 45° C.

In the water washing substitute of the present invention, the compounds of Formulae VIII, IX and water soluble organic siloxane type compounds may be used, particularly to give good effects to improvement of surface properties and liquid storability.

$$R_1'—O—R_2'—O)_mX_1 \qquad \text{Formula VIII}$$

In the above formula, $R_1'$ represents a monovalent organic group, for example, an alkyl group having 6 to 20, preferably 6 to 12 carbon atoms, including hexyl, heptyl, octyl, nonyl, decyl, undecyl or dodecyl; or an aryl group substituted with an alkyl group having 3 to 20 carbon atoms, and the substituent may be preferably an alkyl group having 3 to 12 carbon atoms, such as propyl, butyl, pentyl, hexyl, heptyl, octyl, nonyl, decyl, undecyl or dodecyl. Examples of the aryl group may include phenyl, tolyl, xynyl, biphenyl or naphthyl, preferably phenyl or tolyl. The position at which the alkyl group is bonded to the aryl group may be either ortho-, meta- or para-position. $R_2'$ represents an ethylene group or a propylene group, and m represents an integer of 4 to 50. $X_1$ represents a hydrogen atom, $—SO_3M$ or $—PO_3M_2$, $M_2$ represents a hydrogen atom, an alkali metal (Na, K or Li, etc.) or $—NH_4$.

$$R_4'—\overset{\overset{R_3'}{|}}{\underset{\underset{R_5'}{|}}{N}}{}^{\oplus}—R_6'.X_2^{\ominus} \qquad \text{Formula IX}$$

In the above Formula, each of $R_3'$, $R_4'$, $R_5'$ and $R_6'$ represents a hydrogen atom, an alkyl group or a phenyl group, and the total number of carbon atoms in $R_3'$, $R_4'$, $R_5'$ and $R_6'$ is 3 to 50. $X_2$ represents a halogen atom, hydroxyl group, a sulfate group, a carbonate group, a nitrate group, an acetate group or p-toluene sulfonate anion.

In the following, specific examples of the compound represented by Formulae VIII, IX and water-soluble organic siloxane type compounds are set forth, but the compounds according to the present invention are not limited thereto.

(Exemplary compound represented by Formula VIII)

$C_{12}H_{23}O(C_2H_4O)_{10}H$ VIII-1

$C_8H_{17}O(C_{13}H_6O)_{15}H$ VIII-2

-continued (Exemplary compound represented by Formula VIII)

$C_9H_{19}O(C_2H_4O)_4SO_3Na$ VIII-3

$C_{10}H_{21}O(C_2H_4O)_{15}PO_3Na_2$ VIII-4

VIII-5

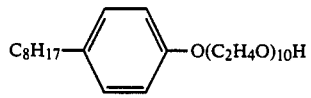

VIII-6

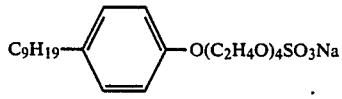

VIII-7

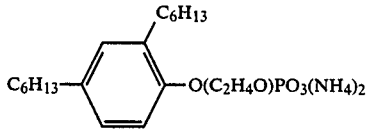

VIII-8

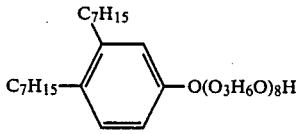

VIII-9

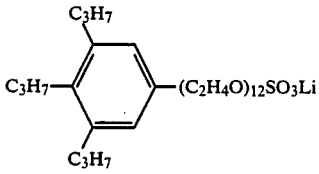

VIII-10

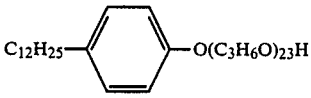

VIII-11

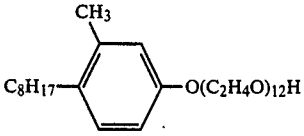

VIII-12

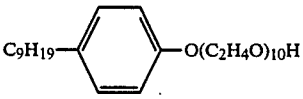

(Exemplary compound represented by Formula IX)

IX-1

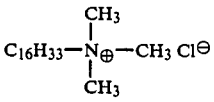

IX-2

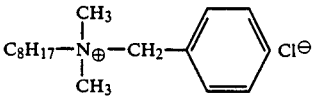

IX-3

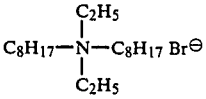

-continued (Exemplary compound represented by Formula IX)

IX-4

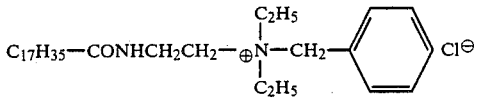

IX-5

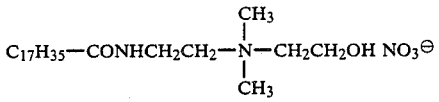

IX-6

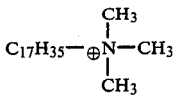

IX-7

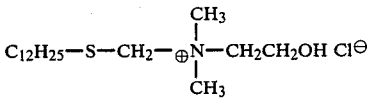

IX-8

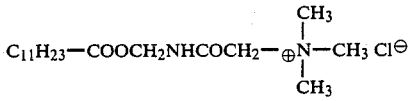

IX-9

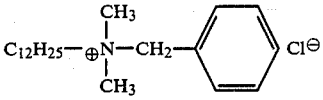

IX-10

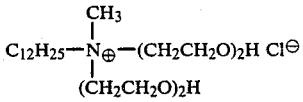

The water-soluble organic siloxane type compound of the present invention means general water-soluble organic siloxane type compounds as disclosed in, for example, Japanese Unexamined Patent Publication No. 18333/1972, Japanese Patent Publication Nos. 51172/1980, 37538/1976, Japanese Unexamined Patent Publication No. 62128/1974 and U.S. Pat. No. 3,545,970.

Among the above water-soluble organic siloxane type compounds, particularly the compounds represented by the following Formula X may be preferably used.

Formula X

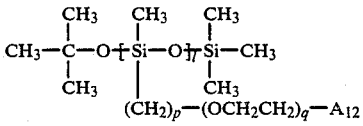

In the above formula, $A_{12}$ represents a hydrogen atom, hydroxy group, a lower alkyl group, an alkoxy group,

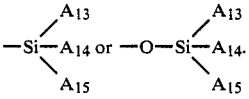

Each of $A_{13}$, $A_{14}$ and $A_{15}$ represents a lower alkyl group (preferably an alkyl group having 1 to 3 carbon atoms such as methyl, ethyl, propyl, etc.) and the above $A_{13}$, $A_{14}$ and $A_{15}$ may be either the same or different. l represents an integer of 1 to 4 and p and q represent integers of 1 to 15.

In the following, specific examples of the compounds represented by Formula X are shown.

(Water-soluble organic siloxane type compound)

X-1

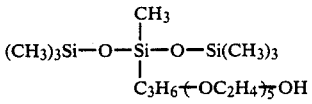

X-2

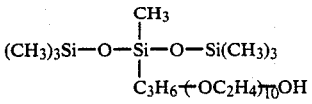

X-3

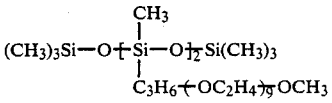

X-4

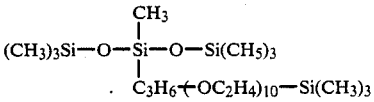

X-5

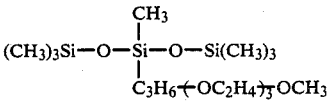

X-6

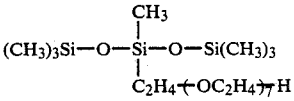

X-7

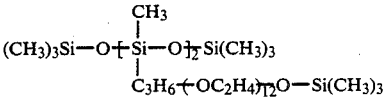

X-8

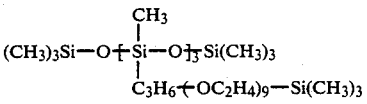

X-9

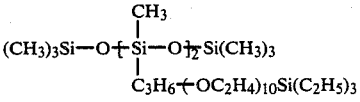

X-10

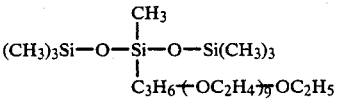

X-11

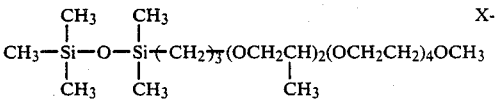

X-12

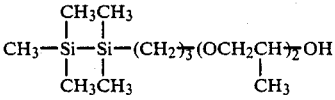

-continued (Water-soluble organic siloxane type compound)

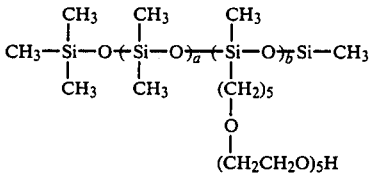

X-13 a + b = 30

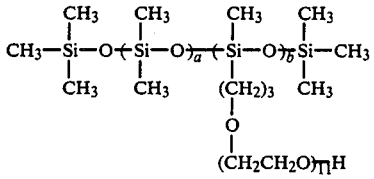

X-14 a + b = 41

These compounds represented by the above Formulae VIII and IX and water-soluble organic siloxane type compounds may be used either singly or in combination. Further, when they are used in an amount added in the range from 0.01 to 20 g per one liter of the water washing substitute, good effect can be exhibited with respect to contamination.

Also, among the compounds represented by the above Formulae VIII, IX and water-soluble organic siloxane type compounds, the compound preferably used in the present invention is the compound represented by the above Formula VIII, which has a great effect for preventing generation of silver sulfide.

Also, in the water washing substitute of the present invention, it is preferable to incorporate a chelating agent represented by Formulae 1 to 3 for improvement of the white ground of the unexposed portion.

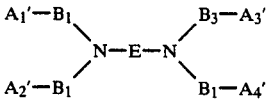

Formula 1

(wherein, E represents an alkylene group, a cycloalkylene group, a phenylene group, $—B_5—O—B_5—$, $—B_5—O—B_5—O—B_5—$ or $—B_5—Z—B_5—$; Z represents

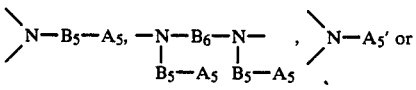

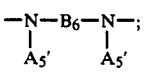

each of $B_1$ to $B_6$ represents an alkylene group; each $A_1'$ to $A_3'$ represents —COOM' or $—PO_3M_2'$, and each of $A_4'$ and $A_5'$ represents a hydrogen atom, a hydroxyl group, —COOM' or $—PO_3M_2'$; M' represents a hydrogen atom or an alkali metal atom).

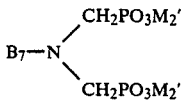

Formula 2

(wherein $B_7$ represents an alkyl group, an aryl group or a nitrogen containing 6-membered cyclic group, M' represents a hydrogen atom or an alkali metal atom).

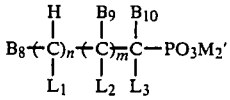

Formula 3

(wherein each of $B_8$, $B_9$ and $B_{10}$ represents a hydrogen atom, a hydroxyl group, —COOM', $—PO_3M_2'$ or an alkyl group; each of $L_1$, $L_2$ and $L_3$ represents a hydrogen atom, a hydroxyl group, —COOM', $—PO_3M_2'$ or

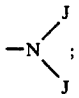

J represents a hydrogen atom, an alkyl group, $—C_2H_4OH$ or $—PO_3M_2'$; M' represents a hydrogen atom or an alkali metal atom; n and m each represent 0 or 1).

In the following, a part of specific examples of the chelating agents represented by Formulae 1, 2 and 3 are shown. The chelating agents to be used in the present invention are not limited to the specific examples shown below.

(Exemplary chelating agent)

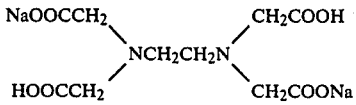

(1)

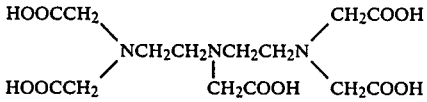

(2)

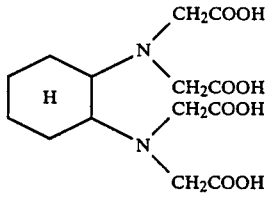

(3)

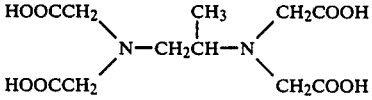

(4)

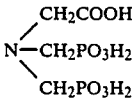

(5)

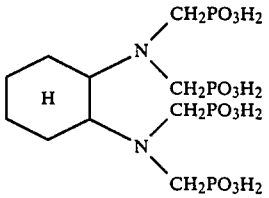

(6)

-continued
(Exemplary chelating agent)
(7)
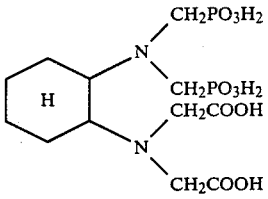
(8)
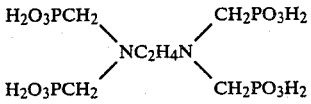
(9)
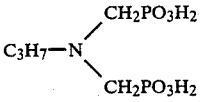
(10)
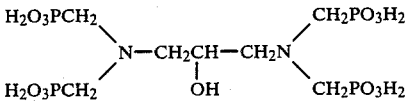
(11)
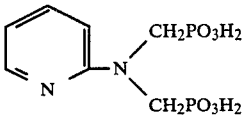
(12)
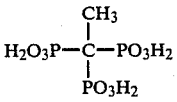
(13)
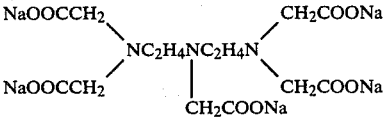
(14)
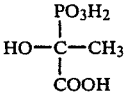
(15)
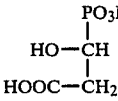
(16)
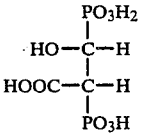
(17)
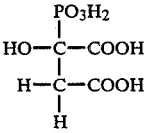
(18)
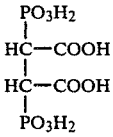
-continued
(Exemplary chelating agent)
(19)
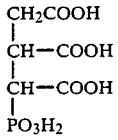
(20)
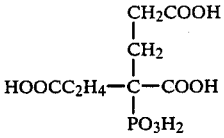
(21)
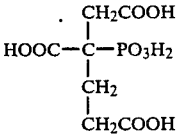
(22)
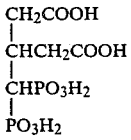
(23)
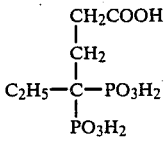
(24)
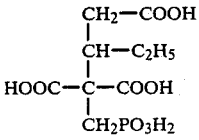
(25)
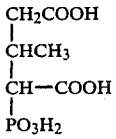
(26)
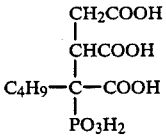
(27)
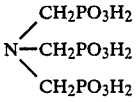
(28)
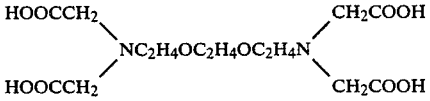
(29)
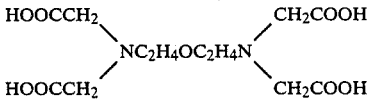
(30)
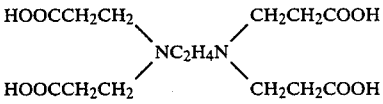

-continued (Exemplary chelating agent)

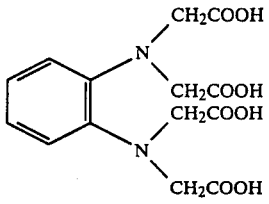

(31)

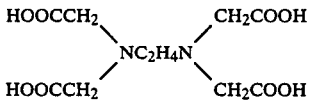

(32)

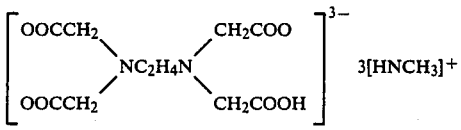

(33)

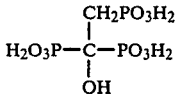

(34)

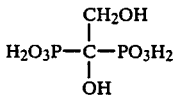

(35)

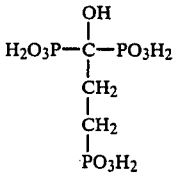

(36)

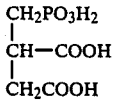

(37)

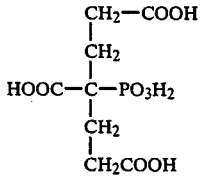

(38)

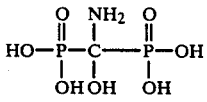

(39)

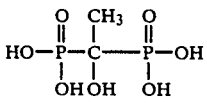

(40)

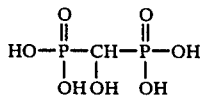

(41)

-continued (Exemplary chelating agent)

(42)

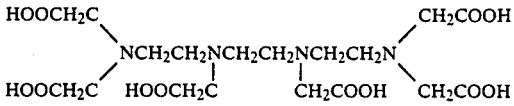

The chelating agents preferably used in the present invention may preferably be used in an amount of 0.01 to 100 g, more preferably 0.05 to 50 g, particularly preferably 0.1 to 20 g per 1 liter of the washing water substitute of the present invention.

The pH value of the washing solution substitute may be adjusted preferably in the range of pH 5.0 to 9.0, more preferably in the range of 5.5 to 9.0, particularly preferably in the range of pH 6.0 to 8.5 for the purpose of improving the effect or image storability of the present invention.

As the pH regulator which can be contained in the washing solution substitute of the present invention, any of alkali agents or acidic agents generally known may be used.

To the washing solution substitute to be used in the present invention, there may be added salts of organic acid (citric acid, acetic acid, succinic acid, oxalic acid, benzoic acid, etc.), pH regulators (phosphate, borate, hydrochloric acid, sulfate, etc.), surfactants, antifungal agents, salts of a metal such as Bi, Mg, Zn, Ni, Al, Sn, Ti, Zr, etc, and the like. These compounds may be added in an any amount and in any combination so long as the amount added is an amount necessary to maintain the pH value of the washing solution substitute of the present invention and will not affect adversely the stability of color photographic image under storing and the genetation of precipitation.

The antifungal agents preferably used in the washing solution substitute of the present invention include hydroxybenzoate compounds, phenol type compounds, thiazole type compounds, pyridine type compounds, guanidine type compounds, carbamate type compounds, morpholine type compounds, quarternary phosphonium type compounds, ammonium type compounds, urea type compounds, isoxazole type compounds, propanolamine type compounds, sulfamide type compounds, amino acid type compounds and benztriazole type compounds.

The above hydroxybenzoate compounds are methyl-, ethyl-, propyl- and butyl-hydroxybenzoate, preferably n-butyl-, isobutyl- and propyl hydroxybenzoate, more preferably a mixture of three kinds of hydroxybenzoate described above.

The phenol type compounds preferably used as the antifungal agents of the present invention are a compound which may have as a substituent an alkyl group, a halogen atom, a nitro group, a hydroxy group, a caboxylic group, an amino group, a phenyl group, etc, preferably ortho-phenylphenol, ortho-cyclohexylphenol, phenol, nitrophenol, chlorophenol, cresol, guaiacol and aminophenol. Otho-phenylphenol particularly preferably exhibits a remarkable antifungal property when combined with the aldehyde derivative of the present invention.

The thiazole type compounds are a compound having a nitrogen atom or a sulfur atom on the five-membered ring, and preferably 1,2-benzisothiazolin-3-one, 2-methyl-4-isothiazolin-3-one, 2-octyl-4-isothiazolin-3-one, 5-chloro-2-methyl-4-isothiazoline-3-one and 2-chloro-4-thiazolyl-benzimidazole.

The pyridine type compounds include specifically 2,6-dimethylpyridine, 2,4,6-trimethylpyridine, sodium-2-pyridinethiol-1-oxide, etc., and preferably sodium-2-pyridinethiol-1-oxide.

The guanidine type compounds are specifically cyclohexydine, polyhexamethylene, biguanidine hydrochloride, dodecylguanidine hydrochloride and preferably dodecylguanidine and a salt thereof.

The carbamate type compounds are specifically methyl-1-(butylcarbamoyl)-2-benzimidazolecarbamete, methylimidazolcarbamate, etc.

The morpholine type compounds include specifically 4-(2-nitrobutyl)morpholine, 4-(3-nitrobutyl)morpholine, etc.

The quarternary phosphonium type compounds are a tetraalkylphosphonium salt, a tetraalkoxyphosphonium salt, etc., and preferably a tetraalkylphosphonium salt, more specifically preferable compounds are tri-n-butyltetradecylphosphonium chloride, tri-phenyl.nitrophenylphosphonium chloride.

The quarternary ammonium compounds are specifically a benzalkonium salt, a benzethonium salt, a tetraalkyl ammonium salt, an alkyl pyridinium salt, and specifically are dodecyldimethylbenzylammonium chloride, didecyldimethylammonium chloride, laurylpyridinium chloride, etc.

The urea type compounds are specifically N-(3,4-dichlorophenyl)-N'-(4-chlorophenyl)urea, N-(3-trifluoromethyl-4-chlorophenyl)-N'-(4-chlorophenyl-)urea, etc.

The isoxazole type compounds are specifically 3-hydroxy-5-methyl-isoxazole, etc.

The propanolamine type compounds include n-propanols and isopropanols and specifically are DL-2-benzylamino-1-propanol, 3-diethylamino-1-propanol, 2-dimethylamio-2-methyl-1-propanol, 3-amino-1-propanol, isopropanolamine, diisopropanolamine, N,N-dimethyl-isopropanolamine, etc.

The sulfamide type compounds include o-nitrobenzenesulfamide, p-aminobenzenesulfamide, 4-chloro-3,5-dinitrobenzenesulfamide, α-amino-p-toluenesulfamide, etc.

The amino acid type compounds are specifically N-lauryl-β-alanine.

The benztriazole type compounds include specifically compounds as shown below.

Benztriazole (a)

(b)

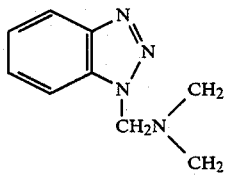

(c)

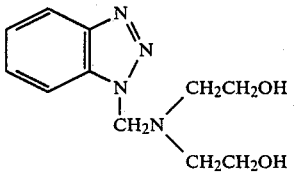

-continued (d)

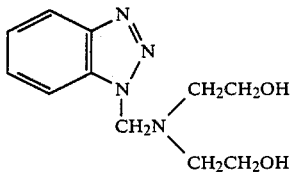

(e)

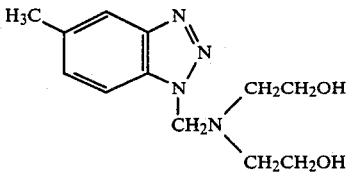

(f)

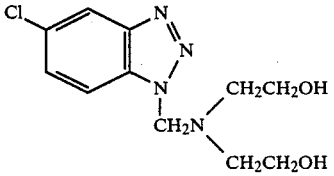

(g)

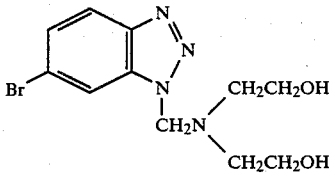

Of the above antifungal agents, the compounds preferably used in the present invention are phenol type compounds, thiazole type compounds, pyridine type compounds, guanidine type compounds, quaternary ammonium type compounds, benztriazole type compounds. Further, particularly preferably in liquid storability, phenol type compounds, thiazole type compounds and benztriazole type compounds are employed.

The amount of the antifungal agent added in the water washing substitute may be preferably in the range from 0.001 g to 50 g, more preferably from 0.005 g to 10 g per 1 liter of the water washing substitute with respect to the effect of the present invention and cost as well as storage stability of the image.

In the processing of the present invention, silver may be recovered according to various methods from the processing liquors containing soluble silver salts such as the water washing substitute as a matter of course, and also fixing liquor and bleach-fixing liquor, etc. For example, it is possible to utilize effectively the electrolytic method (disclosed in French Pat. No. 2,299,667), the precipitation method (disclosed in Japanese Unexamined Patent Publication No. 73037/1977, German Pat. No. 2,331,220), the ion exchange method (Japanese Unexamined Patent Publication No. 17114/1976, German Pat. No. 2,548,237), and the metal substitution method (disclosed in U.K. Pat. No. 1,353,805), etc.

Further, during silver recovery, the above soluble silver salts may be subjected to silver recovery according to the above method by recovering the overflowed processing liquor, and the residual liquor may be disposed as waste liquor, or alternatively it may be used as the replenishment liquor or tank processing liquor with addition of a regenerating agent. It is particularly preferable to carry out silver recovery after mixing the stabilizing liquor with fixing liquor or bleach-fixing liquor.

Also, it is possible to use the treatment in which the water washing substitute of the present invention is contacted with ion exchange resin, the electrodialysis treatment (see Japanese Unexamined Patent Publication No. 28949/1986) or the reverse osmosis treatment (see Japanese Unexamined Patent Publication No. 28949/1986), etc.

In the present invention, when the thiosulfate concentration in the water washing substitute is $0.7\times10^{-5}$ to $1500\times10^{-5}$ mol/liter, the effect of the object of the present invention can be better brought about, and also another effect of improvement of prolonged storability of dye image is also exhibited, and therefore it is more preferably used in the above range.

Further, particularly when used at a concentration in the range from $2\times10^{-5}$ to $200\times10^{-5}$ mol/liter, especially good results can be obtained. The above thiosulfate concentration in the water washing substitute of the present invention refers to the thiosulfate concentration in the tank nearest to the drying step when the water washing substitute comprises two or more tanks, while it refers to the thiosulfate concentration in the single tank in the case of a single tank.

Also, in the water washing substitute, a circulation pump and a filter device may be arranged as desired.

Aromatic primary amine color developing agents to be used in the color developing solution to be used in the color developing processing in the present invention may include known agents used widely in various color photographic processes. These developing agents include aminophenol type and p-phenylenediamine type derivatives. These compounds are generally used in the form of salts such as hydrochlorides or sulfates for stabilization rather than in the free state. Also, these compounds may be used generally at a concentration of about 0.1 g to about 30 g per 1 liter of color developing solution, preferably at a concentration of about 1 g to about 1.5 g per 1 liter of color developing solution.

Aminophenol type developing agents may include, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developing agents are N,N'-dialkyl-p-phenylenediamine type compounds, and the alkyl group and the phenyl group may be substituted with any desired substituent. Among them, particularly useful examples of compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamideethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate and so on.

In the color developing solution to be used in the processing of the present invention, in addition to the above primary aromatic amine type color developing agent, various components conventionally added in the color developing solution, for example, alkali agents such as sodium hydroxide, sodium carbonate, potassium carbonate, etc., alkali metal sufites, alkali metal bisulfites, alkali metal thiocyanates, alkali metal halides, benzyl alcohol, water softeners and thickening agents, etc., may be further incorporated as desired. The pH value of this color developing solution may be usually 7 or higher, most generally about 10 to about 13.

In the present invention, after the color developing processing, processing with a processing liquor having fixing ability is conducted, and when the processing liquor having said fixing ability is a fixing solution, bleaching processing is performed prior thereto. As the bleaching agent to be used in the bleaching solution or bleach-fixing solution used in said bleaching step, a metal complex of an organic acid may be employed, and said metal complex has the action of changing the metallic silver formed by development to silver halide by oxidation and simultaneously the action of color formation of the uncolored portion of the color forming agent, and its structure comprises a metal ion such as iron, cobalt, copper, etc., coordinated with an organic acid such as aminopolycarboxylic acid or oxalic acid, citric acid, etc. As the most preferable organic acid to be used for formation of such metal complex of organic acid, polycarboxylic acid or aminopolycarboxylic acid may be employed. These polycarboxylic acids or aminopolycarboxylic acids may be alkali metal salts, ammonium salts or water-soluble amine salts.

Specific examples of these may include those as shown below.

[1] Ethylenediaminetetraacetic acid
[2] Diethylenetriaminepentaacetic acid
[3] Ethylenediamine-N-(β-oxyethyl)-N,N',N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartaric acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Disodium ethylenediaminetetraacetate
[14] Tetratrimethylammonium ethylenediaminetetraacetate
[15] Tetrasodium ethylenediaminetetraacetate
[16] Pentasodium diethylenetriaminepentaacetate
[17] Sodium ethylenediamine-N-(β-oxyethyl)-N,N',N'-triacetate
[18] Sodium propylenediaminetetraacetate
[19] Sodium nitriloacetate
[20] Sodium cyclohexanediaminetetraacetate The bleaching solution to be used contains a bleaching agent of a metal complex of organic acid as mentioned above and can also contain various additives. As the additive, it is particularly desirable to incorporate rehalogenating agents, including alkali halides or ammonium halides, such as potassium bromide, sodium bromide, sodium chloride, ammonium bromide, etc., metal salts and chelating agents. It is also possible to add suitably those which have been known to be added conventionally in bleaching solutions, for example, pH buffering agents such as borates, oxalates, acetates, carbonates, phosphates, etc., alkylamines, polyethylene oxides, etc.

Further, the fixing solution and bleach-fixing solution can contain pH buffering agents comprising various salts, including sulfites such as ammonium sulfite, potassium sulfite, ammonium bisulfite, potassium bisulfite, sodium bisulfite, ammonium metabisulfite, potassium metabisulfite, sodium metabisulfite, etc., boric acid, borax, sodium hydroxide, potassium hydroxide, sodium carbonate, potassium carbonate, sodium bicarbonate, potassium bicarbonate, acetic acid, sodium acetate, ammonium hydroxide, etc., either singly or as a combination of two or more compounds.

In the present invention, when speed-up of processing and miniaturization of automatic developing machine are considered, the precedent bath for the water washing substitute should be preferably a bleach-fixing bath, which has the advantage of improvement of image storability as still another effect.

When the processing of the present invention is performed while a replenishing agent for bleach-fixing is replenished into the bleach-fixing solution (bath), a thiosulfate, thiocyanate or sulfite, etc., may be contained in said bleach-fixing solution (bath), or alternatively these salts may be contained in said bleach-fixing replenishing solution and replenished into the processing bath.

In the present invention, for enhancing activity of the bleach-fixing solution, blowing of air or blowing of oxygen may be also effected into the bleach-fixing bath and the storage tank for the bleach-fixing supplementing solution, or alternatively an appropriate oxidizing agent such as hydrogen peroxide, a hydrobromide, a persulfate, etc., may be suitably added.

The silver halide in the color sensitive material for photographing to be used in the present invention is silver iodobromide, and the crystal of the silver halide grain may be normal crystal, twin crystal or others, and a crystal with any desired ratio of [100] face to [111] face may be available. Further, the crystal structure of these silver halide grains may be either uniform from the internal portion to the outer portion or may have a layered structure with the inner portion and the outer portion being heterogeneous (core-shell type). Also, these silver halides may be either of the type forming latent images primarily on the surface or of the type forming them internally of the grains. Further, it is also possible to use flat plate silver halide grains (see Japanese Unexamined Patent Publication No. 113934/1983, Japanese Patent Application No. 170070/1984).

Flat plate silver halide emulsions are described in the report of Cugnac, Chateau, "Photographic Emulsion Chemistry" by Duffin (published by Focal Press, New York, 1966) p. 66–72, and "Phot., Journal" edited by A. P. O. Trivelli, W. F. Smith 80 (1940), p. 285, and they can be easily prepared by referring to the methods as disclosed in Japanese Unexamined Patent Publication Nos. 113927/1983, 113928/1983, 127921/1983.

In the photographic constituent layer in the light-sensitive silver halide color photographic material of the present invention, a water soluble dye or a dye capale of being decolorized with a color developing solution (AI dye) can be added, and said AI dye may include oxonol dyes, hemioxonol dyes, melocyanine dyes and azo dyes. Among them, oxonol dyes, hemioxonol dyes and melocyanine dyes, etc., are useful. Examples of avaiable AI dyes may include those as disclosed in U.K. Pat. Nos. 584,609, 1,277,429, Japanese Unexamined Patent Publication Nos. 85130/1973, 99620/1974, 114420/1974, 129537/1974, 108115/1977, 25845/1984, 111640/1984, 111641/1984, U.S. Pat. Nos. 2,274,782, 2,533,472, 2,956,079, 3,125,448, 3,148,187, 3,177,078, 3,247,127, 3,260,601, 3,540,887, 3,575,704, 3,653,905, 3,718,472, 4,071,312, 4,070,352.

These AI dyes may be used preferably at a concentration of $2\times10^{-3}$ to $5\times10^{-1}$ mol, more preferably $1\times10^{-2}$ to $1\times10^{-1}$ mol per 1 mol of silver in the emulsion layer.

The silver halide grains particularly preferably used in the present invention are substantially monodispersed, and this may be obtained according any preparation method such as the acidic method, the neutral method or the ammonia method, etc.

Also, for example, it is possible to use a method in which seed grains are prepared by the acidic method, and further the grains are permitted to grow according to the ammonia method with rapid growth speed to desired sizes. In the case of growing silver halide grains, it is preferable to control pH, pAg in the reactor and injecting successively and simultaneously silver ions and halide ions in amounts corresponding to the growth speed of the silver halide grains to be mixed therein as described in Japanese Unexamined Patent Publication No. 48521/1979.

As the silver halide solvent, known solvents can be used. As the silver halide solvent frequently used, ammonia, thioether, thioureas, thiocyanates, thiazolinediones, etc., may be included. Concerning thioethers, reference may be made to U.S. Pat. Nos. 3,271,157, 3,574,628, 3,790,387, etc., on the other hand, concerning thioureas, reference may be made to Japanese Unexamined Patent Publication Nos. 82408/1978, 77737/1980; concerning thiocyanates, to U.S. Pat. Nos. 2,222,264, 2,448,534, 3,320,069; and concerning thiazolinediones, to Japanese Unexamined Patent Publication No. 144319/1978, respectively.

These silver halide emulsions may be also chemically sensitized with active gelatin; sulfur sensitizers, for example, sulfur sensitizers such as allylthiocarbamide, thiourea, cystine, etc.; selenium sensitizer; reductive sensitizers, such as stannous salts, thiourea dioxide, polyamines, etc.; noble metal sensitizers, for example, gold sensitizers, specifically potassium aurithiocyanate, potassium chloroaurate, 2-aurothio-3-methylbenzothiazolium chloride, etc., or sensitizers of water-soluble salts such as of ruthenium, palladium, platinum, rodium, iridium, etc., specifically ammonium chloropalladate, potassium chloroplatinate and sodium chloropalladate (some kinds of these act as sensitizers or as antifoggants, etc., depending on their amounts), etc., either singly or by use of a suitable combination (for example, combination of a gold sensitizer and a sulfur sensitizer, combination of a gold sensitizer and selenium sensitizer, etc.).

Specific examples of these sensitizers are disclosed in U.S. Pat. Nos. 1,574,944, 2,278,947, 2,410,689, 2,728,668, 3,656,955 concerning the sulfur sensitization method; in U.S. Pat. Nos. 2,419,974, 2,983,609, 4,054,458 concerning the reductive sensitization method; U.S. Pat. Nos. 2,399,083, 2,448,060 and U.K. Patent 618,061 concerning the noble metal sensitization method.

The silver halide emulsion according to the present invention may be subjected to chemical aging with addition of a sulfur containing compound, and before, during or after this chemical aging, at least one kind of hydroxytetrazaindene and at least one kind of nitrogen containing heterocyclic compounds having mercapto group may be contained.

The silver halide to be used in the present invention may be also subjected to optical sensitization with addition of an appropriate sensitizing dye at a concentration of $5\times10^{-8}$ to $3\times10^{-3}$ mol per 1 mol of silver halide for imparting light sensitivity to the respective desired sensitive wavelength region. As the sensitizing dye, various dyes can be employed, and the respective sensitizing dyes can be used either singly or as a combination of two or more kinds. In the present invention, examples of the sensitizing dyes advantageously used may include those as set forth below.

More specifically, examples of the sensitizing dye to be used in the blue-sensitive silver halide emulsion may include those disclosed in German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, U.K. Pat. No. 1,242,588, Japanese Patent Publication Nos. 14030/1969, 24844/1977, etc. On the other hand, examples of the sensitizing dye to be used in the green-sensitive silver halide emulsion may include cyanine dyes, melocyanine dyes or complex cyanine dyes as disclosed in U.S. Pat. Nos. 1,939,201, 2,072,908, 2,739,149, 2,945,763, U.K. Pat. No. 505,979, etc., as representative ones. Further, examples of the sensitizing dye to be used in the red-sensitive silver halide emulsion may include cyanine dyes, melocyanine dyes or complex cyanine dyes as disclosed in U.S. Pat. Nos. 2,269,234, 2,270,378, 2,442,710, 2,454,629, 2,776,280, etc., as representative ones. Further, cyanine dyes, melocyanine dyes or complex cyanine dyes as disclosed in U.S. Pat. Nos. 2,213,995, 2,493,748, 2,519,001, German Pat. No. 929,080, etc., can be also advantageously used in the green-sensitive silver halide emulsion or the red-sensitive silver halide emulsion.

These sensitizing dyes may be used either alone or as a combination of these dyes.

The photographic light-sensitive material of the present invention may be also applied with optical sensitization according to the spectral sensitization method with a single use or combination of cyanine or melocyanine dyes to the desired wavelength region, if desired.

As the particularly preferable spectral sensitization method, for example, representative methods concerning combination of benzimidazolocarbocyanine and benzooxazolocarbocyanine are disclosed in Japanese Patent Publication Nos. 4936/1968, 22884/1968, 18433/1970, 37443/1972, 28293/1973, 6209/1974, 12375/1978, Japanese Unexamined Patent Publication Nos. 52-23931, 51932/1977, 80118/1979, 153926/1983, 116646/1984, 116647/1984, etc.

Also, the methods concerning combination of carbocyanine having benzimidazole nucleus with other cyanine or melocyanine are disclosed in, for example, Japanese Patent Publication Nos. 25831/1970, 11114/1972, 25379/1972, 38406/1973, 38407/1973, 34535/1979, 1569/1980, Japanese Unexamined Patent Publication Nos. 33220/1975, 38526/1975, 107127/1976, 115820/1976, 135528/1976, 104916/1977, 104917/1977, etc.

Further, the methods concerning combination of benzooxazolocarbocyanine (oxa-carbocyanine) with other carbocyanine are disclosed in, for example, Japanese Patent Publication Nos. 32753/1969, 11627/1971, Japanese Unexamined Patent Publication No. 1483/1982; those concerning melocyanine in, for example, Japanese Patent Publication Nos. 38408/1973, 41204/1973, 40662/1975, Japanese Unexamined Patent Publication Nos. 25728/1981, 10753/1983, 91445/1983, 116645/1984, 33828/1975, etc.

Also, the methods concerning a combination of thiacarbocyanine and other carbocyanine are disclosed in, for example, Japanese Patent Publication Nos. 4932/1968, 4933/1968, 26470/1970, 18107/1971, 8741/1972, Japanese Unexamined Patent Publication No. 114533/1984, etc. Further, the method disclosed in Japanese Pablication No. 6207/1974 by use of zeromethine or dimethinemerocyanine, monomethine or trimethine cyanine and styryl dye can be advantageously used.

For adding these sensitizing dyes into the silver halide emulsion according to the present invention, they may be used as the dye solution previously dissolved in, for example, methyl alcohol, ethyl alcohol, acetone, dimethylformamide, or a hydrophilic organic solvent such as fluorinated alcohol as disclosed in Japanese Patent Publication No. 40659/1975, etc.

The timing for addition may be at any point on initiation of chemical aging of the silver halide emulsion, during aging or after completion of aging, and in some cases it may be also added in the step immediately before coating of the emulsion.

In the respective silver halide emulsion layers according to the present invention, couplers, namely compounds capable of forming dyes through the reaction with the oxidized product of a color developing agent can be contained.

As the above couplers available in the present invention, various yellow couplers, magenta couplers and cyan couplers can be used without any special limitation. These couplers may be either of the so called diequivalent type or of the tetraequivalent type, and also couplers of the diffusible dye release type, etc., can be also used in combination with these couplers.

As the above yellow coupler, it is possible to use closed chain ketomethylene compounds, further those called as the diequivalent type couplers, such as active site-o-aryl substituted couplers, active site-o-acyl substituted couplers active site hydantoin compound substituted couplers, active site urazole compound substituted couplers and active site sccinimide compound substituted couplers, active site fluorine substituted couplers, active site chlorine or bromine substituted couplers, active site-o-sulfonyl substituted couplers, etc., as effective yellow couplers. Specific examples of avaiable yellow couplers may include those as disclosed in U.S. Pat. Nos. 2,875,057, 3,265,506, 3,408,194, 3,551,155, 3,582,322, 3,725,072, 3,891,445, German Patent 1,547,868, German Patent Applications 2,219,917, 2,261,361, 2,414,006, U.K. Pat. No. 1,425,020, Japanese Patent Publication No. 10783/1976, Japanese Unexamined Patent Publication Nos. 26133/1972, 73147/1973, 102636/1976, 6341/1975, 123342/1975, 130442/1975, 21827/1976, 87650/1975, 82424/1977, 115219/1977, 95346/1983, etc.

The magenta coupler to be used in the present invention may include pyrazolone type, pyrazolotriazole type, pyrazolinobenzimidazole type, indazolone type compounds. These magenta couplers may include not only tetraequivalent type couplers, but also diequivalent type couplers, similarly as yellow couplers. Specific examples of the magenta coupler may include those as disclosed in U.S. Pat. Nos. 2,600,788, 2,983,608, 3,062,653, 3,127,269, 3,369,897, 3,311,476, 3,419,391, 3,519,429, 3,558,319, 3,582,322, 3,615,506, 3,834,908, 3,891,445, German Pat. No. 1,810,464, German Patent Application (OLS) Nos. 2,408,665, 2,417,945, 2,418,959, 2,424,467, Japanese Patent Publication Nos. 6031/1965, 20826/1976, 58922/1977, 129538/1974, 74027/1974, 159336/1975, 42121/1977, 74028/1974, 60233/1975, 26541/1976, 55122/1978, Japanese Unexamined Patent Publication No. 44705/1979, etc.

Further, useful cyan couplers to be used in the present invention may be exemplified by phenol type, naphtol type couplers, etc., and these cyan couplers may include not only tetraequivalent type couplers but also diequivalent type couplers similarly as yellow couplers. Specific examples of the cyan coupler may include those as disclosed in U.S. Pat. Nos. 2,369,929, 2,434,272, 2,474,293, 2,521,908, 2,772,162, 2,895,826, 3,034,892, 3,311,476, 3,458,315, 3,476,563, 3,583,971, 3,591,383, 3,758,308, 3,767,411, 3,772,002, 3,933,494, 4,044,929, 4,126,396, 4,334,011, 4,327,173, German Patent Application (OLS) Nos. 2,414,830, 2,454,329, 3,329,729, Japanese Unexamined Patent Publication Nos. 59838/1973, 26034/1976, 5055/1973, 146827/1976, 69624/1977, 90932/1977, 95346/1983, Japanese Patent Publication No. 11572/1974, etc.

Also, in the present invention, the polymer couplers as disclosed by the present applicant in Japanese Unexamined Patent Publication No. 50143/1986 may be preferably used.

The couplers to be used in the present invention, for satisfying the characteristics demanded for the light-sensitive material, may be used in combination of two or more kinds in the same layer, or alternatively it is also permissible to add the same compound in two or more different layers.

For correction of unnecessary absorptions in short wavelength regions possessed by the color forming dyes of magenta and cyan couplers, it is preferable to use a colored coupler in the color sensitive material for photographing. For example, there may be employed yellow colored magenta couplers as disclosed in U.S. Pat. No. 4,163,670 and Japanese Patent Publication No. 39413/1972 or a magenta colored cyan couplers as disclosed in U.S. Pat. Nos. 4,004,929, 4,138,258 and U.K. Pat. No. 1,146,368, etc.

Also, as the color forming dye diffusion type couplers, specific examples of magenta couplers are disclosed in U.S. Pat. No. 4,366,237 and U.K. Pat. No. 2,125,570, and also specific examples of yellow, magenta and cyan are disclosed in European Pat. No. 96,873 and German Patent Publication (OLS) No. 3,324,533.

The DIR couplers which can be used in the present invention are described below.

As the DIR coupler, there may be included those which release heterocyclic mercapto type development inhibitor as disclosed in U.S. Pat. No. 3,227,554; those which release benzotriazole derivative as the development inhibitor as disclosed in Japanese Patent Publication No. 9942/1983; the so called non-coloration DIR couplers as disclosed in Japanese Patent Publication No. 16141/1976; those which release nitrogen containing heterocyclic development inhibitor with accompaniment of decomposition of methylol after elimination as disclosed in Japanese Unexamined Patent Publication No. 90932/1975; those which release development inhibitor with accompaniment of intramolecular nucleophilic reaction after elimination as disclosed in U.S. Pat. No. 4,248,962 and Japanese Unexamined Patent Publication No. 56837/1982; those which release development inhibitor by electron transfer through a conjugated system after elimination as disclosed in 114946/1981, 154234/1982, 188035/1982, 98728/1983, 209736/1983, 209737/1983, 209738/1983, 209739/1983, 209740/1983, etc.; those which release diffusible development inhibitor which is deactivated in development inhibiting ability in a developing solution as disclosed in Japanese Unexamined Patent Publication Nos. 151944/1982, 217932/1983, etc.; those which release reactive compound, thereby forming development inhibitor or deactivating development inhibitor through the reaction in the film during developing; and so on.

In the present invention, it is possible to use a compound capable of forming a development accelerator or a foggant with the progress of silver development. Specifically, there may be employed the compounds as disclosed in Japanese Unexamined Patent Publication No. 150845/1982, etc.

Other various additives for photography can be contained in the light-sensitive color photographic material of the present invention. For example, it is possible to use antifoggants, stabilizers, UV-ray absorbers, color staining preventives, fluorescent brighteners, color image fading preventives, antistatic agents, film hardeners, surfactants, plasticizers, wetting agents, etc.

In the light-sensitive color photographic material of the present invention, the hydrophilic colloid to be used for preparation of an emulsion may include any of gelatin, derivative gelatin, graft polymers of gelatin with other polymers, proteins such as albumin, casein, etc., cellulose derivatives such as hydroxyethyl cellulose derivative, carboxymethyl cellulose, etc., starch derivatives, synthetic hydrophilic polymers of homopolymer or copolymer such as polyvinyl alcohol, polyvinylimidazole, polyacrylamide, etc.

As the support of the light-sensitive color photographic material of the present invention, there may be employed, for example, baryta paper, polyethylene coated paper, polypropylene sythetic paper, transparent supports having provided a reflective layer provided in combination or using a reflective member in combination, for example, a glass plate, cellulose acetate, cellulose nitrate or polyester film such as polyethylene terephthalate, etc., polyamide film, polycarbonate film, polystyrene film, etc. These supports may be selected suitably depending on the purpos of use of the light-sensitive material.

For coating of the silver halide emulsion layers and other photographic constituent layers to be used in the present invention, various coating methods such as dipping coating, air doctor coating, curtain coating, hopper coating, etc., can be used. Also, it is possible to use the simultaneous coating method of two or more layers according to the methods as disclosed in U.S. Pat. Nos. 2,761,791 and 2,941,898.

In the light-sensitive material of the present invention, an intermeadiate layer with a suitable thickness may be optionally provided depending on the purpose, and further various layers such as filter layer, curl prevention layer, protective layer, antihalation layer, etc., can be used as constituent layers in a suitable combination. In these constituent layers, hydrophilic colloids which can be used in the emulsion layers as described above can be similarly used as the binder, and also various additives for photography which can be contained in the emulsion layers as described above can be contained in those layers.

The light-sensitive material applicable in the present invention may be any of color reversal films for slide, color reversal films for movie, color reversal films for TV, color reversal printing paper for print, color reversal printing paper for photographing, color negative films, color printing papers, etc.

The present invention is described in more detail by referring to the following Examples, but the embodiment of the present invention are not limited to these.

EXAMPLE 1

Water washing substitute shown below were prepared:

(Water washing substitute)

Aldehyde derivative (as indicated in Table 1) 5-Chloro-2-methyl-4-isothiazoline-3-one, 0.1 g To each of the above water washing substitute, a running bleach-fixing solution (0.02 g as calculated on silver) was added, and the mixture was made up to one liter and adjusted to pH 7.5 with ammonium oxide or sulfuric acid.

The above water washing substitute was stored at room temperature (about 25° C.), and formation of silver sulfide was observed.

The results are shown in Table 1.

TABLE 1

| Processing liquor No. | Aldehyde derivative (mole/water-substitutive stabilizing solution 1 l) | Formation of silver sulfide (time lapse) 1 day | 3 days | 5 days | 7 days |
|---|---|---|---|---|---|
| 1 Control | Exemplary compound V-1 $2.0 \times 10^{-1}$ | generated | — | | — |
| 2 Control | Exemplary compound V-1 ($8.0 \times 10^{-2}$) | none | generated | — | — |
| 3 The invention | Exemplary compound V-1 ($2.5 \times 10^{-2}$) | none | none | none | slightly generated |
| 4 The invention | Exemplary compound V-1 ($2.0 \times 10^{-3}$) | none | none | none | none |
| 5 The invention | Exemplary compound V-1 ($2.0 \times 10^{-5}$) | none | none | none | none |
| 6 Control | Exemplary compound V-1 ($2.0 \times 10^{-6}$) | none | none | none | none |
| 7 Control | none | none | none | none | none |
| 8 Control | Exemplary compound VI-1 ($5.0 \times 10^{-1}$) | none | generated | — | — |
| 9 The invention | Exemplary compound VI-1 ($8.0 \times 10^{-2}$) | none | none | none | slightly generated |
| 10 The invention | Exemplary compound VI-1 ($2.0 \times 10^{-2}$) | none | none | none | none |
| 11 The invention | Exemplary compound VI-1 ($2.0 \times 10^{-4}$) | none | none | none | none |
| 12 The invention | Exemplary compound VI-1 ($2.0 \times 10^{-5}$) | none | none | none | none |
| 13 Control | Exemplary compound VI-1 ($2.0 \times 10^{-6}$) | none | none | none | none |

As apparently seen from the results in Table 1, under the conditions in Example 1, in the cases where the concentration was made higher outside of the present invention (processing liquors No. 1, 2 and 8), silver sulfide was found to be generated with lapse of time of one day. Thus, it can be understood that sulfide formation is greatly dependent on the concentration of the aldehyde derivative.

EXAMPLE 2

On a paper support laminated with polyethylene, the respective layers shown below were successively coated from the support side to prepare a light-sensitive sample.

Layer 1 . . . layer containing 1.3 g/m$^2$ of gelatin, 0.42 g/m$^2$ (as calculated on silver, hereinafter the same) of a blue-sensitive silver chlorobromide emulsion (95 mol% as AgCl) and $1 \times 10^{-3}$ mol/m$^2$ of the yellow coupler (Y-1) shown below dissolved in 0.50 g/m$^2$ of dioctyl phthalate.

Layer 2 . . . intermediate layer comprising 0.68 g/m$^2$ of gelatin.

Layer 3 . . . layer containing 1.20 g/m$^2$ of gelatin, 0.25 g/m$^2$ of green-sensitive silver chlorobromide emulsion (98 mol% as AgCl) and $1 \times 10^{-3}$ mol/m$^2$ of the present magenta coupler or the Comparative magenta coupler Mc-1 shown below (as indicated in Table 2) dissolved in 0.28 g/m$^2$ of dioctyl phthalate.

Layer 4 . . . intermediate layer comprising 1.1 g/m$^2$ of gelatin.

Layer 5 . . . layer containing 1.4 g/m$^2$ of gelatin, 0.25 g/m$^2$ of red-sensitive silver chlorobromide emulsion (98 mol% as silver chloride) and $1.5 \times 10^{-3}$ mol/m$^2$ of Comparative cyan coupler Cc-1 shown below dissolved in 0.20 g/m$^2$ of dibutyl phthalate.

Layer 6 . . . layer containing 1.0 g/m$^2$ of gelatin and 0.31 g/m$^2$ of a compound represented by the following Formula 4:

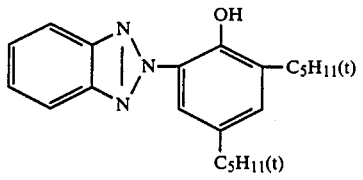

Formula 4 which is dissolved in 0.20 g/m$^2$ of dioctyl phthalate.

Layer 7 . . . layer containing 0.48 g/m$^2$ of gelatin.

Also, as the film hardener, 2,4-dichloro-6-hydroxy-s-triazine sodium was added into the layers 2, 4 and 7 each so as to give an amount of 0.017 g per 1 g of gelatin.

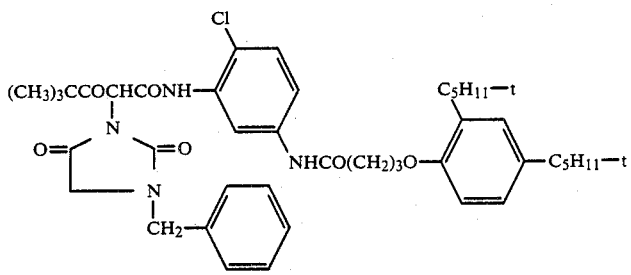

Y-1

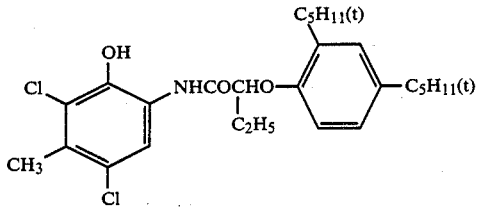

Cc-1

Next, after these samples were subjected to wedge exposure in conventional manner, the following developing processing was applied.

| Processing steps | Processing temperature | Processing time |
|---|---|---|
| [1] Color developing | 35° C. | 45 sec. |
| [2] Bleach-fixing | 35° C. | 45 sec. |
| [3] *Processing with Water washing substitute | 30° C. | 90 sec. |
| [4] Drying | 60–80° C. | 60 sec. |

*With 3 tanks cascade, processing time per 1 tank was made 30 seconds.

The processing liquors employed had the following compositions.

| (Color developing solution) | |
|---|---|
| Potassium chloride | 2.0 g |
| Potassium sulfide (50% solution) | 0.6 ml |
| Potassium carbonate | 30.0 g |
| Color developing agent (3-methyl-4-amino-N—ethyl-N—(β-methanesulfonamidoethyl)-anilinesulfate) | 5.0 g |
| Diethylhydroxylamine | 5.0 g |
| Triethanolamine | 10 g |

(made up to the total quantity of 1 liter with addition of water, and adjusted to pH 10.15 with potassium hydroxide or sulfuric acid).

The bleach-fixing solution had the following composition.

| (Bleach-fixing solution) | |
|---|---|
| Ferric ammonium ethylenediaminetetraacetatedihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

(made up to the total quantity of 1 liter with addition of water, and adjusted to pH 7.1 with ammonium hydroxide or glacial acetic acid).

For the water washing substitute, the processing liquor used in Example 1 (as indicated in Table 2) was employed.

The samples after developing processing were subjected to measurement of the density Dmin at the unexposed portion (minimum density of the magenta dye density) by means of Sakura Photoelectric Densitometer PDA-65 (produced by Konishiroku Photo Industry K.K.), and thereafter stored under the conditions of 75° C. and 80% RH (relative humidity) for 7 days, and then the magenta dye minimum density of the unexposed portion after storage was measured, and the difference is shown in Table 2.

Comparative magenta coupler Mc-1

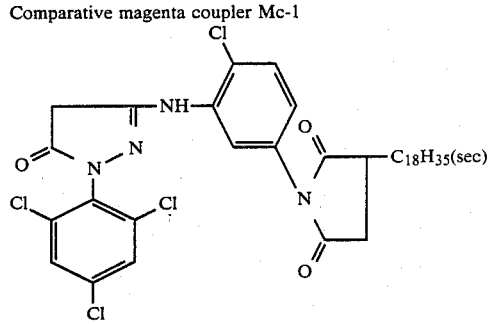

TABLE 2

| Sample No. | Processing liquor | Magenta coupler | Image storability 75° C. 80% RH (Difference in concentration of Blue) |
|---|---|---|---|
| 1 | 1 | Comparative Mc-1 | 0.10 |
| 2 | | M-18 | 0.02 |
| 3 | 2 | Comparative Mc-1 | 0.12 |
| 4 | | M-18 | 0.02 |
| 5 | 3 | Comparative Mc-1 | 0.15 |
| 6 | | M-18 | 0.03 |
| 7 | 4 | Comparative Mc-1 | 0.20 |
| 8 | | M-18 | 0.03 |
| 9 | 5 | Comparative Mc-1 | 0.26 |
| 10 | | M 18 | 0.07 |
| 11 | 6 | Comparative Mc-1 | 0.29 |
| 12 | | M-18 | 0.15 |
| 13 | 7 | Comparative Mc-1 | 0.30 |
| 14 | | M-18 | 0.16 |
| 15 | 8 | Comparative Mc-1 | 0.13 |
| 16 | | M-18 | 0.02 |
| 17 | 9 | Comparative Mc-1 | 0.16 |
| 18 | | M-18 | 0.03 |
| 19 | 10 | Comparative Mc-1 | 0.19 |
| 20 | | M-18 | 0.03 |
| 21 | 11 | Comparative Mc-1 | 0.24 |
| 22 | | M-18 | 0.06 |

TABLE 2-continued

| Sample No. | Processing liquor | Magenta coupler | Image storability 75° C. 80% RH (Difference in concentration of Blue) |
|---|---|---|---|
| 23 | 12 | Comparative Mc-1 | 0.29 |
| 24 | | M-18 | 0.09 |
| 25 | 13 | Comparative Mc-1 | 0.31 |
| 26 | | M-18 | 0.18 |

As is apparent from Table 2, although yellow stain is great even by use of the water washing substitute of the present invention, it can be understood that yellow stain is markedly prevented in the combination with the magenta coupler of the present invention.

Also, similar evaluation were conducted for M-5, M-7, M-44, M-59, M-104, M-182 and M-202 in place of the magenta coupler M-18, and substantially the same results for M-18 were obtained.

EXAMPLE 3

On a paper support laminated with polyethylene, the respective layers shown below were successively coated from the support side to prepare a light-sensitive sample.

Layer 1 . . . layer containing 1.3 g/m$^2$ of gelatin, 0.42 g/m$^2$ (as calculated on silver, hereinafter the same) of a blue-sensitive silver chlorobromide emulsion (95 mol% as AgCl) and $1\times10^{-3}$ mol/m$^2$ of the yellow coupler (Y-1) shown below dissolved in 0.50 g/m$^2$ of dioctyl phthalate.

Layer 2 . . . intermediate layer comprising 0.68 g/m$^2$ of gelatin.

Layer 3 . . . layer containing 1.20 g/m$^2$ of gelatin, 0.25 g/m$^2$ of green-sensitive silver chlorobromide emulsion (98 mol% as AgCl) and $1\times10^{-3}$ mol/m$^2$ of the Comparative magenta coupler Mc-1 dissolved in 0.28 g/m$^2$ of dioctyl phthalate.

Layer 4 . . . intermediate layer comprising 1.1 g/m$^2$ of gelatin.

Layer 5 . . . layer containing 1.4 g/m$^2$ of gelatin, 0.25 g/m$^2$ of red-sensitive silver chlorobromide emulsion (98 mol% as silver chloride) and $1.5\times10^{-3}$ mol/m$^2$ of Comparative cyan coupler Cc-1 shown below or the present cyan coupler (as indicated in Table 3) dissolved in 0.20 g/m$^2$ of dibutyl phthalate.

Layer 6 . . . layer containing 1.0 g/m$^2$ of gelatin and 0.31 g/m$^2$ of a compound replesented by the Formula 4 described above, which is dissolved in 0.20 g/m$^2$ of dioctyl phthalate.

Layer 7 . . . layer containing 0.48 g/m$^2$ of gelatin.

Also, as the film hardener, 2,4-dichloro-6-hydroxy-s-triazine sodium was added into the layers 2, 4 and 7 each so as to give an amount of 0.017 g per 1 g of gelatin.

Y-1

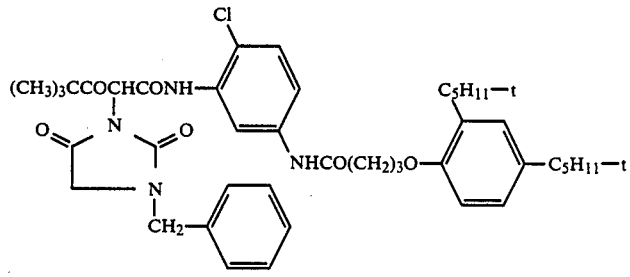

Mc-1

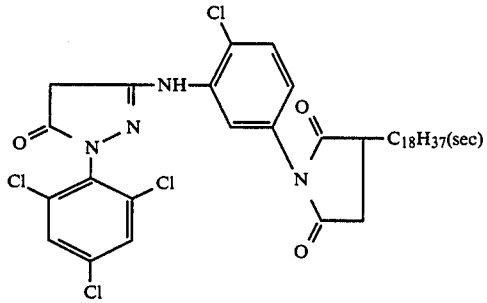

Next, after these samples were subjected to wedge exposure in conventional manner, the following developing processing was applied.

| Processing steps | Processing temperature | Processing time |
|---|---|---|
| [1] Color developing | 35° C. | 45 sec. |
| [2] Bleach-fixing | 35° C. | 45 sec. |
| [3] *Processing with water washing substitute | 30° C. | 90 sec. |
| [4] Drying | 60–80° C. | 60 sec. |

*With 3 tanks cascade, processing time per 1 tank was made 30 seconds.

The processing liquors employed had the following compositions.

| (Color developing solution) | |
|---|---|
| Potassium chloride | 2.0 g |
| Potassium sulfide (50% solution) | 0.6 ml |
| Potassium carbonate | 30.0 g |
| Color developing agent (3-methyl-4-amino-N—ethyl-N—(β-methanesulfonamidoethyl)-anilinesulfate) | 5.0 g |
| Diethylhydroxylamine | 5.0 g |
| Triethanolamine | 10 g |

(made up to the total quantity of 1 liter with addition of water, and adjusted to pH 10.15 with potassium hydroxide or sulfuric acid).

The bleach-fixing solution had the following composition.

| (Bleach-fixing solution) | |
|---|---|
| Ferric ammonium ethylenediaminetetra-acetatedihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

(made up to the total quantity of 1 liter with addition of water, and adjusted to pH 7.1 with ammonium hydroxide or glacial acetic acid).

For the water washing substitute, the processing liquor used in Example 1 (as indicated in Table 2) was employed.

The samples after developing processing were subjected to measurement of the density Dmin at the unexposed portion (minimum density of the cyan dye density) by means of Sakura Photoelectric Densitometer PDA-65 (produced by Konishiroku Photo Industry K.K.), and thereafter stored under the conditions of 75° C. and 80%RH (relative humidity) for 7 days, and then the cyan dye minimum density of the unexposed portion after storage was measured, and the difference is shown in Table 3.

Comparative magenta coupler Cc-1

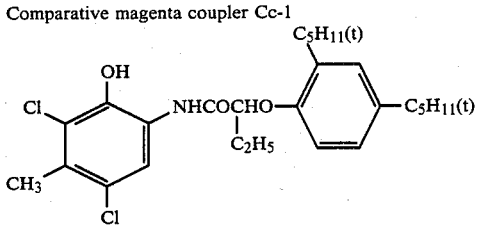

TABLE 3

| Sample No. | Processing liquor | Cyan coupler | Image storability 75° C. 80% RH (Difference in concentration of Red) |
|---|---|---|---|
| 27 | 1 | Comparative Cc-1 | 0.06 |
| 28 | | C-8 | 0.01 |
| 29 | 2 | Comparative Cc-1 | 0.06 |
| 30 | | C-8 | 0.01 |
| 31 | 3 | Comparative Cc-1 | 0.07 |
| 32 | | C-8 | 0.02 |
| 33 | 4 | Comparative Cc-1 | 0.08 |
| 34 | | C-8 | 0.02 |
| 35 | 5 | Comparative Cc-1 | 0.11 |
| 36 | | C-8 | 0.03 |
| 37 | 6 | Comparative Cc-1 | 0.13 |
| 38 | | C-8 | 0.06 |
| 39 | 7 | Comparative Cc-1 | 0.13 |
| 40 | | C-8 | 0.08 |
| 41 | 8 | Comparative Cc-1 | 0.08 |
| 42 | | C-8 | 0.01 |
| 43 | 9 | Comparative Cc-1 | 0.09 |
| 44 | | C-8 | 0.02 |
| 45 | 10 | Comparative Cc-1 | 0.10 |
| 46 | | C-8 | 0.02 |
| 47 | 11 | Comparative Cc-1 | 0.12 |
| 48 | | C-8 | 0.03 |
| 49 | 12 | Comparative Cc-1 | 0.13 |
| 50 | | C-8 | 0.04 |
| 51 | 13 | Comparative Cc-1 | 0.14 |
| 52 | | C-8 | 0.08 |

As is apparent from Table 3, although cyan stain is great even by use of the water washing substitute of the present invention, it can be understood that cyan stain is markedly prevented in the combination with the cyan coupler of the present invention.

Also, similar evaluation were conducted for C-2, C-57 and C-103 in place of the cyan coupler C-8, and substantially the same results for C-8 were obtained.

EXAMPLE 4

On a cellulose triacetate film support, a multi-layer color light-sensitive material was prepared comprising the respective layers with the compositions as shown below was prepared.

First layer: hallation preventive layer, a gelatin layer containing black colloidal silver.

Second layer: intermediate layer (gelatin layer).

Third layer: first red-sensitive emulsion layer,

Silver iodobromide (silver iodide: 3.5 mol%, monodispersed spherical grains with average grain size of 0.5 μm) . . . amount of silver coated 0.8 g/m$^2$ Silver iodobromide (silver iodide: 3 mol%, monodispersed spherical grains with average grain size of 0.5 μm) . . . amount of silver coated 0.8 g/m$^2$ Sensitizing dye I (shown below) . . . $6\times10^{-5}$ mol per 1 mol of silver Sensitizing dye II (shown below) . . . $1.5\times10^{-5}$ mol per 1 mol of silver Cyan coupler (shown below) . . . 0.044 mol per 1 mol of silver Fourth layer: second red-sensitive emulsion layer, Silver iodobromide (silver iodide: 5 mol%, monodispersed spherical grains with average grain size of 1.0 μm) . . . amount of silver coated 2.0 g/m$^2$ Sensitizing dye I . . . $3.5\times10^{-5}$ mol per 1 mol of silver Sensitizing dye II . . . $1.0\times10^{-5}$ mol per 1 mol of silver Cyan coupler (shown below) . . . 0.020 mol per 1 mol of silver Fifth layer: intermediate layer, the same as the second layer Sixth layer: first green-sensitive emulsion layer Silver halide emulsion (silver iodide: 4.0 mol%, mono-dispersed spherical grains with average grain size of 0.5 μm) . . . amount of silver coated 1.8 g/m$^2$ Sensitizing dye III . . . $3.3\times10^{-5}$ mol per 1 mol of silver Sensitizing dye IV . . . $1.1\times10^{-5}$ mol per 1 mol of silver Magenta coupler (shown below) . . . 12 g per 1 mol of silver Seventh layer: second green-sensitive emulsion layer Silver halide emulsion (silver iodide: 5.0 mol%, mono-dispersed spherical grains with average grain size of 1.0 μm) . . . amount of silver coated 1.8 g/m$^2$ Sensitizing dye III . . . $2.65\times10^{-5}$ mol per 1 mol of silver Sensitizing dye IV . . . $0.89\times10^{-5}$ mol per 1 mol of silver Magenta coupler (shown below) . . . 0.02 mol per 1 mol of silver Eighth layer: yellow filter layer, a gelatin layer containing yellow colloidal silver in an aqueous gelatin solution Ninth layer: first blue-sensitive emulsion layer Silver iodobromide (silver iodide: 5.6 mol%, monodispersed spherical grains with average grain size of 0.4 μm) . . . amount of silver coated 1.5 g/m$^2$ Yellow coupler (shown below) . . . 0.25 mol per 1 mol of silver Tenth layer: second blue-sensitive emulsion layer Silver iodobromide (silver iodide: 6 mol%, monodispersed spherical grains with average grain size of 0.90 μm) . . . amount of silver coated 1.21 g/m$^2$ Yellow coupler (shown below) . . . 0.06 mol per 1 mol of silver Eleventh layer: first protective layer Silver iodobromide (silver iodide: 1 mol%, monodispersed spherical grains with average grain size of 0.07 μm) . . . amount of silver coated 0.5 g, a gelatin layer containing an emulsion of UV-absorber.

Twelfth layer: second protective layer, a gelatin layer containing trimethyl methacrylate particles (diameter 1.5 μm) in the respective layers, in addition to the above composition, gelatin hardeners and surfactants were added.

Sensitizing dye I: anhydro-5,5'-dichloro-3,3'-(γ-sulfopropyl)-9-ethyl-thiacarbocyanine hydroxide pyridium salt Sensitizing dye II: anhydro-9-ethyl-3,3'-di-(γ-sulfopropyl)-4,5,4',5'-dibenzothiacarbocyanine hydroxide triethylamine salt Sensitizing dye III: anhydro-9-ethyl-5,5'-dichloro-3,3'-di-(γ-sulfopropyl)oxacarbocyanine sodium salt Sensitizing dye IV: anhydro-5,6,5',6'-tetradichloro-1,1'-diethyl-3,3'-di-{β-[β-(γ-sulfopropoxy)ethoxy]}ethylimidazolocarbocyanine hydroxide sodium salt Cyan couplers

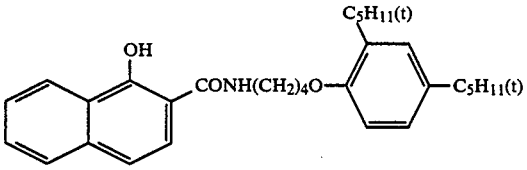

Magenta coupler

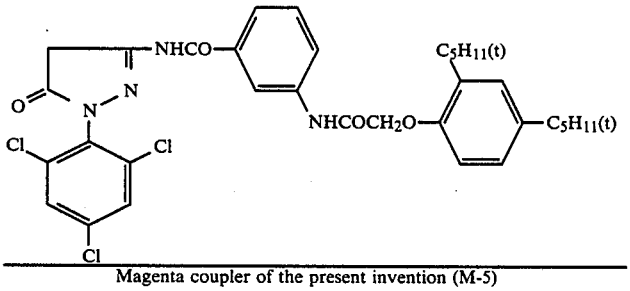

Magenta coupler of the present invention (M-5)

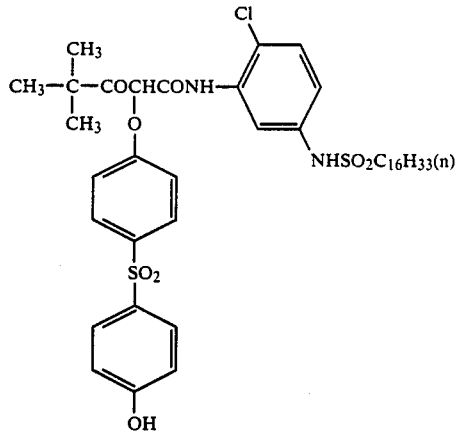

Yellow coupler

The above light-sensitive material was subjected to processing by an automatic developing machine according to the following steps. As the automatic developing machine, CL-NP34 (produced by Konishiroku Photo Industry K.K.) was modified and used.

| Processing steps (38° C.) | Number of tanks | Processing time |
|---|---|---|
| Color developing | 1 | 3 min. 15 sec. |
| Bleaching | 1 | 3 min. 15 sec. |
| Fixing | 1 | 3 min. 15 sec. |
| Processing with water washing substitute (cascade system) | 3 | 2 min. 30 sec. |

The color developing solution used had the following composition.

| | |
|---|---|
| Potassium carbonate | 30 g |
| Sodium hydrogen carbonate | 2.5 g |
| Potassium sulfite | 5 g |
| Sodium bromide | 1.3 g |
| Potassium iodide | 2 mg |
| Hydroxylaminesulfate | 2.5 g |
| Sodium chloride | 0.6 g |
| 4-Amino-3-methyl-N—ethyl-N—(β-hydroxylethyl) aniline sulfate | 4.8 g |
| Potassium hydroxide | 1.2 g |

(made up to 1 liter with addition of water, and adjusted to pH 10.06 with potassium hydroxide or 20% sulfuric acid).

The color developing replenishing solution had the following composition.

| | |
|---|---|
| Potassium carbonate | 40 g |

-continued

| | |
|---|---|
| Sodium hydrogen carbonate | 3 g |
| Potassium sulfite | 7 g |
| Sodium bromide | $3.0 \times 10^{-3}$ mol |
| Hydroxylaminesulfate | 3.1 g |
| 4-Amino-3-methyl-N—ethyl-N—(β-hydroxylethyl) aniline sulfate | 6.0 g |
| Potassium hydroxide | 2 g |

(made up to 1 liter with addition of water, and adjusted to pH 10.12 with potassium hydroxide or 20% sulfuric acid).

The bleaching solution used had the following composition.

| | |
|---|---|
| Iron ammonium ethylenediamine tetraacetate | 100 g |
| Disodium ethylenediamine tetraacetate | 10 g |
| Ammonium bromide | 150 g |
| Glacial acetic acid | 10 ml |

(made up to 1 liter with addition of water, and adjusted to pH 5.8 with ammonia water or glacial acetic acid).

The bleaching replenishing solution used had the following composition.

| | |
|---|---|
| Iron ammonium ethylenediamine tetraacetate | 120 g |
| Disodium ethylenediamine tetraacetate | 12 g |
| Ammonium bromide | 178 g |
| Glacial acetic acid | 21 ml |

(made up to 1 liter with addition of water, and adjusted to pH 5.6 with ammonia water or glacial acetic acid).

The fixing solution used had the following composition.

| | |
|---|---|
| Ammonium thiosulfate | 150 g |
| Anhydrous sodium bisulfite | 12 g |
| Sodium metabisulfite | 2.5 g |
| Disodium ethylenediaminetetraacetate | 0.5 g |
| Sodium carbonate | 10 g |

(made up to 1 liter with addition of water).

The fixing replenishing solution had the following composition.

| | |
|---|---|
| Ammonium thiosulfate | 200 g |
| Anhydrous sodium bisulfite | 15 g |
| Sodium metabisulfite | 3 g |
| Disodium ethylenediaminetetraacetate | 0.8 g |
| Sodium carbonate | 14 g |

(made up to 1 liter with addition of water).

The water washing substitute and its replenishing solution had the following composition.

| | |
|---|---|
| Aldehyde derivative (V-1) | Indicated in Table 4 |
| Additive (VIII-5) | 0.5 g |
| 5-Chloro-2-methyl-4-isothiazolin-3-one | 0.05 g |
| 2-Methyl-4-isothiazolin-3-one | 0.05 g |

(made up to 1 liter with addition of water, and adjusted to pH 7.0 with ammonium hydroxide or sulfuric acid).

The color developing replenishing solution was replenished into the color developing bath in an amount of 1450 ml per 1 $m^2$ of the light-sensitive material, the bleaching replenishing solution into the bleaching bath in an amount of 925 ml per 1 $m^2$, and the fixing replenishing solution into the fixing bath in an amount of 925 ml per 1 $m^2$. The water washing substitute was supplied according to the 3 tanks cascade system, with the replenished amount being made as indicated in Table 4, and processing was conducted until the replenishing solution become the volume of the 3 tanks for the water washing substitute, and thereafter silver sulfide formation was observed after a storage period of 1 week according to the same method as in Example 1. Also, the maximum density of the magenta dye was measured according to the same method as in Example 2 to measure the density lowering after storage (however, transmitted density).

The amount of the fixing solution carried over with the light-sensitive material into the water washing substitute was 50 ml/$m^2$.

The results are shown in Table 4.

TABLE 4

| Sample No. | Aldehyde derivative (mole/water-washing substitute | Amount of water-washing substitute replenished (ml/$m^2$) | Formation of silver sulfide (time lapse) | Image storability (Difference in concentration of Cyan) |
|---|---|---|---|---|
| 53 | $5.0 \times 10^{-2}$ | 50(1 fold) | generated | −0.02 |
| 54 | | 100(2 fold) | generated | −0.02 |
| 55 | | 500( 10 fold) | generated | −0.03 |
| 56 | | 2500(50 fold) | generated | −0.04 |
| 57 | | 5000(100 fold) | generated | −0.04 |
| 58 | $1.5 \times 10^{-2}$ | 50(1 fold) | generated | −0.02 |
| 59 | | 100(2 fold) | slightly generated | −0.03 |
| 60 | | 500(10 fold) | no generation | −0.04 |
| 61 | | 2500(50 fold) | no generation | −0.04 |
| 62 | | 5000(100 fold) | no generation | −0.07 |
| 63 | $1.5 \times 10^{-4}$ | 50(1 fold) | generated | −0.02 |
| 64 | | 100(2 fold) | no generation | −0.03 |
| 65 | | 500(10 fold) | no generation | −0.04 |
| 66 | | 2500(50 fold) | no generation | −0.05 |
| 67 | | 5000(100 fold) | no generation | −0.09 |
| 68 | $1.5 \times 10^{-5}$ | 50(1 fold) | no generation | −0.08 |
| 69 | | 100(2 fold) | no generation | −0.11 |
| 70 | | 500(10 fold) | no generation | −0.13 |
| 71 | | 2500(50 fold) | no generation | −0.15 |
| 72 | | 5000(100 fold) | no generation | −0.16 |

As is apparent from Table 4, silver sulfide will be generated with difficulty as the concentration of the aldehyde derivative is lowered, but on the contrary, image storability will be deteriorated. Also, when the replenished amount of the water washing substitute is extremely low (50 ml/m$^2$), while silver sulfide is readily generated, image storability is good. On the other hand, when it is extremely much (5000 ml/m$^2$), while silver sulfide is generated with difficulty, there is the problem that image storability is lowered. Thus, when the replenished amount of the water washing substitute is 100 to 2500 ml/m$^2$, particularly 500 ml/m$^2$ or higher at the concentration of the aldehyde derivative of the present invention, silver sulfide is generated with difficulty and also image storability is good.

Also, by use of Comparative couplers Mc-2 to Mc-5 as the comparative coupler, evaluation was made based on Example 4. As the result, the magenta density was found to be as low as 0.10 to 0.15 as compared with the magenta coupler of the present invention, thus indicating deteriorated image storability.

Comparative Mc-2

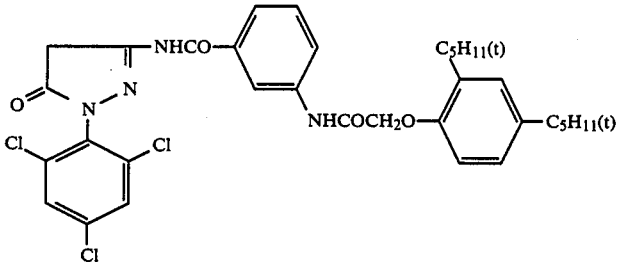

Comparative Mc-3

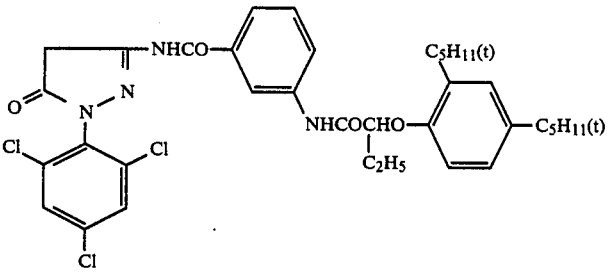

Comparative Mc-4

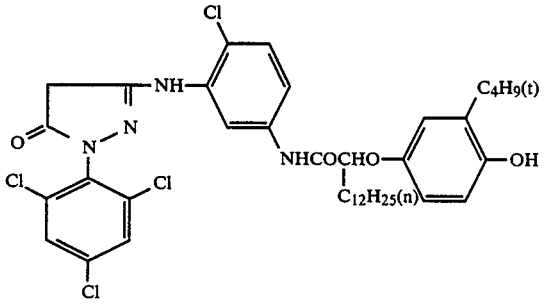

Comparative Mc-5

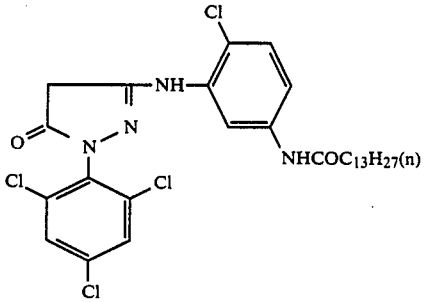

EXAMPLE 5

On a cellulose triacetate film support, a multi-layer color light-sensitive material was prepared comprising the respective layers with the compositions as shown below was prepared.

First layer: hallation preventive layer, a gelatin layer containing black colloidal silver.

Second layer: intermediate layer (gelatin layer).

Third layer: first red-sensitive emulsion layer,

Silver iodobromide (silver iodide: 3.5 mol%, monodispersed spherical grains with average grain size of 0.5 μm) . . . amount of silver coated 0.8 g/m$^2$ Silver iodobromide (silver iodide: 3 mol%, monodispersed spherical grains with average grain size of 0.5 μm) . . . amount of silver coated 0.8 g/m$^2$ Sensitizing dye I (shown below) . . . $6\times10^{-5}$ mol per 1 mol of silver Sensitizing dye II (shown below) . . . $1.5\times10^{-5}$ mol per 1 mol of silver Cyan coupler (shown below) . . . 0.044 mol per 1 mol of silver Fourth layer: second red-sensitive emulsion layer, Silver iodobromide (silver iodide: 5 mol%, monodispersed spherical grains with average grain size of 1.0 μm) . . . amount of silver coated 2.0 g/m$^2$ Sensitizing dye I . . . $3.5\times10^{-5}$ mol per 1 mol of silver Sensitizing dye II . . . $1.0\times10^{-5}$ mol per 1 mol of silver Cyan coupler (shown below) . . . 0.020 mol per 1 mol of silver Fifth layer: intermediate layer, the same as the second layer Sixth layer: first green-sensitive emulsion layer Silver halide emulsion (silver iodide: 4.0 mol%, mono-dispersed spherical grains with average grain size of 0.5 μm) . . . amount of silver coated 1.8 g/m$^2$ Sensitizing dye III . . . $3.3\times10^{-5}$ mol per 1 mol of silver Sensitizing dye IV . . . $1.1\times10^{-5}$ mol per 1 mol of silver Magenta coupler (shown below) . . . 12 g per 1 mol of silver Seventh layer: second green-sensitive emulsion layer Silver halide emulsion (silver iodide: 5.0 mol%, mono-dispersed spherical grains with average grain size of 1.0 μm) . . . amount of silver coated 1.8 g/m$^2$ .

Sensitizing dye III . . . $2.65\times10^{-5}$ mol per 1 mol of silver

Sensitizing dye IV . . . $0.89\times10^{-5}$ mol per 1 mol of silver

Magenta coupler (shown below) . . . 0.02 mol per 1 mol of silver

Eighth layer: yellow filter layer, a gelatin layer containing yellow colloidal silver in an aqueous gelatin solution Ninth layer: first blue-sensitive emulsion layer Silver iodobromide (silver iodide: 5.6 mol%, mono-dispersed spherical grains with average grain size of 0.4 μm) . . . amount of silver coated 1.5 g/m$^2$ Yellow coupler (shown below) . . . 0.25 mol per 1 mol of silver Tenth layer: second blue-sensitive emulsion layer Silver iodobromide (silver iodide: 6 mol%, monodispersed spherical grains with average grain size of 0.90 μm) . . . amount of silver coated 1.21 g/m$^2$ Yellow coupler (shown below) . . . 0.6 mol per 1 mol of silver Eleventh layer: first protective layer Silver iodobromide (silver iodide: 1 mol%, monodispersed spherical grains with average grain size of 0.07 μm) . . . amount of silver coated 0.5 g, a gelatin layer containing an emulsion of UV-absorber.

Twelfth layer: second protective layer, a gelatin layer containing trimethyl methacrylate particles (diameter 1.5 μm) in the respective layers, in addition to the above composition, gelatin hardeners and surfactants were added.

Sensitizing dye I: anhydro-5,5'-dichloro-3,3'-(γ-sulfopropyl)-9-ethyl-thiacarbocyanine hydroxide pyridium salt Sensitizing dye II: anhydro-9-ethyl-3,3'-di-(γ-sulfopropyl)-4,5,4',5'-dibenzothiacarbocyanine hydroxide triethylamine salt Sensitizing dye III: anhydro-9-ethyl-5,5'-dichloro-3,3'-di-(γ-sulfopropyl)oxacarbocyanine sodium salt Sensitizing dye IV: anhydro-5,6,5',6'-tetradichloro-1,1'-diethyl-3,3'-di-{β-[β-(γ-sulfopropoxy)ethoxy]}ethylimidazolocarbocyanine hydroxide sodium salt Cyan couplers (Exemplary cyan coupler C-29)

Magenta coupler

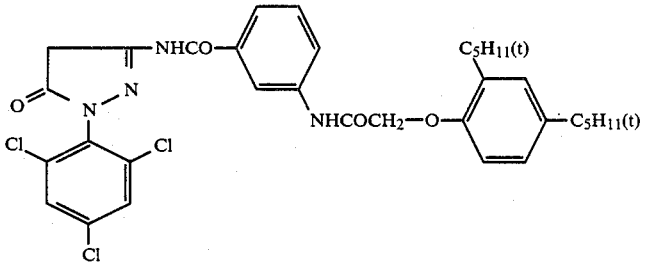

Yellow coupler

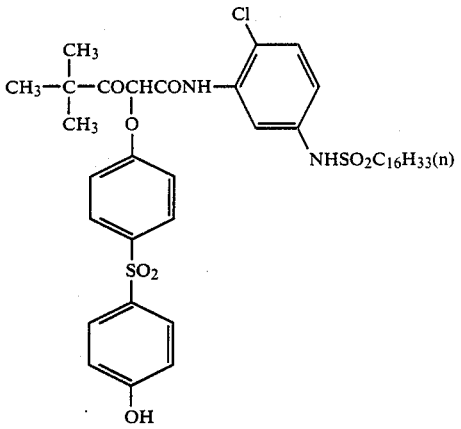

The above light-sensitive material was subjected to processing by an automatic developing machine according to the following steps. As the automatic developing machine, CL-NP34 (produced by Konishiroku Photo Industry K.K.) was modified and used.

| Processing steps (38° C.) | Number of tanks | Processing time |
|---|---|---|
| Color developing | 1 | 3 min. 15 sec. |
| Bleaching | 1 | 3 min. 15 sec. |
| Fixing | 1 | 3 min. 15 sec. |
| Processing with water washing substitute (cascade system) | 3 | 2 min. 30 sec. |

The color developing solution used had the following composition.

| | |
|---|---|
| Potassium carbonate | 30 g |
| Sodium hydrogen carbonate | 2.5 g |
| Potassium sulfite | 5 g |
| Sodium bromide | 1.3 g |
| Potassium iodide | 2 mg |
| Hydroxylaminesulfate | 2.5 g |
| Sodium chloride | 0.6 g |
| 4-Amino-3-methyl-N—ethyl-N—(β-hydroxylethyl) aniline sulfate | 4.8 g |
| Potassium hydroxide | 1.2 g |

(made up to 1 liter with addition of water, and adjusted to pH 10.06 with potassium hydroxide or 20% sulfuric acid).

The color developing replenishing solution had the following composition.

| | |
|---|---|
| Potassium carbonate | 40 g |
| Sodium hydrogen carbonate | 3 g |

-continued

| | |
|---|---|
| Potassium sulfite | 7 g |
| Sodium bromide | $3.0 \times 10^{-3}$ mol |
| Hydroxylaminesulfate | 3.1 g |
| 4-Amino-3-methyl-N—ethyl-N—(β-hydroxylethyl) aniline sulfate | 6.0 g |
| Potassium hydroxide | 2 g |

(made up to 1 liter with addition of water, and adjusted to pH 10.12 with potassium hydroxide or 20% sulfuric acid).

The bleaching solution used had the following composition.

| | |
|---|---|
| Iron ammonium ethylenediamine tetraacetate | 100 g |
| Disodium ethylenediamine tetraacetate | 10 g |
| Ammonium bromide | 150 g |
| Glacial acetic acid | 10 ml |

(made up to 1 liter with addition of water, and adjusted to pH 5.8 with ammonia water or glacial acetic acid).

The bleaching replenishing solution used had the following composition.

| | |
|---|---|
| Iron ammonium ethylenediamine tetraacetate | 120 g |
| Disodium ethylenediamine tetraacetate | 12 g |
| Ammonium bromide | 178 g |
| Glacial acetic acid | 21 ml |

(made up to 1 liter with addition of water, and adjusted to pH 5.6 with ammonia water or glacial acetic acid).

The fixing solution used had the following composition.

| | |
|---|---|
| Ammonium thiosulfate | 150 g |
| Anhydrous sodium bisulfite | 12 g |
| Sodium metabisulfite | 2.5 g |
| Disodium ethylenediaminetetraacetate | 0.5 g |
| Sodium carbonate | 10 g |

(made up to 1 liter with addition of water).

The fixing replenishing solution had the following composition.

| | |
|---|---|
| Ammonium thiosulfate | 200 g |
| Anhydrous sodium bisulfite | 15 g |
| Sodium metabisulfite | 3 g |
| Disodium ethylenediaminetetraacetate | 0.8 g |
| Sodium carbonate | 14 g |

(made up to 1 liter with addition of water).

The water washing substitute and its replenishing solution had the following composition.

| | |
|---|---|
| Aldehyde derivative (V-1) | Indicated in Table 5 |
| Additive (VIII-5) | 0.5 g |
| 5-Chloro-2-methyl-4-isothiazolin-3-one | 0.05 g |
| 2-Methyl-4-isothiazolin-3-one | 0.05 g |

(made up to 1 liter with addition of water, and adjusted to pH 7.0 with ammonium hydroxide or sulfuric acid).

The color developing replenishing solution was replenished into the color developing bath in an amount of 1450 ml per 1 $m^2$ of the light-sensitive material, the bleaching replenishing solution into the bleaching bath in an amount of 925 ml per 1 $m^2$, and the fixing replenishing solution into the fixing bath in an amount of 925 ml per 1 $m^2$. The water washing substitute was supplied according to the 3 tanks cascade system, with the replenished amount being made as indicated in Table 5, and processing was conducted until the replenishing solution became the volume of the 3 tanks for the water washing substitute, and thereafter silver sulfide formation was observed after a storage period of 1 week according to the same method as in Example 1. Also, the maximum density of the cyan dye was measured according to the same method as in Example 3 to measure the density lowering after storage (however, transmitted density).

The amount of the fixing solution carried over with the light-sensitive material into the water washing substitute was 50 ml/$m^2$.

The results are shown in Table 5.

TABLE 5

| Sample No. | Aldehyde derivative (mole/water-solution substitute) | Amount of water-solution substitute replenished (ml/$m^2$) | Formation of silver sulfide (time lapse: 1 week) | Image storability (Difference in concentration of Cyan) |
|---|---|---|---|---|
| 73 | $5.0 \times 10^{-2}$ | 50(1 fold) | generated | −0.01 |
| 74 | | 100(2 fold) | generated | −0.01 |
| 75 | | 500(10 fold) | generated | −0.02 |
| 76 | | 2500(50 fold) | generated | −0.03 |
| 77 | | 5000(100 fold) | generated | −0.03 |
| 78 | $1.5 \times 10^{-2}$ | 50(1 fold) | generated | −0.01 |
| 79 | | 100(2 fold) | slightly generated | −0.01 |
| 80 | | 500(10 fold) | no generation | −0.02 |
| 81 | | 2500(50 fold) | no generation | −0.03 |
| 82 | | 5000(100 fold) | no generation | −0.07 |
| 83 | $1.5 \times 10^{-4}$ | 50(1 fold) | generated | −0.02 |
| 84 | | 100(2 fold) | no generation | −0.02 |
| 85 | | 500(10 fold) | no generation | −0.02 |
| 86 | | 2500(50 fold) | no generation | −0.03 |
| 87 | | 5000(100 fold) | no generation | −0.08 |
| 88 | $1.5 \times 10^{-5}$ | 50(1 fold) | no generation | −0.09 |
| 89 | | 100(2 fold) | no generation | −0.09 |
| 90 | | 500(10 fold) | no generation | −0.10 |
| 91 | | 2500(50 fold) | no generation | −0.11 |
| 92 | | 5000(100 fold) | no generation | −0.13 |

As is apparent from Table 5, silver sulfide will be generated with difficulty as the concentration of the aldehyde derivative is lowered, but on the contrary, image storability will be deteriorated. Also, when the replenished amount of the water washing substitute is extremely low (50 ml/m$^2$), while silver sulfide is readily generated, image storability is good. On the other hand, when it is extremely much (5000 ml/m$^2$), while silver sulfide is generated with difficulty, there is the problem that image storability is lowered. Thus, when the replenished amount of the water washing substitute is 100 to 2500 ml/m$^2$, particularly 500 ml/m$^2$ or higher at the concentration of the aldehyde derivative of the present invention, silver sulfide is generated with difficulty and also image storability is good.

Also, by use of Comparative couplers described above, evaluation was made based on Example 5. As the result, the cyan density was found to be lowered to as low as 0.10 or more as compared with the present invention, thus indicating deteriorated image storability.

Comparative Cc-2

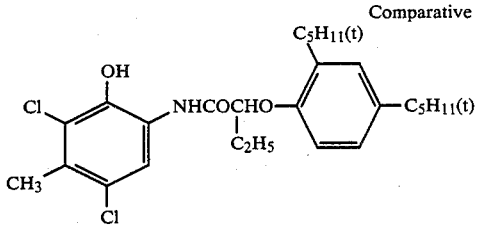

Comparative Cc-3

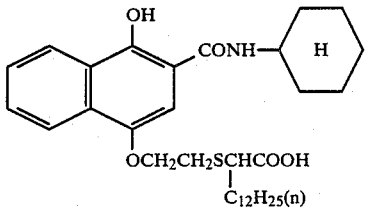

EXAMPLE 6

When the same evaluation as in Example 4 was conducted also for the aldehyde derivatives (V-2), (V-16), (VI-2) and (VII-2) in place of the aldehyde derivative (V-1), the same results as Example 4 were obtained. Also, for (VI-2) and (VII-2), no sulfidation occurred even when added in $8.0\times10^{-2}$ mol, and image storability was also good.

Also, when the same evaluation was conducted as in Example 4 for M-7, M-11, M-22 and M-127 in place of the magenta coupler M-5 of the present invention, the same results as in M-5 could be obtained.

EXAMPLE 7

When the same evaluation as in Example 5 was conducted also for (V-2), (V-16), (VI-2) and (VII-2) in place of the aldehyde derivative (V-1), the same results as Example 5 were obtained. Also, for (VI-2) and (VII-2), no sulfidation occurred even when added in $8.0\times10^{-2}$ mol, and image storability was also good.

Also, when the same evaluation was conducted as in Example 5 for C-30, C-31, C-36, C-51 and C-85 in place of the cyan coupler C-29 of the present invention, the same results as in C-29 could be obtained.

We claim:

1. A method for processing a light-sensitive silver halide color photographic material, which comprises including at least the step of color developing, the step of processing with a liquor having fixing ability and the step of processing with a washing solution substitute as the final processing step, after imagewise exposure of a light-sensitive silver halide color photographic material containing at least one silver halide emulsion layer on a support, characterized in that at least one layer of said silver halide emulsion layer contains at least one coupler selected from magenta couplers represented by Formula I shown below, cyan couplers represented by Formula II shown below, cyan couplers represented by Formula III shown below and cyan couplers represented by Formula IV shown below; said washing solution substitute contains at least one compound selected from the group consisting of from $2.0\times10^{-5}$ to $2.5\times10^{-2}$ mol per liter of said washing solution substitute of compounds represented by Formula V shown below, from $2.0\times10^{-5}$ to $8.0\times10^{-2}$ mol per liter of said washing solution substitute of compounds represented by Formula VI shown below and from $2.0\times10^{-5}$ to $8.0\times10^{-2}$ mol per liter of said washing solution substitute of compounds represented by Formula VII shown below; and the replenished amount of said washing solution substitute is at least 2 to 50-fold of the amount of processing solution in the processing steps prior to the step of processing with said washing solution substitute, which is carried over into said washing solution substitute by the light-sensitive photographic material processed in the step processed with said liquor having fixing ability:

Formula I

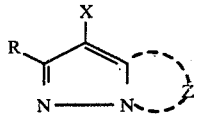

wherein Z represents a group of nonmetallic atoms necessary for formation of a nitrogen containing heterocyclic ring, and the ring formed by said Z may have a substituent; X represents a hydrogen atom or a substituent eliminatable through the reaction with the oxidized product of a color developing agent; and R represents a hydrogen atom or a substituent, Formula II

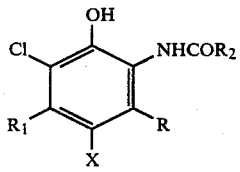

wherein one of R and $R_1$ is a hydrogen atom, and the other is a straight chain or branched alkyl group having at least 2 to 12 carbon atoms, X represents a hydrogen atom or a group eliminatable through the coupling reaction with the oxidized product of an aromatic primary amino color developing agent, and $R_2$ represents a ballast group,

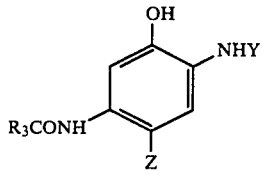

Formula III

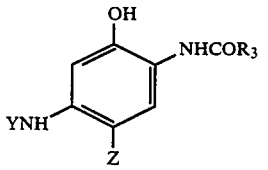

Formula IV wherein Y represents

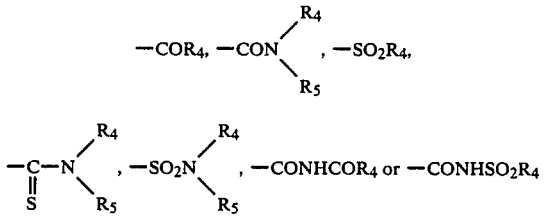

($R_4$ represents an alkyl group, an alkenyl group, a cycloalkyl group, an aryl group or a heterocyclic group, $R_5$ represents a hydrogen atom, an alkyl group, an alkenyl group, a cycloalkyl, an aryl group or a heterocyclic group, or $R_4$ and $R_5$ may be bonded together to form a 5- or 6-membered ring), $R_3$ represents a ballast group, Z represents a hydrogen atom or a group eliminatable through the coupling reaction with the oxidized product of an aromatic primary amine color developing agent, $A_1$—CHO Formula V wherein $A_1$ represents a hydrogen atom, an alkyl group having 1 to 6 carbon atoms, a formyl group, an acyl group or an alkenyl group,

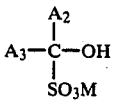

Formula VI wherein each of $A_2$ and $A_3$ represents a hydrogen atom, an alkyl group having 1 to 6 carbon atoms, a formyl group, an acyl group or an alkenyl group, and M represents an alkali metal,

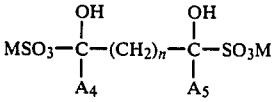

Formula VII wherein each of $A_4$ and $A_5$ represents a hydrogen atom, an alkyl group having 1 to 6 carbon atoms, a formyl group, an acyl group or an alkenyl group, M represents an alkali metal and n represents an integer of 0 to 4.

2. The method according to claim 1, wherein said step of processing with said washing solution substitute is practiced in a countercurrent system having at least two baths.

3. The method according to claim 1, wherein said compound contained in said washing solution substitute is at least one selected from the group consisting of compounds represented by Formula V.

4. The method according to claim 1, wherein said compound contained in said washing solution substitute is at least one selected from the group consisting of compounds represented by Formula VI and compounds represented by Formula VII.

5. The method according to claim 1, wherein said coupler is at least one selected from the group consisting of magenta couplers represented by Formula I.

6. The method according to claim 1, wherein said coupler is at least one selected from the group consisting of cyan couplers represented by Formula II, cyan couplers represented by Formula III and cyan couplers represented by Formula IV.

7. The method according to claim 1, wherein said compound contained in said washing solution substitute is at least one selected from the group consisting of compounds represented by Formula VI and compounds represented by Formula VII and said coupler is at least one selected from the group consisting of magenta couplers represented by Formula I.

8. The method according to claim 2, wherein said coupler is at least one selected from the group consisting of magenta couplers represented by Formula I.

9. The method according to claim 1, wherein said magenta coupler represented by Formula I is at least one selected from the group consisting of

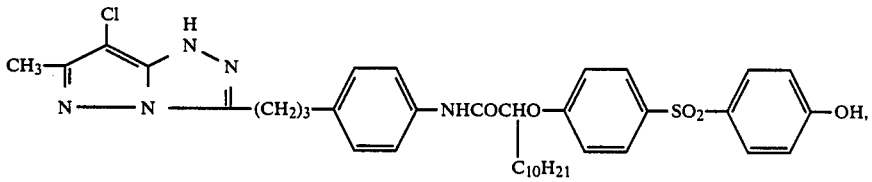

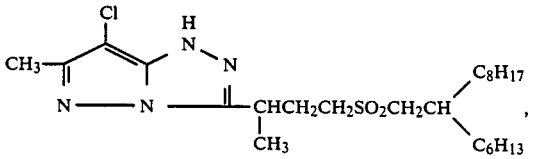

-continued
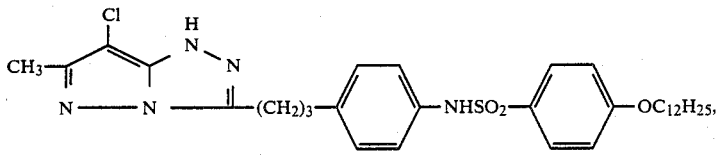
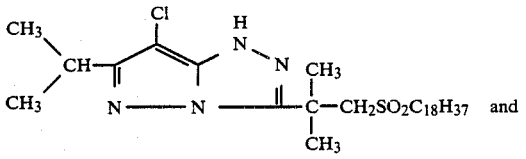
and
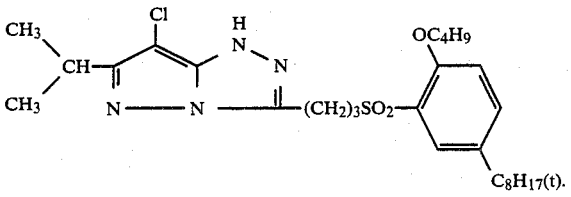
10. The method according to claim 2, wherein said magenta coupler represented by Formula I is at least one selected from the group consisting of
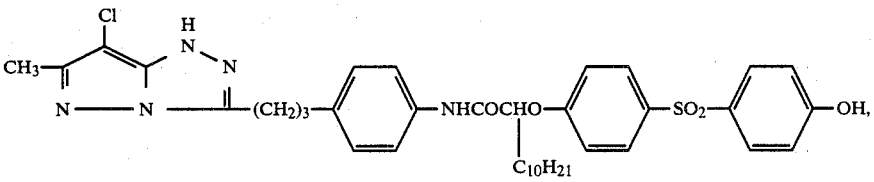
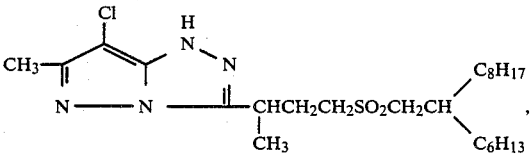
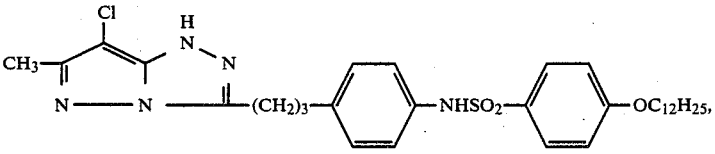
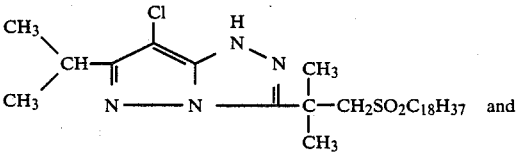
and
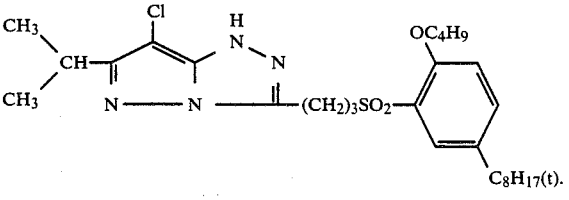
11. The method according to claim 7, wherein said magenta coupler represented by Formula I is at least one selected from the group consisting of

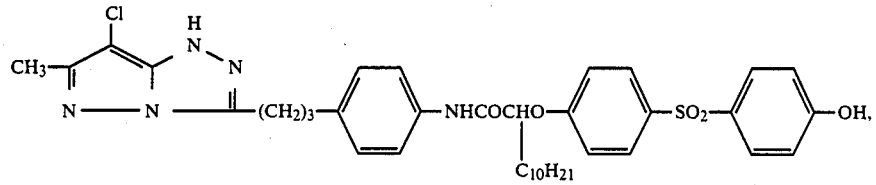

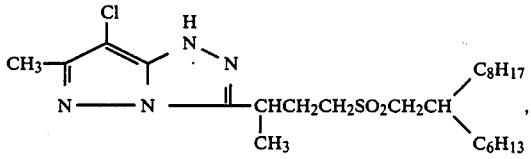

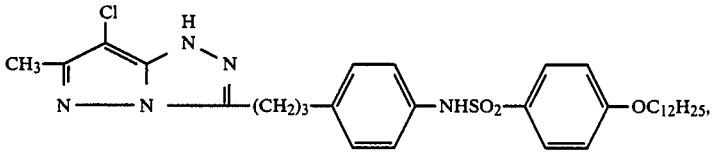

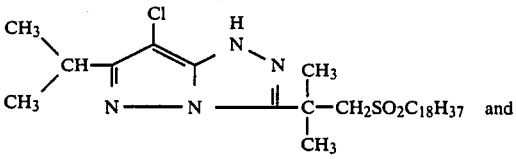

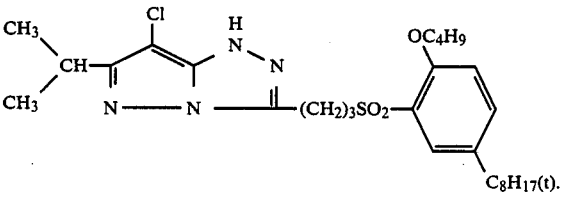

12. The method according to claim 1, wherein said magenta coupler represented by Formula I is contained in an amount of from $1\times10^{-3}$ mol to $5\times10^{-1}$ mol per 1 mol of silver halide.

13. The method according to claim 2, wherein said coupler represented by Formula I is contained in an amount of from $1\times10^{-3}$ mol to $5\times10^{-1}$ mol per 1 mol of silver halide.

14. The method according to claim 7, wherein said coupler represented by Formula I is contained in an amount of from $1\times10^{-3}$ mol to $5\times10^{-1}$ mol per 1 mol of silver halide.

15. The method according to claim 1, wherein $R_2$ in Formula II represents an alkyl group having total carbon atoms of 8 to 32 or an aryl group.

16. The method according to claim 1, wherein said cyan coupler represented by Formula II is selected from the group consisting of

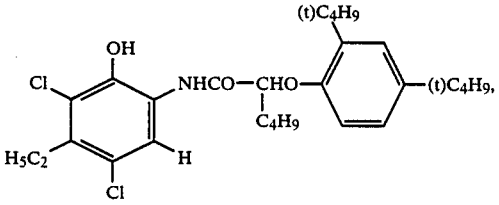

-continued

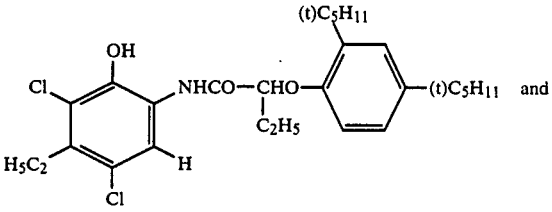

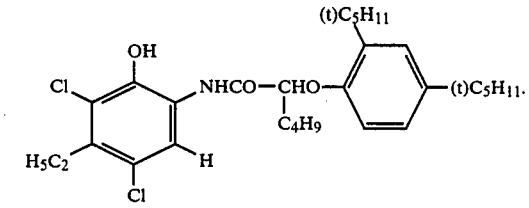

17. The method according to claim 1, wherein $R^3$ in Formula III or IV represents an alkyl group having 4 to 30 carbon atoms, an aryl group or a heterocyclic group.

18. The method according to claim 1, wherein said cyan coupler represented by Formula III or IV is selected from the group consisting of

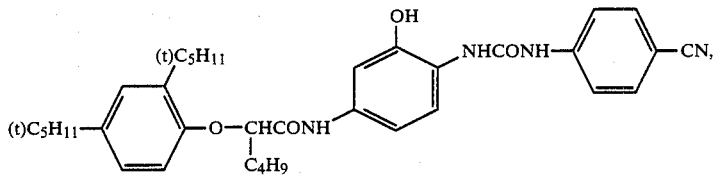
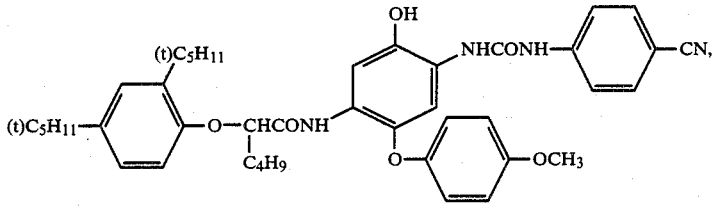
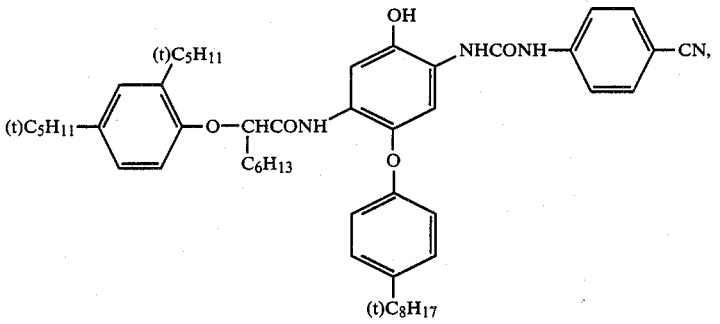
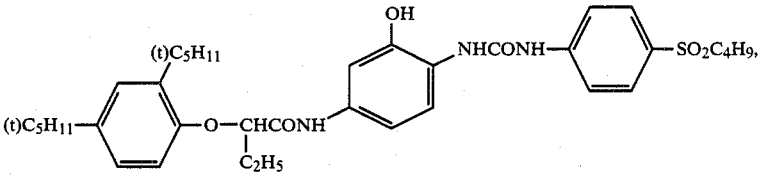
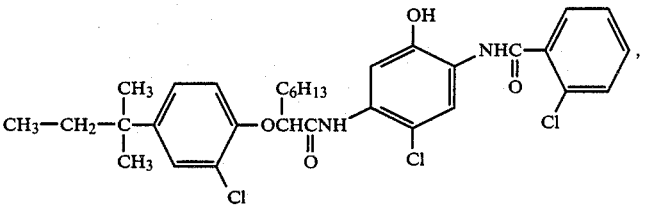
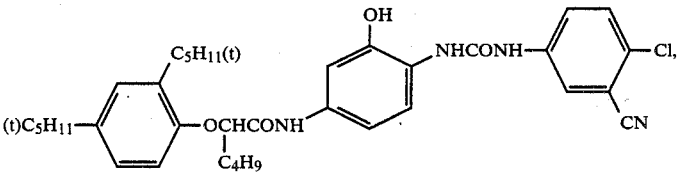
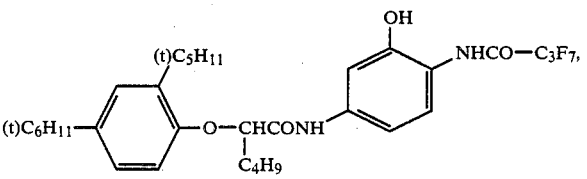

-continued

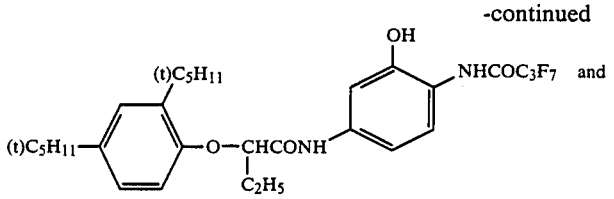

and

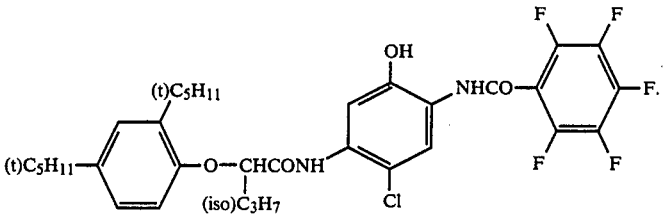

19. The method according to claim 1, wherein said cyan coupler is contained in an amount of 0.005 to 2 mol per 1 mol of silver halide.

20. The method according to claim 1, wherein the alkyl group having 1 to 6 carbon atoms represented by $A_1$, $A_2$, $A_3$, $A_4$ or $A_5$ in Formula V, VI or VII is a straight chain or branched, substituted or unsubstituted methyl group, ethyl group, propyl group, butyl group, valeric group or hexyl group, and the alkenyl group represented by $A_1$, $A_2$, $A_3$, $A_4$ or $A_5$ in Formula V, VI or VII is a substituted or unsubstituted vinyl group or 2-propenyl group.

21. The method according to claim 1, wherein the compound represented by Formula V, VI or VII is selected from the group consisting of formaldehyde, acetaldehyde, sodium formaldehyde bisulfite, sodium acetaldehyde bisulfite, sodium propionaldehyde bisulfite and sodium glutaraldehyde bisbisulfite.

22. The method according to claim 1, wherein said compound represented by Formula V is contained in an amount of from $5.0\times10^{-4}$ to $2.0\times10^{-2}$ mol per 1 liter of said washing solution substitute.

23. The method according to claim 1, wherein said compound represented by Formula VI or VII is contained in an amount of from $1.0\times10^{-4}$ to $4.0\times10^{-2}$ mol per 1 liter of said washing solution substitute.

24. The method according to claim 1, wherein the concentration of the previous bath components in the washing solution substitute is 1/50 to 1/100000.

25. The method according to claim 1, wherein the amount carried over is 50 ml/m$^2$ to 150 ml/m$^2$, and the replenished amount is in the range from 100 ml/m$^2$ to 4.0 liter/m$^2$.

* * * * *